US008727351B2

(12) United States Patent
Agamawi

(10) Patent No.: US 8,727,351 B2
(45) Date of Patent: May 20, 2014

(54) CUBE PUZZLE GAME

(76) Inventor: Mosen Agamawi, Maple Grove, MN (US)

( * ) Notice: Subject to any disclaimer, the term of this patent is extended or adjusted under 35 U.S.C. 154(b) by 481 days.

(21) Appl. No.: 12/807,100

(22) Filed: Aug. 27, 2010

(65) Prior Publication Data

US 2012/0049448 A1 Mar. 1, 2012

(51) Int. Cl.
*A63F 9/08* (2006.01)

(52) U.S. Cl.
USPC ..... 273/157 R; 273/155

(58) Field of Classification Search
USPC ..... 273/157 R, 155, 158, 159, 153 S; 446/487
See application file for complete search history.

(56) References Cited

U.S. PATENT DOCUMENTS

| | | | | | |
|---|---|---|---|---|---|
| 956,632 | A | * | 5/1910 | Finch | 446/119 |
| 994,227 | A | * | 6/1911 | Whitelaw | 273/157 R |
| 2,429,027 | A | * | 10/1947 | Myers | 273/157 R |
| 2,825,178 | A | * | 3/1958 | Hawkins | 446/119 |
| 2,877,506 | A | * | 3/1959 | Almoslino | 273/155 |
| 3,201,894 | A | * | 8/1965 | Resch | 446/487 |
| 3,222,072 | A | * | 12/1965 | Dreyer | 273/157 R |
| 3,577,673 | A | * | 5/1971 | Monestier | 446/490 |
| 3,608,906 | A | | 9/1971 | Odier | |
| 4,392,323 | A | * | 7/1983 | Rubik | 446/487 |
| 4,722,712 | A | * | 2/1988 | McKenna | 446/487 |
| 4,875,681 | A | * | 10/1989 | Ofir | 273/155 |
| 4,997,375 | A | * | 3/1991 | Heinz | 446/487 |
| 5,046,988 | A | * | 9/1991 | Bennett | 446/487 |
| 5,108,100 | A | * | 4/1992 | Essebaggers et al. | 273/153 R |
| 5,249,966 | A | | 10/1993 | Hiigli | |
| 5,299,804 | A | | 4/1994 | Stevens | |
| 5,302,148 | A | * | 4/1994 | Heinz | 446/119 |
| 5,322,284 | A | * | 6/1994 | El-Agamawi | 273/157 R |
| 5,338,034 | A | * | 8/1994 | Asch | 273/155 |
| 5,344,148 | A | * | 9/1994 | Asch | 273/156 |
| 5,346,215 | A | * | 9/1994 | Asch | 273/155 |
| 5,525,089 | A | * | 6/1996 | Heinz | 446/119 |
| 5,538,452 | A | * | 7/1996 | Kurani | 446/102 |
| 6,257,574 | B1 | | 7/2001 | Evans | |
| 6,264,199 | B1 | * | 7/2001 | Schaedel | 273/157 R |
| 2002/0008355 | A1 | | 1/2002 | Wilson | |
| 2006/0232006 | A1 | | 10/2006 | Fang et al. | |
| 2007/0262523 | A1 | | 11/2007 | Burns | |
| 2009/0014954 | A1 | | 1/2009 | Cook | |

FOREIGN PATENT DOCUMENTS

| | | |
|---|---|---|
| CN | 2748137 | 12/2005 |
| TW | M268094 | 6/2005 |

OTHER PUBLICATIONS

International Search Report of the Patent Cooperation Treaty Office in application No. PCT/US2011/049495 dated Jan. 31, 2012.

* cited by examiner

*Primary Examiner* — Steven Wong
(74) *Attorney, Agent, or Firm* — Kinney & Lange, P.A.

(57) ABSTRACT

A puzzle unit for an amusement device comprises a first puzzle unit assembly, a second puzzle unit assembly, a third removable unit face, and a fourth removable unit face. The first puzzle unit assembly includes a first support member and a second support member projecting from a first inner surface of the first unit assembly, and a first triangular unit face on an outer surface of the first unit assembly. A space between the first support member and the second support member define a first linear slot. The second puzzle unit assembly is geometrically identical to the first unit assembly, including a third support member and a fourth support member projecting from a second inner surface of the second unit assembly, and a second triangular unit face on an outer surface of the second unit assembly.

32 Claims, 36 Drawing Sheets

CUBE PUZZLE GAME

BACKGROUND

This application relates to puzzles for personal amusement and recreation, and more specifically to those puzzles presenting geometric and color-based challenges.

Several puzzles challenge a user to solve various geometric riddles with a number of two- or three-dimensional pieces. The most basic of these is a set of small cubes for small children that can be stacked. Other puzzles present color- or picture-based tests of a user's mental acuity. Color- or picture-based puzzles are frequently integrated with individual square or cubic blocks by placing a color or partial pattern on a plurality of the blocks and directing a user to arrange these pieces into a larger geometric shape with different colors on each surface. Some puzzles include mechanical connections between the geometric shapes. One of the most famous and well-known three-dimensional puzzles that integrates geometric and color challenges is the "Spatial Logical Toy," described in U.S. Pat. No. 4,378,116.

SUMMARY

A puzzle unit for an amusement device comprises a first puzzle unit assembly, a second puzzle unit assembly, a third removable unit face, and a fourth removable unit face. The first puzzle unit assembly includes a first support member and a second support member projecting from a first inner surface of the first unit assembly, and a first triangular unit face on an outer surface of the first unit assembly. A space between the first support member and the second support member define a first linear slot. The second puzzle unit assembly is geometrically identical to the first unit assembly, including a third support member and a fourth support member projecting from a second inner surface of the second unit assembly, and a second triangular unit face on an outer surface of the second unit assembly. A space between the third support member and the fourth support member define a second linear slot, with the second unit assembly rotated relative to the first unit assembly such that the second linear slot aligns with the first linear slot. A portion of the first support member overlaps with a portion of the fourth support member, a portion of the second support member overlaps with a portion of the third support member, and a common edge defines an angle of about 60° between the first unit face and the second unit face. The third removable unit face engages with the first support member or the fourth support member such that the third unit face occupies a plane substantially parallel to planes occupied by overlapping first and fourth support members. A fourth removable unit face engages with the second support member or the third support member such that the fourth unit face occupies a plane substantially parallel to planes occupied by overlapping second and third support members.

A puzzle unit pair comprises a first tetrahedral puzzle unit with faces marked in a first color progression, a second tetrahedral puzzle unit with faces marked in a second color progression, and a connector. The second puzzle unit is a geometric mirror image of the first puzzle unit and both puzzle units are marked according to a predetermined color code. The connector has a first linkage attached to a first surface on an interior volume of the first puzzle unit, and a second linkage attached to a second surface on an interior volume of the second puzzle unit. The connector is repositionable between a first corner and a second corner of the respective puzzle units without detaching or disassembling the connector.

DETAILED DESCRIPTION

U.S. Pat. No. 5,322,284, issued to the applicant, discloses a puzzle with a single chain of three-dimensional puzzle units. In the '284 patent, units along the chain have two solid arms extending from two unit corners joined at a single pivot point outside the connected units, such as in a ball and socket configuration. Hemispherical heads are pressed into a void on the interior of each unit in the chain through a bore. The previous puzzle is solved by turning and reorienting the units to fold the chain into a complex three-dimensional structure. Such chains have limited solutions and adjusting the order or number of units required disassembly.

Embodiments of the amusement device described herein can provide challenge and amusement to users with widely varying levels of aptitude and skill. Embodiments also can include a resilient, flexible, and repositionable connector that links two mirror image puzzle units into a pair. The paired units are then configured into blocks, which themselves are oriented into larger shapes to solve one or more puzzle challenges. The puzzle units can be built with an interchangeable and modular structure, allowing them to be disassembled and reassembled by the player to create a personalized set of puzzle units.

Challenges can be solved with a partial set, a complete set or multiple sets. In certain embodiments, puzzle unit faces can be colored or marked according to a code. Such colors can also be indicated on one or more opposing corners of the puzzle units. These unit pairs can be grouped into sets such that a single set or subset can be manipulated into a wide variety of different solutions having both color and geometric elements. The amusement device can additionally or alternatively include virtual puzzle blocks, which are geometric representations of various blocks, partial solutions, or complete solutions made from one or more of the mirror image puzzle units as described below. In certain embodiments, virtual blocks can be combined with colored puzzle units to create hybrid solutions. In certain other embodiments, a set of virtual blocks alone can be oriented into solutions without colored puzzle units.

Figure 1A:
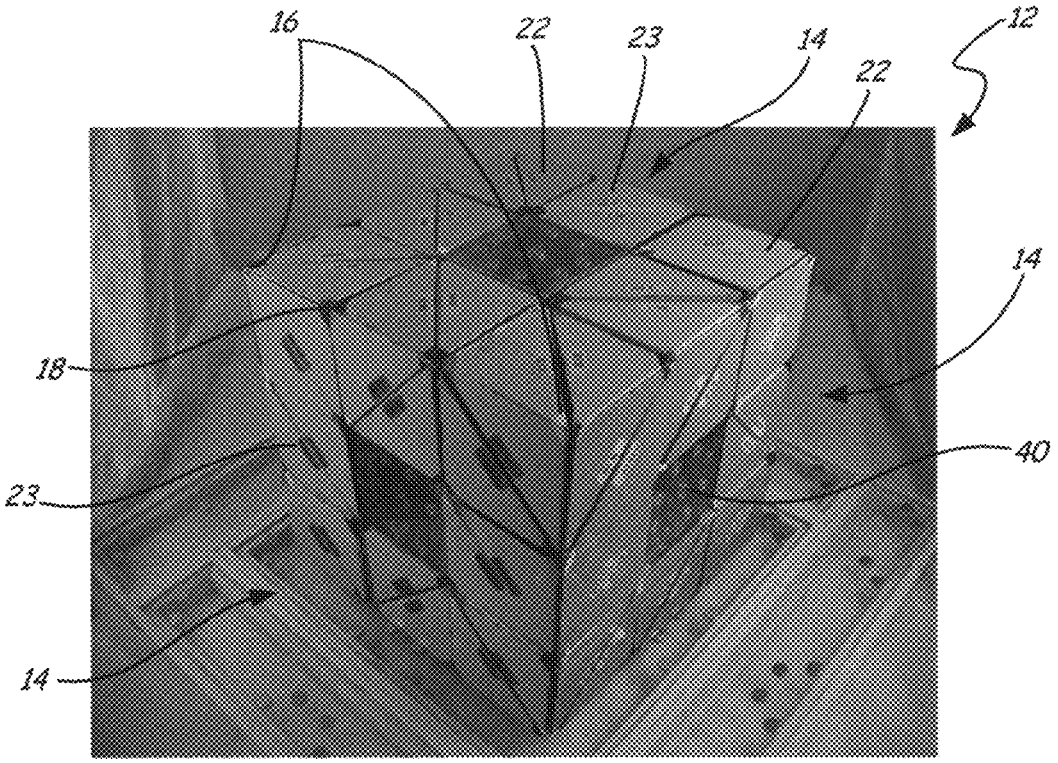
FIGS. 1A-1B are front and rear color photographs of a hybrid cube of side length 3*L, an example of a major puzzle solution.
Figure 1B:
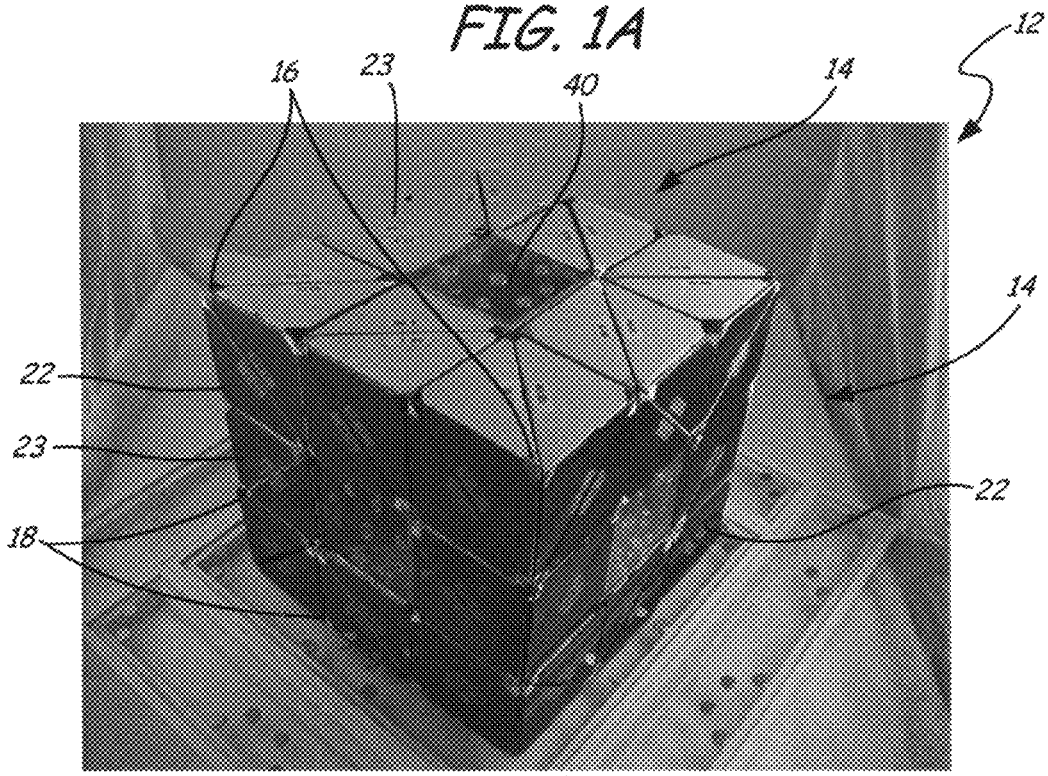

The figures are generally organized into four groups in this specification. FIGS. 1A and 1B show an example of a hybrid puzzle solution embodying many of the color and geometric elements covered throughout the application in more detail. FIGS. 2-8 include details of many geometric elements in the amusement device, including examples of modular and interchangeable structures for the puzzle unit pairs. FIGS. 9A-9H illustrate virtual puzzle blocks and solutions, which geometrically represent combinations of two or more colored puzzle units described in FIGS. 2-8. FIGS. 10-19 show color photographs of additional example puzzle solutions. These examples are built using one or more puzzle sets organized by one or more of predetermined color codes, such as those described herein. These groupings are to aid in understanding the different parts of the amusement device only, and the descriptions are not intended to be read separately. Because many embodiments of the device integrate both color and geometric aspects, this description should be read and considered as a whole.

Example Hybrid Puzzle Solution

FIG. 1A is a color photograph of a front perspective view of large hybrid cube 12 having major faces 14, major corners 16, and major edges 18. Large hybrid cube 12 includes small colored cubes 22, small hybrid cubes 23, and several embodiments of puzzle block 40.

Large hybrid cube 12 is an example of a major hybrid puzzle solution encompassing many aspects of the amusement device described herein. In this description, a hybrid puzzle solution is one in which a combination of colored tetrahedral puzzle units and virtual puzzle blocks 40 are required to complete the challenge.

Geometrically, large cube 12, has sides with lengths of about 3*L. This example solution is a combination of twenty-seven smaller cubes, each having sides with lengths of about L. As will be described in certain examples below, each smaller cube is built with three colored blocks 24 (shown in FIGS. 2B and 4A-4D) or their geometric equivalents (shown in FIG. 9A). Puzzle units, such as those defining colored block 24, can be marked according to a predetermined color code and organized into different puzzle sets. These color codes permit one set of units to create a wide variety of solutions, several examples of which are described herein.

In this example, large hybrid cube 12 is built using all four subsets of puzzle unit pairs marked with example Color Code 1 (described below). However, it should be noted that there are only forty-eight total puzzle unit pairs 30 in a Color Code 1 set available to be configured into a total of forty-eight colored blocks 24. Thus, a Color Code 1 set does not itself have enough properly colored mirror image puzzle unit pairs 30 to form a 3*L cube using only colored blocks 24. However, virtual puzzle blocks 40 (described in detail in FIGS. 9A-9G) can be strategically added or substituted to certain locations relative to colored puzzle components such as on the interior of large cube 12 or at the center of major cube face 14. With the right virtual puzzle blocks 40, large cube can be assembled using a single Color Code 1 puzzle set. Here, eight of the twenty-seven cubes are versions of colored small cube 22, and seven cubes are instances of one example embodiment of virtual puzzle block 40. The remaining twelve cubes are small hybrid cubes 23, each including two blocks 24 and one virtual block 40.

Starting with small colored cube 22, one instance is located at each of the eight major corners 16 of large cube 12. Small cube 22 is one of several examples of a basic solution. Basic solutions are formed by orienting two or more colored puzzle blocks into a basic geometric shape, such as a cube or pyramid. As will be seen in more detail later, multiple instances of basic solutions can be integrated in many different ways to create larger and/or more complex challenges involving geometry, color, or both.

Figure 2A:
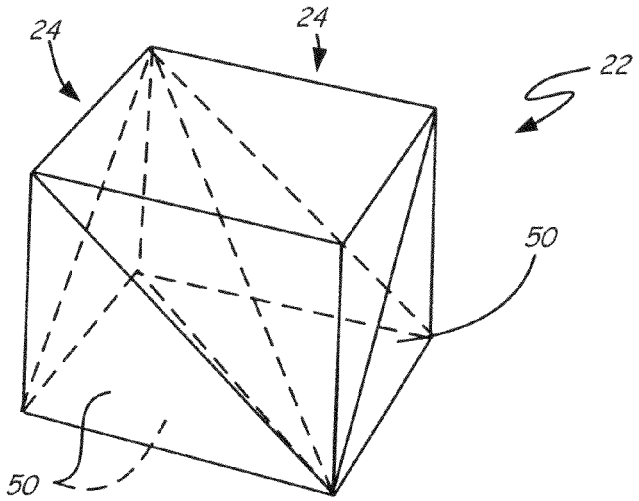
FIGS. 2A-2B schematically depict combined and exploded views of three closed square base puzzle blocks arranged into a cube having sides of length L.
Figure 2B:
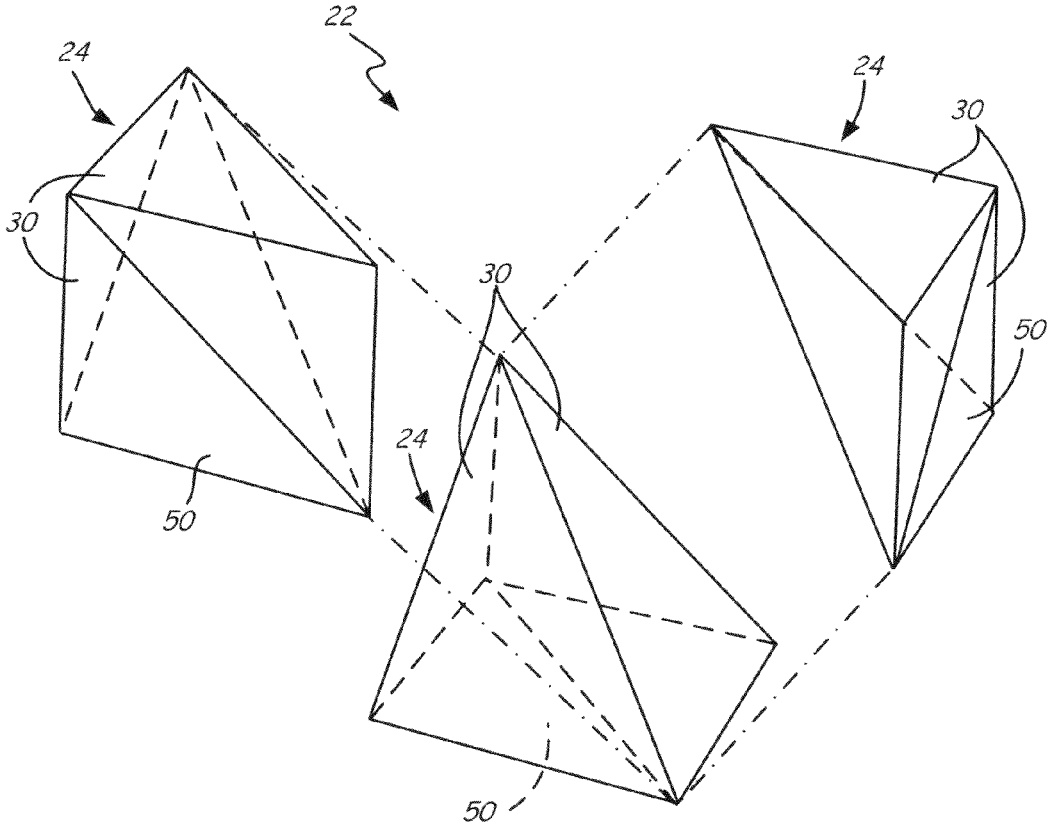

In this case, small cube 22 is a combination of three small square base colored blocks 24 joined as shown in FIGS. 2A-2B. Another example basic solution includes square-base pyramid 26, which is made by joining four triangle base puzzle blocks 28 as shown in detail in FIGS. 2C-2D. Each of these blocks can have different color patterns by manipulating mirror image tetrahedral puzzle units 30A and 30B (shown in FIG. 3) into different configurations. In certain embodiments, puzzle units 30A and 30B have a color progression on their respective unit faces. In certain of those embodiments, the mirror image units are linked by a single flexible connector into puzzle unit pairs 30. Configurations of puzzle unit pairs 30 into puzzle blocks with different shapes, different connector placement, and different possible color patterns are shown in FIGS. 4-6. Examples of modular embodiments of units 30A and 30B are shown and described with reference to FIGS. 7-8.

Moving on to the virtual puzzle blocks 40 that are visible on major faces 14, large cube 12 includes six virtual blocks 40 at the center of each major face 14 and a seventh virtual block (not visible) at the center of large hybrid cube 12. As will be shown and described in reference to FIGS. 9A-9G, virtual puzzle blocks 40 have a shape with a continuous volume that is substantially equivalent to a reference shape of integer quantities of at least one of mirror image puzzle units 30A and 30B. Each of these seven virtual blocks 40 in cube 12 represent the shape and volume of small cube 22 with side length L. This particular example of virtual puzzle block 40 is seen in more detail in FIG. 9F as virtual small cube 114.

Finally, recall that twelve hybrid cubes 23 with sides of length L complete large hybrid cube 12. Small hybrid cubes 23 are located at the center of each of the twelve major edges 18, between two colored small cubes 22 at corners 16. Like small colored cubes 22, they include three blocks, each having a shape and volume equivalent to square-base blocks 24. However, only two instances of these blocks are colored blocks 24. The third instance is an alternate embodiment of virtual block 40. As briefly mentioned above, virtual blocks 40 are equivalent in shape and volume to various integer combinations of puzzle units 30A and/or 30B. In this case, the embodiments of virtual blocks 40 used in small hybrid cube 23 have a shape and volume equivalent to square base puzzle block 24. The example embodiment of virtual block 40 used in small hybrid cube 23 is seen in more detail as virtual block 100 in FIG. 9A.

However, blocks 40 do not have any distinguishing colors or markings on their outer surfaces. This readily permits geometric, but not color substitution of virtual blocks 40 for colored puzzle blocks matching the reference shape. Substitution or addition of virtual puzzle blocks 40 is helpful in several situations. Using the example of large hybrid cube 12, certain faces of some units 30 may face the interior of the puzzle solution and thus its color may not be necessary to solving a particular challenge. This reduces the number of units dedicated to a particular solution, and makes available those remaining units in the set to create additional puzzle solutions. Another reason for substituting virtual blocks 40 can include using them to expand the number of solutions available for a predetermined color code, such as was done here.

Since hybrid cubes 23 in the middle of each major edge 18 only have two colored blocks 24, hybrid cubes 23 are placed with the correct colored unit faces directed outward to match the color arrangement on major faces 14 required to solve the particular challenge. In this example, the challenge is to have a single unique color on each major face 14.

Regardless of the relative number of colored versus virtual puzzle blocks used, the blocks must be held together in some fashion to give the solution a degree of structural stability. In this example, a plurality of magnets hold pieces against metalized portions of adjacent surfaces, as described in detail below.

FIG. 1B is a color photograph of a rear perspective view of large hybrid cube 12 with major faces 14, major corners 16 and major edges 18 as shown in FIG. 1A. As before, cube 12 includes small colored cubes 22, small hybrid cubes 23, and virtual blocks 40.

As described above, large cube 12 presents a color-based challenge as well as a geometric one. Excluding virtual blocks 40, large cube 12 has a single color unique to each major face 14, resulting from correctly orienting cubes 22, 23, and 40. As will be described primarily with reference to FIGS. 10A and 10B, cubes 22 and 23 are created by orienting puzzle unit pairs 30 into colored blocks 24, with a color pattern consistent with the desired outcome It will be apparent that the puzzle can be readily modified to create variations on large hybrid cube 12. For example, one or more small virtual cubes 40 (114 in FIG. 9F) at the center of each major face 14 can alternatively be a plurality of virtual square base blocks 40 (100 in FIG. 9A) arranged into a cube in a manner similar to blocks 24 oriented into cubes 22 (shown in FIG. 2B). In another alternative challenge, large hybrid cube 12 has a single unique color on each face with no virtual puzzle blocks visible on major faces 14, while still only using a single set of 96 colored puzzle units. In certain embodiments, that single puzzle set includes two pairs of identical subsets of example Color Code 1, such as two sets of Subset I and two sets of Subset II. In those alternative embodiments, several blocks 24 are not configured into cube 22 or hybrid cube 23 as shown in FIGS. 1A-1B. For example, some blocks include only one corner or one edge of one puzzle unit adjacent to one corner or one edge of a second linked mirror image puzzle unit. Examples of such are shown as units 30A and 30B in FIG. 3.

While large cube 12 is built using Color Code 1, other color codes can cause the color arrangement to differ from large hybrid cube 12 shown in FIGS. 1A and 1B. For example, large hybrid cube 12 can include different combinations of unit pairs 30 and virtual puzzle blocks 40, such as by locating virtual blocks 40 at each corner 16 in place of cubes 22. Another alternative includes arranging the colors on each face such that more than one color or design pattern is present on faces 14. Other examples of alternative color arrangements on faces 14 include a checkerboard pattern such that each square is a different color from adjacent squares.

As will be seen in this specification, a virtually unlimited variety of geometric and color-based challenges are possible with different embodiments of this amusement device. Geometrically, the puzzle is modular and scalable, providing challenges to players having a wide range of skill levels. Pairs of mirror image puzzle units 30 are configured into open or closed blocks, such as puzzle blocks 24, 28, or 29. The blocks can then be combined with one another to make basic solutions. Each set of puzzle unit pairs can be configured into enough blocks for different basic solutions, such as small cube 22 and/or pyramid 26. Basic solutions can define their own solution or can be combined in different ways for more complex solutions. Complex solutions can also include multiple puzzle sets to build larger or more intricate shapes. Sets can also be integrated with virtual blocks 40 to create hybrid solutions such as large hybrid cube 12.

Other elements discussed below and used in cube 12 include construction of modular mirror image puzzle units 30A and 30B having a plurality of interchangeable faces. Elements also include a unit connection system with embedded magnets, metalized unit faces, and a flexible and repositionable connector. Other elements of the puzzle include two example Color Codes for marking puzzle unit pairs 30, as well as a color indicator on one or more unit corners that corresponds to colors or designs on unit faces.

Basic Puzzle Solutions and Unit Blocks

FIG. 2A schematically depicts small cube 22, a cube of side length L, made by combining three small square-base blocks 24. Blocks 24 each are closed configurations of puzzle unit pair 30 (shown in FIG. 3). Blocks 24 are oriented into cube 22 as seen in FIG. 2B. In certain embodiments, one or more outer surfaces of small cube 22 will include one or more colors, such as will be seen later in FIGS. 10A-10B and 17A-17B.

FIG. 2B is an exploded view of small cube 22 from FIG. 2A, which includes three square-base blocks 24 oriented relative to one another to create cube 22. Square base 50 of a first puzzle block 24, having side length L, defines one outer surface at the bottom of small cube 22. Second and third puzzle blocks 24 are oriented relative to the first block 24 such that their square bases 50 define two additional outer surfaces at the sides of small cube 22. When large faces of each block 24 are placed flush as shown in FIG. 2B, a small triangular face from the first block 24 aligns with a small triangular face of the second block 24 along each hypotenuse to form an additional square serving as a fourth outer surface of cube 22. The fifth and sixth outer surfaces of cube 22 are formed from similar combinations of the remaining small triangular faces on the outside of blocks 24.

Puzzle block 24 is a closed configuration of puzzle unit pair 30 with five corners and five outer surfaces, including square base 50. To configure block 24, a large unit face of one puzzle unit 30A is placed flush against a large unit face of a geometric mirror image puzzle unit 30B as seen in FIGS. 4A-4D. In certain embodiments discussed in more detail below, faces of units 30A and 30B are marked with a color or design according to a predetermined code, such as examples Color Code 1 and Color Code 2. As will be seen later, the color progression on a given pair of units 30A and 30B define a color pattern on the resulting block 24. The relative orientations of color patterns on blocks 24, in turn define a color arrangement on cube 22. In certain embodiments with a predetermined color code, the color arrangement on one instance of cube 22 can be coordinated with color arrangements on other instances of cube 22 to define a puzzle solution. For example, a plurality of cubes 22 from a set can all have a color arrangement where each cube 22 has a single color on each surface. In certain of those embodiments, each of the cubes will additionally have each color unique to one outer surface. In yet other embodiments, two cubes 22 share an identical color arrangement. In even yet other embodiments, two cubes are color mirror images of each other.

In certain embodiments, magnets 52 (not visible in FIGS. 2A-2B) are part of a unit connection system and are embedded within one or more faces of puzzle units 30. In certain embodiments, these magnets 52 are attracted to metalized portions of adjacent unit faces, holding units 30A and 30B in the shape of block 24. In addition, magnets 52 can also be used to hold several blocks 24 together to define shapes like cube 22. Certain embodiments of the connection system also include repositionable connector 60, an example of which is described below.

Figure 2C:
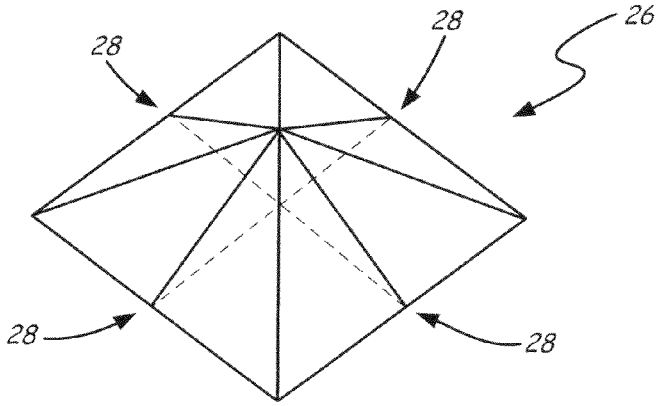
FIGS. 2C-2D show combined and exploded views of four closed triangle base puzzle blocks arranged into a pyramid with a square base of side length 2*L.

FIG. 2C schematically depicts pyramid 26, which includes four triangle-base puzzle blocks 28. Like small cube 22, pyramid 26 can be a stand alone solution or used as part of more challenging puzzles. In this embodiment, pyramid 26 has a square base with sides of length 2*L, and a height of L. In certain embodiments, one or more outer surfaces of pyramid 26 will include one or more colors, such as will be seen later in FIGS. 12A-12B and 14A-14B.

Figure 2D:
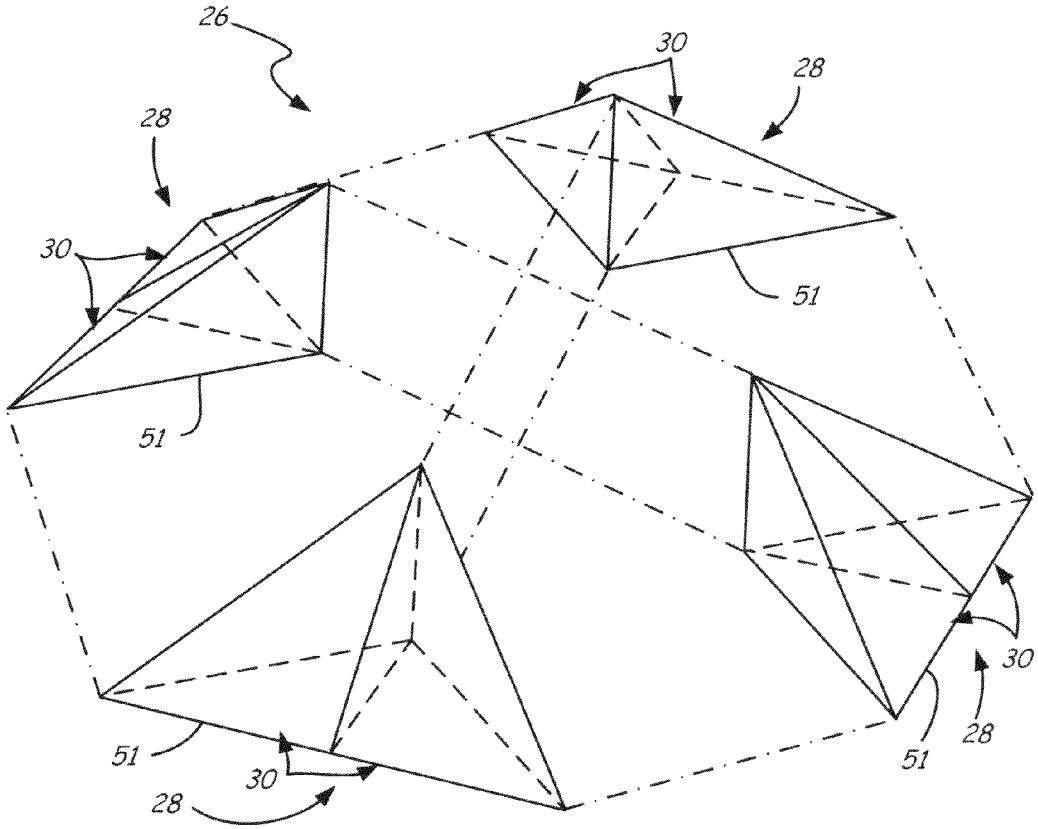

FIG. 2D shows an exploded view of four small triangle-base blocks 28 oriented into an example of pyramid 26 from FIG. 2C. Each of the four triangle-base blocks 28 has triangle base 51. The right angle of each base 51 is aligned at a center point of the square base of pyramid 26. The hypotenuse of each base 51 (having length of about 2*L) defines one of the four edges of the square base of the pyramid.

Different configurations of blocks 28 are seen in FIGS. 5A-5D and FIGS. 6A-6D. Square-base pyramids 26 also have four side surfaces, each of which is defined by the largest face of each block 28. Unlike puzzle blocks 24, puzzle blocks 28 are in the shape of a large tetrahedral solid as shown in more detail in FIGS. 5A-5D. Unit 30 can readily be manipulated between puzzle block 28 and puzzle block 24 as seen in FIGS. 4A-4D.

Like blocks 24, triangle-base blocks 28 can engage with each other via magnets 52 (not shown in FIGS. 2C-2D) to define larger structures including pyramid 26. As described above, blocks 28 can include a connection system with magnets 52 embedded within puzzle units 30A and 30B that are attracted to opposing metalized portions of faces. Similarly, magnets 52 can also be used to hold blocks 28 to metalized faces of other units, blocks, and/or solutions. Faces can be metalized according to various examples described below. In certain embodiments, one or more blocks 29 (see FIGS. 6A-6D) with the same geometry can substitute for blocks 28.

It will be apparent from the description that four blocks 24 can alternatively be oriented into pyramid 26 because they both involve two instances of puzzle units alternating between 30A and 30B. It will also be apparent that four instances of blocks 28 can alternatively be arranged into a pyramid having rhombic base and four side surfaces. Four triangles on two blocks 28, each with sides L, SQRT(2)*L and SQRT (3)*L, are oriented with the right angles of these triangles defining the center of the rhombic base. Such triangles are equivalent to a large unit face such as faces 42 or 44 discussed below. Those two instances of block 28 also define a lower portion of each of the four side surfaces of the rhombic pyramid, while the remaining two instances of blocks 28 define the remaining upper portions of the four side surfaces. Thus, in these embodiments, the rhombic base pyramid will have sides of length SQRT (3)*L and a height of SQRT(2)*L.

Figure 2E:
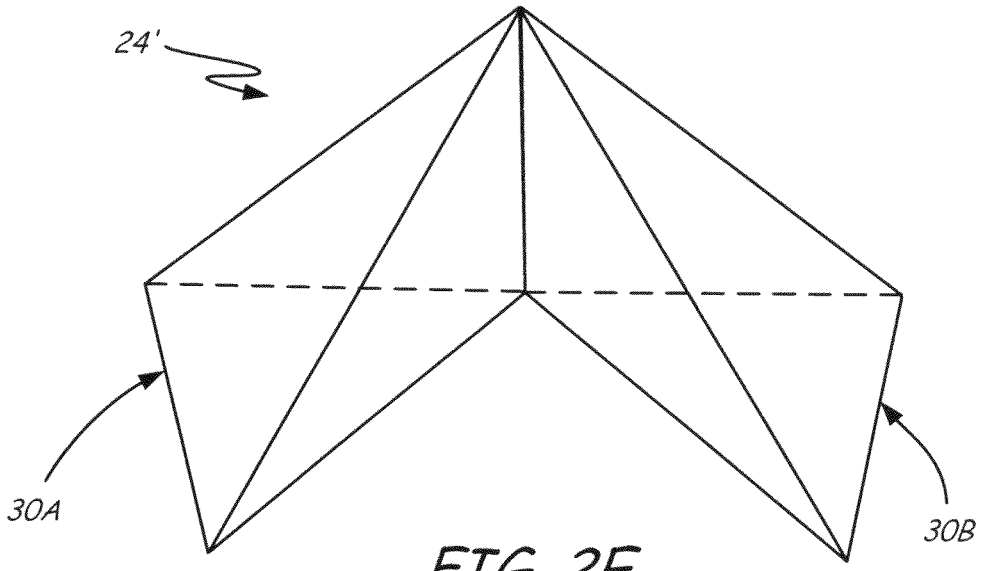
FIG. 2E shows a closed block from FIG. 2B reconfigured into a block with an open configuration.

While FIGS. 2A-2D depict puzzle blocks 24 and 28 in a closed configuration, various blocks can also be set up in an open configuration with only a corresponding element of each puzzle unit 30A and 30B substantially adjacent to or flush against each other. For example, FIG. 2E shows block 24', which is an open variation on closed block 24. Instead of two entire faces being flush, block 24' includes one edge of unit 30A flush against a corresponding edge of unit 30B. Two unit faces along the rear of block 24' are coplanar and define a continuous triangular surface with the gap between units 30A and 30B accommodating closed block 28 between units 30A and 30B. When closed block 28 is placed in the gap defined by open block 24', the resulting structure is half of pyramid 26 divided vertically across the midpoints of opposing side surfaces. This geometry is also represented by virtual block 110 in FIG. 9D.

Figure 2F:
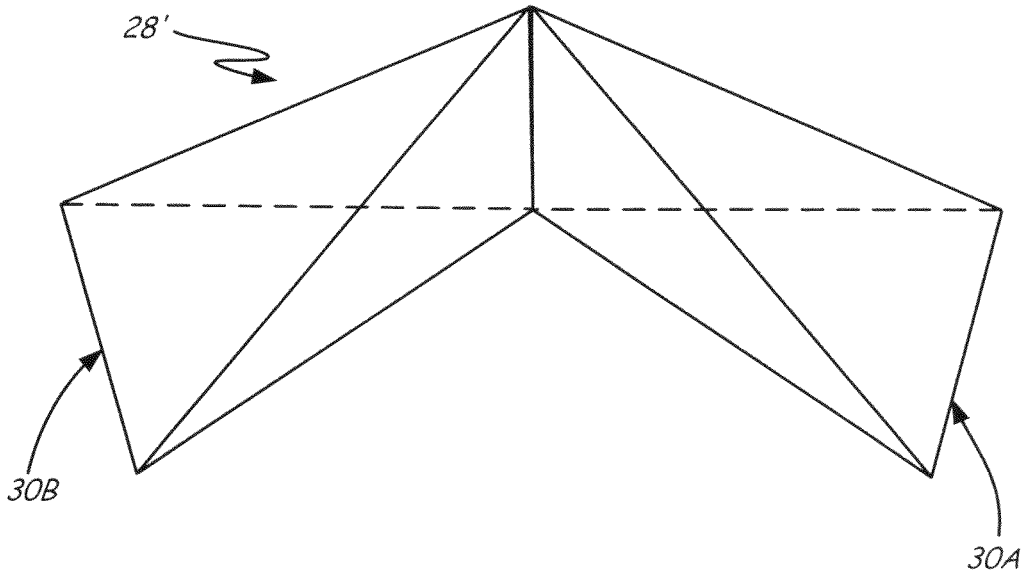
FIG. 2F shows a closed block from FIG. 2D reconfigured into a block with an open configuration.

In another example, FIG. 2F shows block 28', which is an open configuration of block 28. Compared to block 24', block 28' includes the same edge of unit 30A flush against a corresponding edge of unit 30B. In some embodiments, the rear faces are coplanar, and the gap between units 30A and 30B accommodates a closed block 24 between units 30A and 30B. When closed block 24 is placed in the gap defined by open block 28', the resulting structure is that of half of pyramid 26 divided vertically and diagonally across the square base. Both blocks 24' and 28' can be useful in solving certain color-based challenges, such as those involving pyramids or more complex structures. It will be apparent that blocks can also be created with open configurations where only a corner of each unit 30A and 30B are adjacent. For example, when a full Color Code 1 set is used to build large hybrid cube 12 with no virtual blocks visible on major faces 14, some blocks are configured with adjacent corners or edges.

FIGS. 2A-2F describe examples of blocks oriented into basic geometric puzzle solutions. Basic solutions can include simple color challenges such as arranging a simple color pattern on one or more surfaces of cube 22 or pyramid 26. Such solutions can be sufficient for young and novice players, or can be used to familiarize oneself with the puzzle. However, the puzzle game is not limited to a single cube, pyramid, block, or even to a fixed number of connected units. The puzzle is highly scalable and modular, with multiple challenges being integrated into a single puzzle set of unit pairs 30 with both geometric and color elements.

For example, advanced or experienced players can use a single set of paired and colored units 30 to create multiple instances of basic solutions according to an advanced or coordinated color challenge. Such a challenge can include a plurality of geometrically identical basic solutions built according to matching and/or mirror image color patterns as shown and described below. Other examples include using the puzzle set to build more complex structures, several of which also can include a color challenge. Examples of such solutions utilizing a single puzzle set are shown in FIGS. 10-12 and FIGS. 17-19.

The most advanced players can combine multiple sets to solve challenges with even higher levels of difficulty. Solutions involving more than one set of puzzle units can be used as building blocks for much larger and more complex geometric challenges, such as those shown in FIGS. 13-16. Virtual puzzle blocks 40, such as those seen in FIGS. 9A-9G, can also be used to create additional challenges. A set containing only virtual blocks can be oriented into major virtual puzzle solutions, such as these example shown in FIG. 9H. Virtual blocks can also be used in conjunction with one or more sets of colored puzzle blocks to create hybrid solutions, such as those already described in FIGS. 1A and 1B. Other examples of hybrid solutions can be seen in FIGS. 16-17. In addition, advanced players can even design their own puzzle sets with interchangeable embodiments of units 30A and 30B, shown in FIGS. 7-8.

Figure 3:
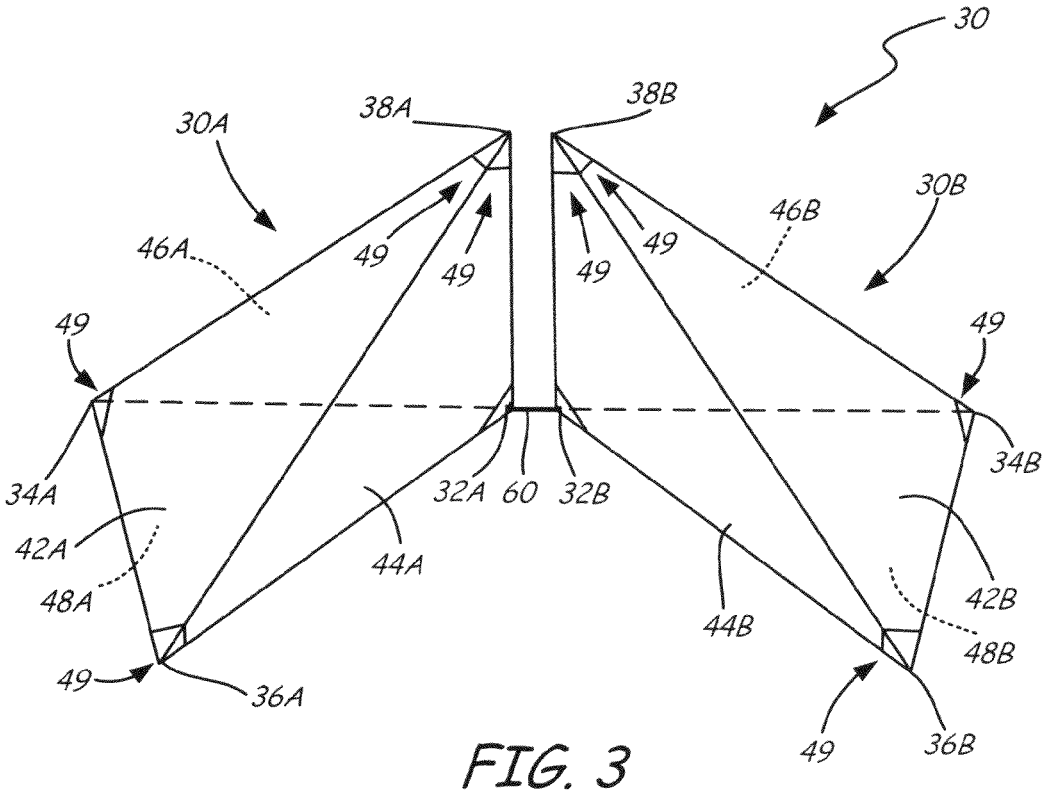
FIG. 3 schematically depicts a puzzle unit pair linked by a connector.

FIG. 3 shows puzzle unit pair 30, which includes tetrahedral puzzle units 30A and 30B linked by connector 60. Unit 30A includes right angle corners 32A and 34A; sharp corners 36A, and 38A; large faces 42A and 44A and small faces 46A and 48A. Puzzle unit 30B includes right angle corners 32B and 34B; sharp corners 36B, and 38B; large faces 42B and 44B and small faces 46B and 48B. Indicators 49 are shown at each corner of units 30A and 30B. Connector 60 includes a flexible filament section 62 extending from corners 32A and 32B.

Modularity and scalability of the puzzle game results in part from the geometry of puzzle unit pair 30, which is the geometric foundation of the amusement device. Units 30A and 30B are geometric mirror image versions of a tetrahedral solid. Tetrahedral solids are unique three-dimensional structures having four triangular faces converging at only four corners. It can be seen in FIG. 3 that corners and faces are numbered to reflect the symmetry of tetrahedral solids. Each corner has a corresponding face opposite the corner and the corner is defined by a point at the intersection of the three remaining faces. For example, right-angle corner 32A is shown at the rear of the base of unit 30A. At the front of unit 30A large unit face 42A is directly opposite corner 32A. Corner 32A is defined by the intersection of the three remaining faces 44A, 46A, and 48A. Similarly, right-angle corner 34A is opposite large unit face 44A and is defined by the intersection of the remaining three unit faces 42A, 46A, and 48A. Sharp corners 36A and 38A are opposite small unit faces 46A and 48A respectively. Finally, edges are identified by their respective numbered corners, e.g. edge 32A-34A extends between corners 32A and 34A. It should also be noted that when relationships between various elements are common to both units 30A and 30B, the description will omit the 'A' or 'B' designation and refer instead to generic elements only (e.g., unit pair or units 30, corners 32, faces 42, etc.).

Symmetry of units 30 also serves to simplify explanation and description of the puzzle's construction and various solutions. As noted, unit 30B is a geometric minor image of unit 30A. When connector 60 is in its home position at corners 32A and 32B, the corners and faces of unit 30B are thus numbered in the same progression as unit 30A. In other words, each face and corner of unit 30B is in a location that is a mirror image of its corresponding element on unit 30A. For example, face 42B is in the mirror image location relative to face 42A.

Right angle corners 32 and 34 are each defined by the convergence of three unit faces. Two pairs of unit faces each meet at an edge, and the three edges, like the three unit faces, converge at the right angle corners at a particular set of angles. In FIG. 3, corner 32 is defined by unit faces 44, 46 and, 48, while unit face 42 is opposite corner 32. Large unit faces 42 and 44 are right triangles with sides of about L, SQRT(2)*L, and SQRT (3)*L, while unit faces 46 and 48 measure about L, L and SQRT (2)*L. Both large unit face 44 and small unit face 46 are perpendicular to small unit face 48 on the bottom of unit 30. These two 90° edges (between faces 44/48 and 46/48) converge at corner 32. The remaining pair of faces (44/46) are at 45°. Corner 34 has a similar arrangement with two pairs of adjacent faces (42/46 and 46/48) forming 90° angles while the third pair of faces converging at corner 34 (faces 42/48) form a 45° angle.

While edge 32-34 between right angle corners 32 and 34 define a right angle edge, sharp corners 36 and 38 make up the remaining two corners of units 30. In this example, at corner 36, large face 44 and small face 48 are at a right angle, large face 42 and small face 48 define an approximate 45° angle, while the third angle of approximately 60° at corner 36 is located between large faces 42 and 44. At sharp corner 38, the right angle is defined between large face 42 and small face 46, the approximate 60° angle is between large faces 42 and 44, while large face 44 and small face 46 define the approximate 45° angle.

As will be clear from the description, there can be slight variations in the different angles and dimensions described above depending on the manufacturing process. However, tighter manufacturing tolerances will generally permit less displacement and imbalance of units 30A and 30B as they are configured into blocks, and as the blocks are oriented into solutions. Tighter tolerances allow for much greater scalability of the puzzle into larger solutions.

Symmetry reflected by the reference numbers above can also be exploited to identify colors or designs on unit faces that are not always visible. Indicators 49 are on each respective corner 32, 34, 36, and 38 of units 30A and 30B, and correspond to the color or design on opposing faces 42, 44, 46, and 48. In one example, indicator 49 on corner 38A of unit 30A is red, which communicates to the player that unit face 48A, disposed opposite corner 38A, is also red. This can be helpful when unit face 48A is not visible, such as when it is part of a solution in progress. Indicators 49 can also work in reverse. If only unit face 48A is visible, indicators 49 can be seen on corners 32A, 34A, and 36A, thereby revealing the colors on unit faces 42A, 44A, and 46A respectively. Thus indicators 49 exploit the geometry of puzzle units 30A and 30B, allowing a player to immediately identify all four colors based on seeing only a single unit face.

When puzzle units 30A and 30B are manufactured according to a predetermined color code, indicators 49 can be placed on the respective corners during production. In embodiments where users can modify units and create their own predefined color code, indicators 49 can accordingly be made removable and/or replaceable. This can be done, for example, by small stickers or inserts, which would accommodate changes to the color progression made by the player to a given puzzle unit. It will be apparent that, to be effective, indicator 49 need only correspond to the color or design on the opposing face. They need not match so long as indicator 49 readily communicates the status of the opposing face.

Symmetry of units 30A and 30B also informs how they are linked by a single connector 60. As will be seen below with respect to example Color Codes, puzzle units 30A and 30B are geometric mirror images of each other but are not necessarily color mirror images. Connector 60 includes flexible filament 62 which allows the units 30A and 30B to be freely translatable and rotatable relative to each other.

In certain embodiments, units 30A and 30B, and connector 60 can include other components described with reference to FIGS. 7A-7E and 8A-8E. Certain components allow a user to rearrange unit faces as described below to create new sets of unit pairs 30 with new color codes. These components can also be used separately or in unison to decrease stress and fatigue and increase the useful life of the puzzle. They also permit a user to reposition connector 60 between corners of units 30A and/or 30B without detaching or disassembling connector 60.

As shown in FIGS. 4-6, certain unit faces of unit pair 30 are placed flush against each other to form example puzzle blocks 24, 28, or 29. However, the short length of connector 60 outside units 30A and 30B restricts placement of the distant outer large faces into contact. For example, unit faces 42A and 42B in FIG. 3 are too far apart to form puzzle block 24. The length of connector 60 is such that units 30A and 30B can be no more than a small distance apart proximate connector 60. In some embodiments, units 30A and 30B are no more than about 0.20*L apart at their closest point. In some embodiments that distance is no more than about 0.05*L. A small degree of movement simplifies configuration of unit pair 30 into different puzzle blocks. This does not account for extension of connector 60, such as in FIG. 7E.

Joining a set of units 30A and 30B into individual puzzle unit pairs 30 can not only increase the possible number of solutions, it can introduce additional challenges compared to a single long chain. For example, a single chain of units inherently communicates the next unit to be placed in the puzzle. While the player must still decide the location and orientation of the next unit in the chain, one element of strategy and challenge is not available. Further, pairing mirror image units with a single connector 60 also adds other strategic or recreational elements to the puzzle game. The single connector can be made to move between corners instead of being locked to a single corner, such as corners 32A and 32B, adding flexibility and many additional solutions. It also enables creation of color codes, such as those examples described below. Codes permit various solutions such as cube-based solutions, pyramid-based solutions, as well as other complex solutions to be created from the same set or subset of puzzle units.

Using single connector 60 to link units 30A and 30B also limits the number of ways a user can arrive at a given solution with a given set of puzzle units. This creates an additional challenge compared to selecting the correct units 30A or 30B out of a set of individual unlinked units. While a particular unit in one instance of pair 30 may appear to have correct unit faces for a particular solution, its mirror image counterpart unit may not be appropriate for the particular solution. A player must instead identify and arrange the correct puzzle units pair 30. Therefore, strategy and patience are required to select the correct puzzle unit pair 30 from a set, configure them into the correct block, and orient the blocks according to the various challenges.

Creating a puzzle with separate unit pairs 30 also allows partial sets with varying quantities of units 30A and 30B to be used. In contrast, a fixed number of units in a chain will require that all solutions have the same number of units or that parts of the chain be repeatedly separated and rejoined. In one example, a 48-unit chain will result in every possible puzzle solutions having the same volume, unless puzzle solutions involving fewer units include vestigial remnants of unused units in the chain. Leaving these remnants attached reduces aesthetic enjoyment and satisfaction inherent in solving a challenging puzzle, while detaching or disassembling the connector introduces unwanted and unnecessary stress on the components.

Magnets 52 can be included as part of the connection system to hold units 30A and 30B in place. Units can be held as blocks, as well as against other units, blocks or solutions. With magnets 52, blocks or even large portions of a puzzle solution can be added, reconfigured, or easily reassembled to help the player solve larger or more complex puzzle challenges. In contrast, linking large numbers of units into a chain severely restricts movement and adaptability of units while the puzzle is being solved. For example, translating a part of the chain can cause movement in remote parts of the chain, potentially disrupting the partially completed solution. This affects structural integrity of the puzzle being solved, with the effects being multiplied when working on larger-scale solutions involving several puzzle sets. Placement and numbers of magnets 52 in each unit are discussed further with reference to FIGS. 7A-7E and 8A-8E.

This puzzle design also makes the puzzle accessible to a much greater range of player skill levels. Challenges can be designed to take advantage of the modular and scalable design of various embodiments of the amusement device. As described above, single basic solutions with primarily geometric solutions can serve as a satisfactory challenge for young and/or novice players. Multiple basic solutions or more complex solutions can be created from a single puzzle set with various color challenges for moderately-skilled players. Larger scale solutions provide challenges using multiple sets, including the introduction of hybrid puzzle solutions for more advanced players. The most advanced players can create their own codes with examples of modular and interchangeable units 30A and 30B shown in FIGS. 7-8.

Various ways of configuring puzzle unit pair 30 into blocks 24, 28, and 29 are explained with reference to FIGS. 4-6. FIGS. 4A-4D depict variations on square base block 24 based on the position of connector 60. The figures also have arrows illustrating blocks 24 being reconfigured into triangle base blocks 28 and 29 by rotating units 30A and 30B about the axes. Examples of blocks 28 are shown in FIGS. 5A-5D, followed by blocks 29 in FIGS. 6A-6D.

Figure 4A:
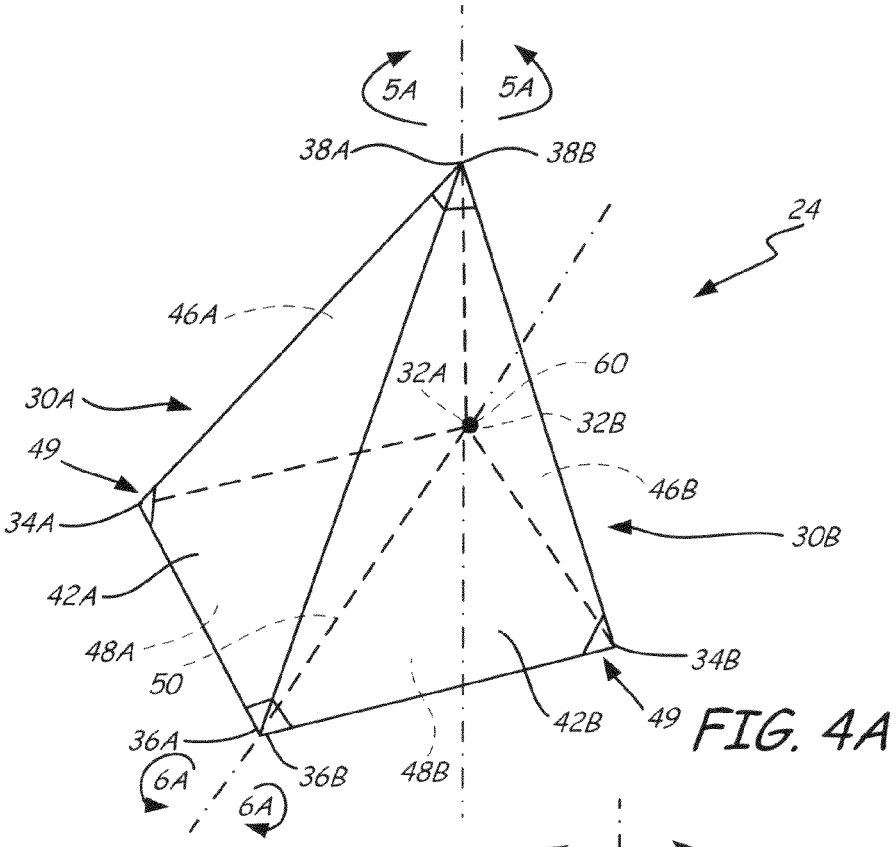
FIGS. 4A-4D show the puzzle unit of FIG. 3 configured into various example embodiments of closed square base puzzle.

FIG. 4A is a detailed view of small square-based puzzle block 24, a combination of units 30A and 30B with square base 50 as was shown in FIG. 2B. On outer surfaces of block 24, unit 30A has corners 32A, 34A, 36A, and 38A; large face 42A; and small faces 46A and 48A. On its outer surfaces, unit 30B has corners 32B, 34B, 36B, and 38B; large face 42B; and small faces 46B and 48B. Large faces 44A and 44B are not visible in FIG. 4A because they are at the center of puzzle block 24. Connector 60 is represented by a solid circle at corners 32A and 32B at the rear of block 24. Arrows 5A and 6A represent rotation of units about the illustrated axes to reconfigure unit pair 30 into blocks 28 and 29 seen in FIGS. 5A and 6A respectively.

To configure unit pair 30 into block 24, large unit faces 44A and 44B are placed flush against each other. In some embodiments, faces 44A and 44B are held together by the interaction of magnets 52 (not visible in FIG. 4A) and metalized portions of various unit faces. Magnets 52 are embedded, and portions of unit faces are metalized as part of the unit connection system. Here, magnets 52 can be embedded into the faces or disposed on an inner surface as will be seen in more detail below. Magnets 52 can be aligned with metalized portions of faces 42, 44, 46, and 48 to the extent that the designer or manufacturer chooses to allow the faces to be secured. Selective placement of magnets and/or metal can also be used to assist a player in solving the puzzle by discouraging selection of incorrect units. Alternatively, metalizing only selected portions of selected faces 42, 44, 46, and 48 on different units 30 within a set can introduce an additional challenge of finding the correct units 30 for a given solution.

Figure 5A:
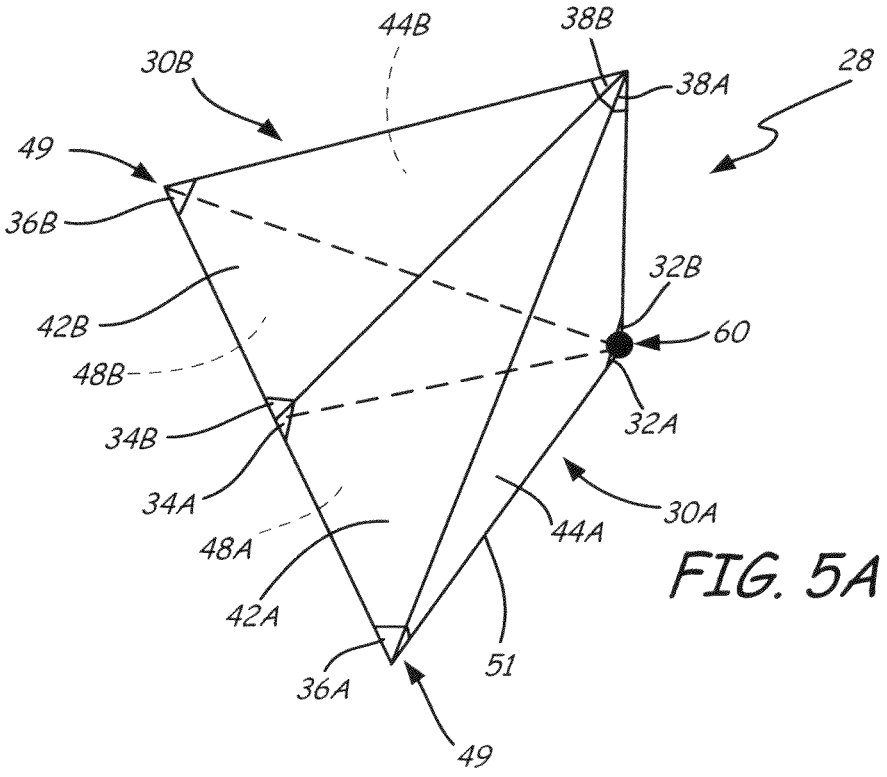
FIGS. 5A-5D show the square base puzzle blocks of FIGS. 4A-4D reconfigured into closed puzzle blocks with the connector at one corner of the triangle base.
Figure 6A:
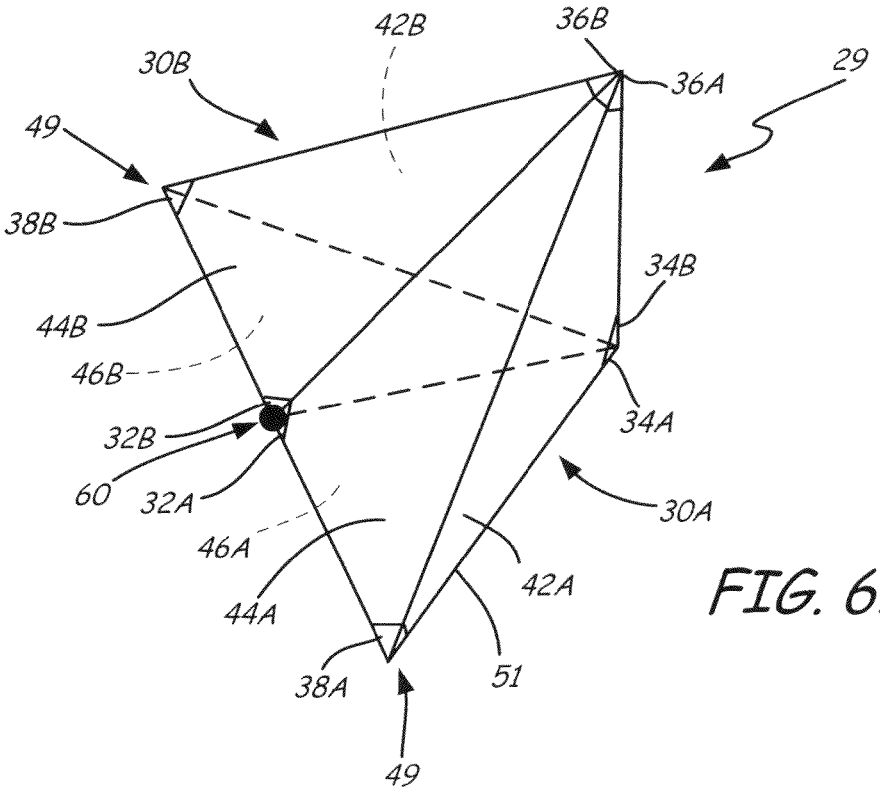
FIGS. 6A-6D show the square base puzzle blocks of FIGS. 4A-4D reconfigured into closed puzzle blocks, with the connector at the hypotenuse of the triangular base.

Block 24 has five total surfaces, one of which is square base 50 with sides of length L. Square base 50 is the combination of two small unit faces 48A and 48B. The 90° angles on small faces 48A and 48B form two opposing corners of square base 50. The remaining four surfaces of block 24 are four sides of units 30A and 30B. Large faces 44A and 44B, having dimensions L, SQRT(2)*L and SQRT(3)*L are the two front surfaces of block 24 in FIG. 4A. Two small faces 46A and 46B, each having dimensions L, L, and SQRT(2)*L, define two rear faces of block 24. When units 30A and 30B are rotated about a vertical axis as indicated by arrows 5A, block 24 is manipulated into block 28 as shown in FIG. 5A. Similarly, by rotating units 30A and 30B about a horizontal axis as indicated by arrows 6A forms block 29 as shown in FIG. 6A. As will be seen later, both blocks 28 and 29 are tetrahedral solids with four faces and four corners, but with different relative dimensions as compared to units 30A and 30B.

An example will illustrate the different color patterns possible by repositioning connector 60. In this example, puzzle unit 30A has a color progression of YGWB. As described later, this means large unit face 42A is yellow, large unit face 44A is green, small unit face 46A is white and small unit face 48A is blue. Unit 30B has a color progression of WRBG (white, red, blue, green). In FIG. 4A, with connector 60 at corners 32A and 32B, the front outer surfaces of block 24 are equivalent to unit faces 42A (yellow) and 42B (white). The two rear surfaces of block 24 match unit faces 46A (white) and 46B (blue). The fifth surface, square base 50 in FIG. 4A is defined by the colors of small unit faces 48A (blue) and 48B (green).

Positioning connector 60 at corners other than 32A and 32B will change the faces visible on outer surfaces of block 24. This can cause up to four different color patterns on block 24 where one end of connector 60 is repositioned between corners 32A and 34A on unit 30A and where 30B are marked with different colors or designs. In other words, with the pair of colored puzzle units 30A and 30B, block 24 will have the same geometry, but a different color pattern based on the position of connector 60. Changes to this example pattern are seen in FIGS. 4B-4D.

Figure 4B:
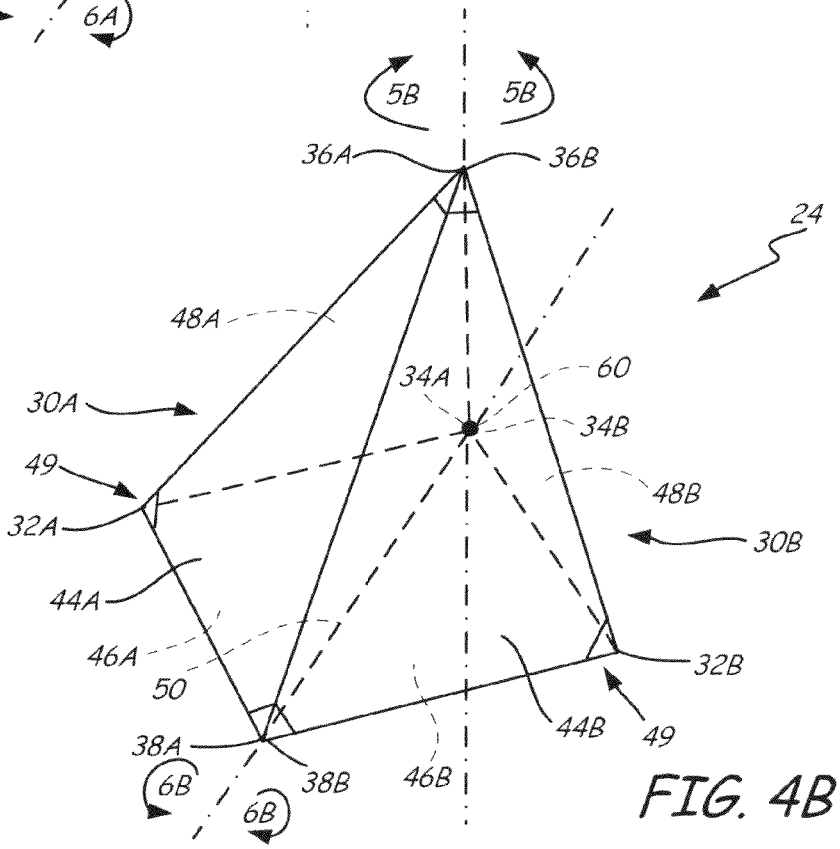
Figure 4C:
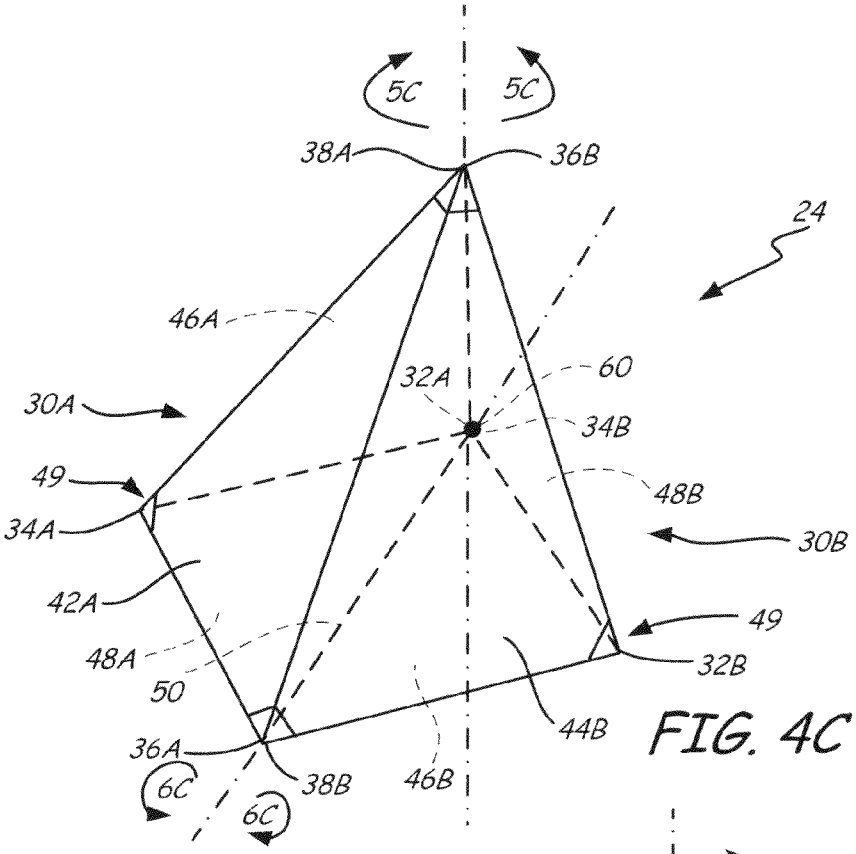
Figure 4D:
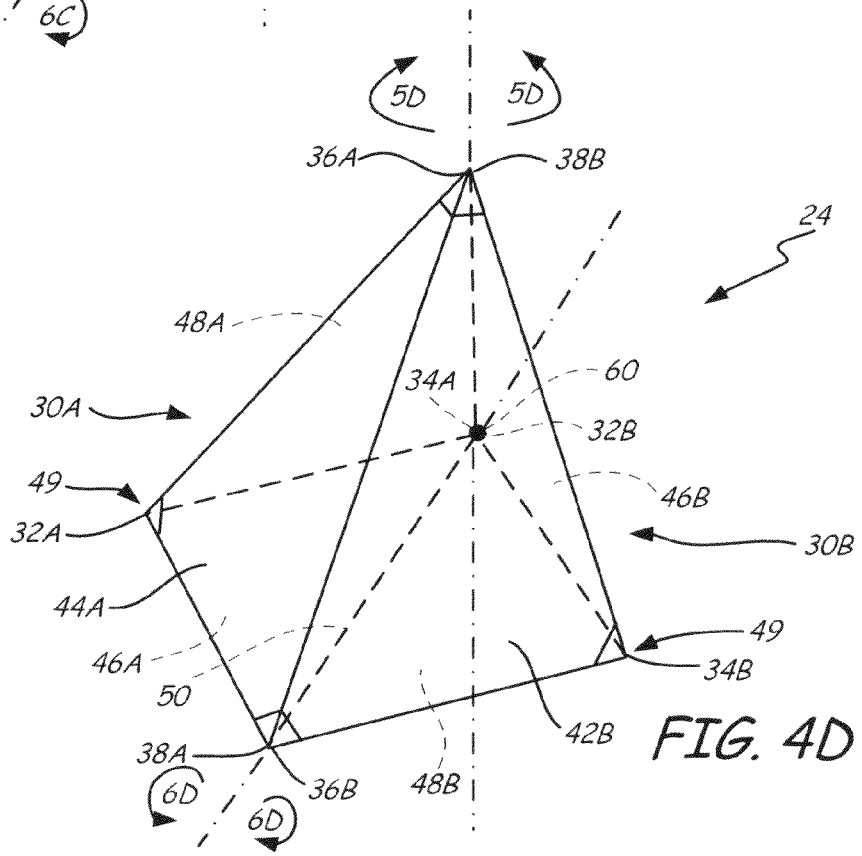
Figure 5B:
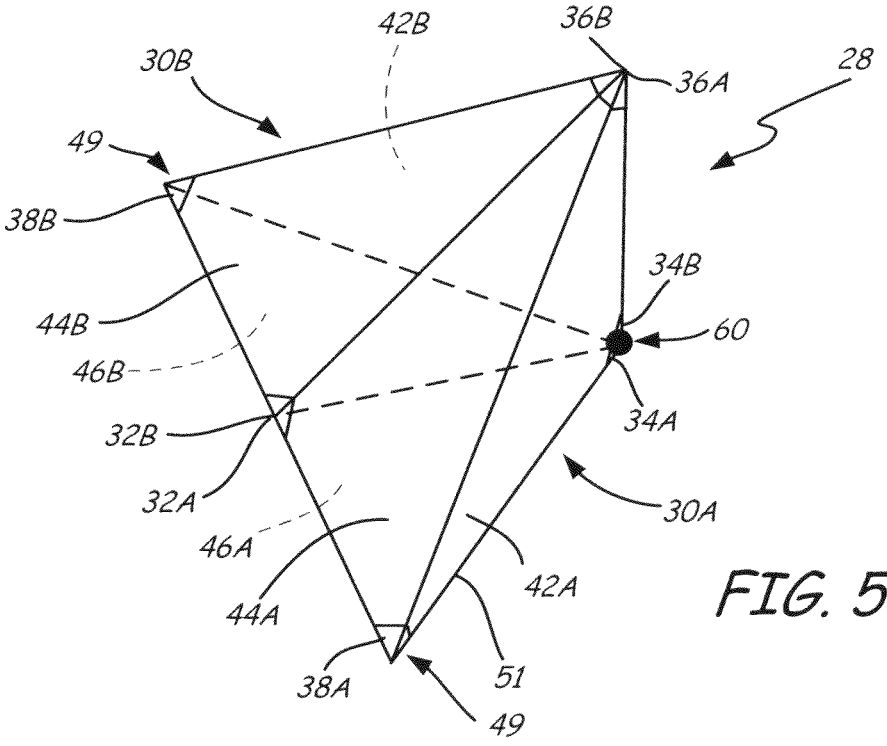
Figure 6B:
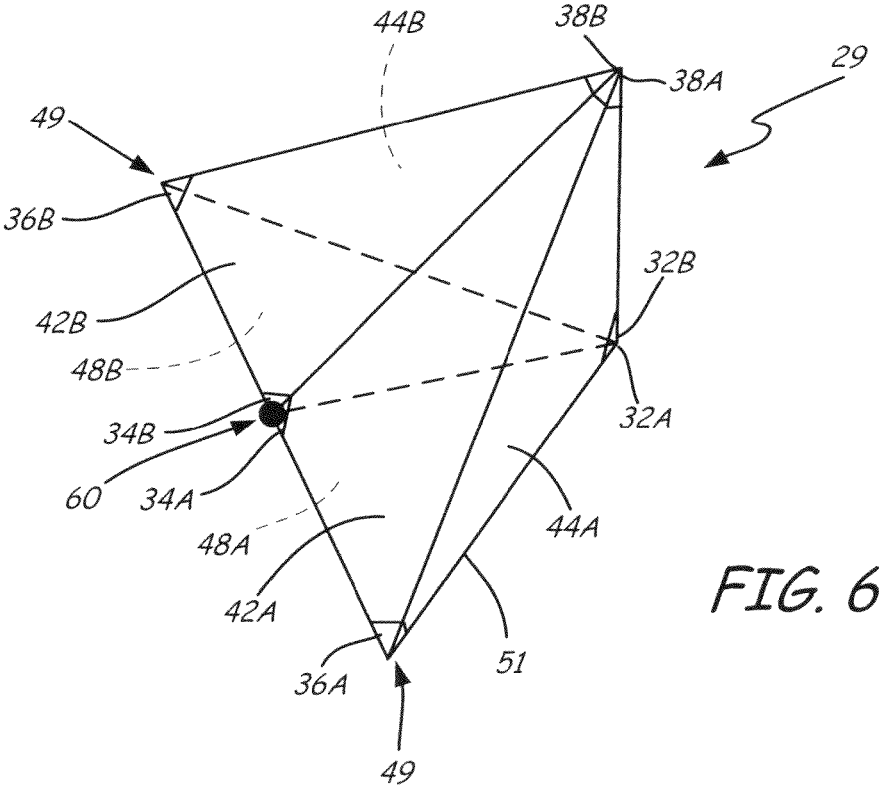

In a second example embodiment of block 24 shown in FIG. 4B, connector 60 is now positioned at corners 34A and 34B instead of corners 32A and 32B. Block 24 is still a combination of units 30A and 30B with square base 50. Unit 30A still has corners 32A, 34A, 36A, and 38A, while unit 30B is seen with corners 32B, 34B, 36B, and 38B. But in contrast to FIG. 4A, large unit face 44A, small unit faces 46A and 48A from unit 30A are now on the outer surface of block 24, as well as large unit face 44B, and small unit faces 46B and 48B from unit 30B. Arrows 5B, seen above units 30A and 30B, direct rotation of block 24 about a vertical axis to expose faces 42A and 42B to reconfigure it into puzzle block 28 as seen in FIG. 5B. Arrows 6B direct rotation of block 24 about a horizontal axis into block 29, as shown in FIG. 6B.

With connector 60 now represented by the black circle at corners 34A and 34B, large faces 42A and 42B are flush against each other at the center of colored block 24, while the second pair of large faces 44A and 44B are on the outside of block 24. This is the reverse configuration of large unit faces seen in FIG. 4A. Similarly, the positions of small unit faces 46 and 48 are also reversed. Unit faces 48A and 48B are at the rear of block 24 in FIG. 4B while faces 46A and 46B define the fifth outer surface, square base 50.

To illustrate the effect of changing the position of connector 60 to corners 34A and 34B, recall the example puzzle unit pair 30 from FIG. 4A. In FIG. 4B, the two front surfaces are now unit faces 44A (green) and 44B (red) instead of faces 42A (yellow) and 42B (white). The rear faces are now small unit faces 48A (blue) and 48B (green) instead of small faces 46A (white) and 46B (blue). Square base 50 in FIG. 4B is now white and blue, not blue and green.

Two additional examples of blocks 24 with different possible color patterns are also shown in FIGS. 4C and 4D. Connector 60 can be positioned at corners 32A and 34B as shown in FIG. 4C, or at corners 34A and 32B as shown in FIG. 4D. In FIG. 4C, block 24 has connector 60 at corner 32A of unit 30A and corner 34B of unit 30B. In addition to corners 32A, 34A, 36A, and 38A, unit 30A contributes large unit face 42A, and small unit faces 46A, 48A to the outer surfaces of block 24. This is the same configuration of unit 30A seen in FIG. 4A. And similar to FIG. 4B, unit 30B contributes large unit face 44B as well as small faces 46B and 48B to the outer surfaces of block 24.

Square base block 24 in FIG. 4C is effectively an amalgam of block 24 from FIGS. 4A and 4B. Therefore, when continuing the color example from above, the two front surfaces of block 24 will be unit faces 42A (yellow) and 44B (red). The small rear surfaces in this example will be small unit faces 46A (white) and 48B (green), while square base 50 is entirely blue due to the combination of faces 48A and 46B.

In FIG. 4D, connector 60 is now at corners 34A and 32B, opposite that of block 24 in FIG. 4C. In FIG. 4D, unit 30A still includes corners 32A, 34A, 36A, and 38A, but with large face 44A, and small faces 46A and 48A visible on the outer surface of block 24. And unit 30B includes corners 32B, 34B, 36B, and 38B, with large face 42B along with small faces 46B and 48B visible on the outer surface of block 24. Since block 24 in FIG. 4D is the inverse of that shown in FIG. 4C, the example color pattern on block 24 will also be different. The two front surfaces of block 24 will be unit faces 44A (green) and 42B (white). The small rear surfaces in this example will be small unit faces 48A (blue) and 46B (blue), while square base 50 is white and green due to the combination of faces 46A and 48B.

As seen in FIGS. 4A-4D, repositioning connector 60 will affect which unit faces define the five outer surfaces of block 24. This in turn defines which colors are available for the puzzle solutions. In certain embodiments, connector 60 is repositionable without being disassembled or detached from unit 30A and 30B. An example of such a connector is described below. Changing the orientation of unit faces by repositioning connector 60 among the four possible combinations shown in FIGS. 4A-4D gives a single puzzle unit pair 30 up to four different color patterns when configured into the same geometry of block 24.

Formation of blocks 24 can generally be described as placing a large unit face (42 or 44) from each of units 30A and 30B together at its center. Triangle-base blocks 28 and 29 can similarly be described as placing small unit faces (46 or 48) from each of units 30A and 30B together. As seen by arrows 5A-5D, forming block 28 entails placing the rear small faces of block 24 into contact, while forming blocks 29 is done by placing the bottom small faces into contact, as shown by arrows 6A-6D.

In addition to the closed configurations shown in FIGS. 4A-4D, it should be noted that units 30A and 30B can alternatively remain in an open configuration. Partial rotation of blocks 24 in the direction represented by respective arrows 5A-5D will result in blocks arranged in an open configuration similar to block 24' shown in FIG. 2E or block 28' shown in FIG. 2F. Completing the rotation until the rear faces are flush define block 28 as shown in FIGS. 5A-5D.

FIG. 5A is a view of small triangle-base block 28 in a closed configuration with triangle base 51. Block 28 includes units 30A and 30B as well as connector 60. On the outer surfaces of block 28, unit 30A has visible corners 32A, 34A, 36A, and 38A, large faces 42A, 44A small face 48A and triangle base 51. Corners 32B, 34B, 36B, and 38B, large faces 42B and 44B, and small face 48B are on the outside of unit 30B.

As discussed above, arrow 5A in FIG. 4A shows how units 30A and 30B can be rotated to reconfigure puzzle unit pair 30 from block 24 into block 28. So as to better illustrate its features, block 28 is shown from the opposite perspective viewed from the opposing surface (i.e. rotated 180° from the view in FIG. 4A). As such, unit 30B is now on the left side of FIG. 5A and unit 30A is now on the right. Here, it can be seen in FIG. 5A that unit faces 46A and 46B are flush at the center of block 28, creating a larger tetrahedral solid with the combined volume of units 30A and 30B. Like other unit faces, faces 46A and 46B can include a metalized portion and be held by magnets 52 within or near the faces.

Four outer surfaces of tetrahedral block 28 define four corners and include two identical right triangles at the rear, an isosceles triangle at base 51, and a right isosceles triangle in the front. The two identical right triangles at the rear are individually defined by large unit faces 44A and 44B, with edges having lengths L, SQRT (2)*L and SQRT (3)*L. Finally, base 51 includes small faces 48A and 48B arranged into an isosceles right triangle with sides having lengths of about SQRT(2)*L, SQRT(2)*L, and 2*L.

Triangle base 51 has two sides of length SQRT (2)*L and a hypotenuse of length 2*L, with both ends of connector 60 at its midpoint. The other isosceles triangle at the front of block 28 is not a right triangle, and has two sides of length SQRT (3)*L and a third side of length 2*L defined by a combination of large unit faces 44A and 44B. Continuing the example color progressions on unit 30A (YGWB) and 30B (WRBG), block 28 will also have a certain color pattern resulting from the position of connector 60 at corners 32A and 32B. The large front outer surface of block 28 in FIG. 5A is defined by unit faces 42A (yellow) and 42B (white). The rear surfaces of block 28 are defined by large unit faces 44A (green) and 44B (red), while triangle base 51 remains blue and green after conversion from square base 50.

Figure 5C:
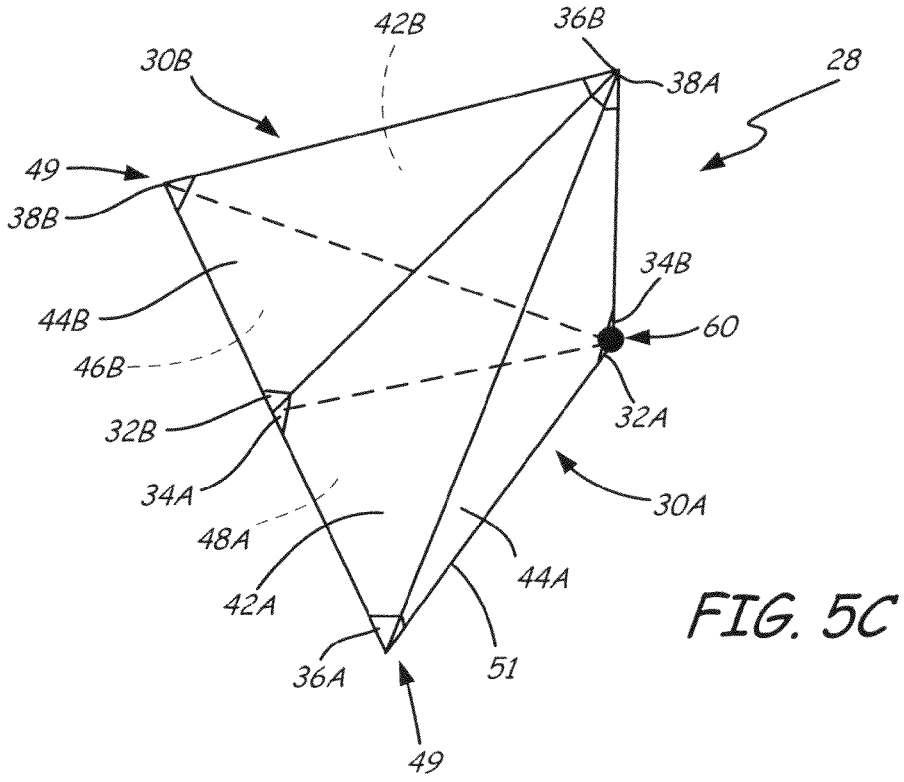
Figure 5D:
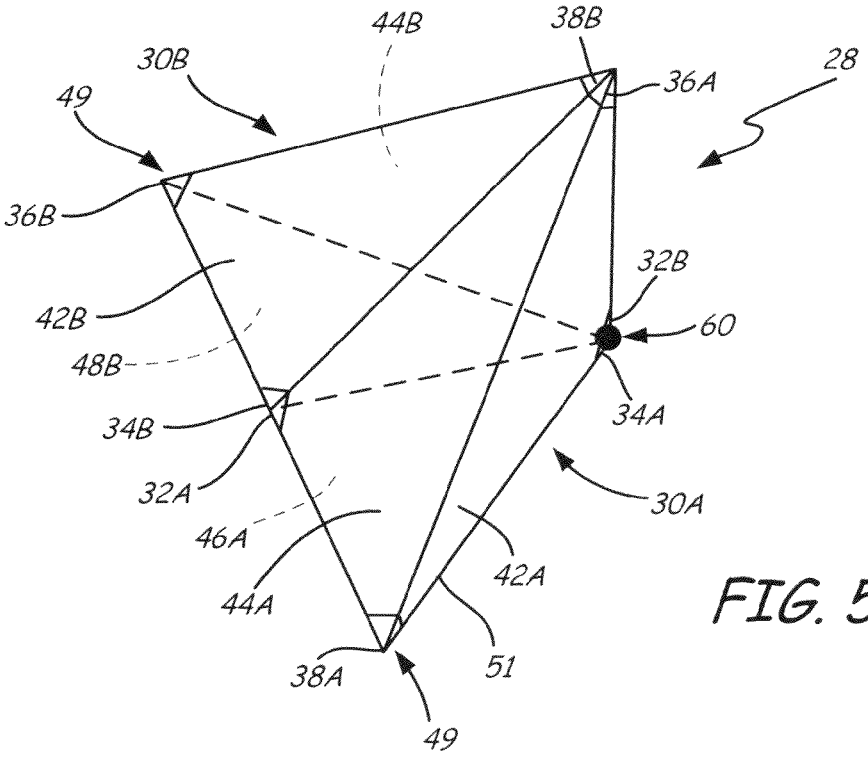

Next, FIGS. 5B-5D illustrate other examples of blocks 28 with connector 60 at different corners of puzzle units 30A and 30B. FIG. 5B shows block 28 with connector 60 at corners 34A and 34B. As was the case in FIG. 5A, block 24 in FIG. 4B is reconfigured into block 28 by rotating unit 30A clockwise and unit 30B counterclockwise in the direction of arrows 5B. Rotation continues until the rear surfaces of block 24 (unit faces 48A and 48B) are flush with each other. As above, block 28 is then rotated 180° for ease of illustration. Large faces 44A and 44B, which originally were located at the front of block 24 in FIG. 4B, now form a single face at the front of block 28 in FIG. 5B. Large unit faces 42A and 42B, previously flush in FIG. 4B, are now individually the two rear surfaces of block 28. Finally, block 28 now has triangle base 51 defined by a combination of small unit faces 46A and 46B.

This configuration in FIG. 5B also affects the example color pattern on block 28 described with respect to FIG. 5A. In FIG. 5B, the large front surface of block 28 is defined by large unit faces 44A (green) and 44B (red), while rear surfaces are defined by large unit faces 42A (yellow) and 42B (white). Base 51 retains the same colors as base 50 in FIG. 4B (white/blue).

FIGS. 5C and 5D also correspond to FIGS. 4C and 4D, respectively. To reconfigure block 24 in FIG. 4C into block 28 in FIG. 5C, units 30A and 30B are rotated in the direction of arrow 5C. When connector 60 is positioned at corners 32A and 34B, block 28 includes small faces 46A and 48B at its center, leaving triangle base 51 to be defined by a combination of small unit faces 48A and 46B. Large unit faces 42A and 44B are combined to form the large block surface at the front of block 28, while large unit faces 44A and 42B individually serve as the two rear surfaces of this instance of block 28.

In FIG. 5D, connector 60 is positioned at corners 34A and 32B, the inverse position relative to FIG. 5C. After rotation of units 30A and 30B in the direction of arrow 5D (shown in FIG. 4D), block 28 in FIG. 5D now includes small faces 48A and 46B in contact, with triangle base 51 defined by small unit faces 46A and 48B. The large surface at the front of block 28 includes large unit faces 44A and 42B, while rear surfaces are large unit faces 42A and 44B.

As described above, four instances of blocks 28 (or 29 as seen in FIGS. 6A-6D) can be oriented into square base pyramid 26 by placing the respective right angles of bases 51 together to define a center point of the pyramid's square base. Alternatively, two of the four blocks 28 or 29 can be oriented with their large upper surfaces (defined in the example of FIG. 5A by unit faces 44A and 44B) aligned along the hypotenuse forming a rhombic base.

As described above in the example shown in FIGS. 2E-2F, puzzle solutions can be also created with one or more configurations of open blocks 24' and/or 28', having only adjacent edges together. This can be done in certain embodiments to position the correct colored faces onto the outer surfaces of solutions. Unit pairs 30 can also be configured into blocks with just a single corner of each unit being adjacent to each other for even more complex solutions.

For example, assume that pyramid 26 (shown in FIGS. 2C-2D) is to have a predefined color arrangement on its four side surfaces in order to solve the particular puzzle challenge. In this example, moving clockwise around the pyramid, the side surfaces have colors yellow, blue, green, and white. Recall that side surfaces of pyramid 26 are defined by the large face at the front of block 28. If each block 28 is in a closed configuration, this large front surface on each block 28 must be all yellow blue, green, and white respectively. However, in sets or subsets using certain color codes, such as a subset of example Color Code 1, closed block 28 does not always include a single color on that large front-facing surface used in pyramid 26. But if one or two blocks 28 are arranged in an open configuration, it becomes apparent that there are now additional methods of achieving the same result by placing a closed block 24 between units 30 in an open block 28'. Additional examples are shown in FIGS. 12A-12B and 14A-14B and described further with respect to Color Code 1 in Tables 2-3.

Block 29 in FIG. 6A shows connector 60 at corners 34A and 34B. Large faces 44A and 44B, which originally were located at the center of block 24 in FIG. 4A, now form a single face at the front of block 28 in FIG. 6A. Large unit faces 42A and 42B, previously at the front of FIG. 4A, are now individually the two rear surfaces of block 29. Finally, block 29 now has triangle base 51 defined by a combination of small unit faces 46A and 46B.

Block 29 in FIG. 6A is defined by having small faces 48A and 48B flush against each other. Units 30A and 30B are rotated around a horizontal axis toward base 51 in the direction of arrows 6A as shown in FIG. 4A. Block 29 is an alternative to block 28. Blocks 29 are the same shape and dimensions as corresponding blocks 28, but connector 60 is located at the midpoint of the hypotenuse of triangle base 51 rather than at its right angle. Like block 28, block 29 is a four-sided tetrahedral solid each with one large face of unit 30A and 30B defining two of the four faces at the rear of block 29. The third and largest face is visible at the front of block 29, which is a combination of the second large face of each unit 30A and 30B. Finally, triangle base 51 is an alignment of two small faces originally at the rear of units 30. Colored block 29 is again rotated for ease of illustration, causing unit 30B to be on the left and unit 30A to be on the right.

Comparing block 29 in FIG. 6A to block 28 in FIG. 5A, it can be seen that the roles of each large unit face and each small unit face are reversed. In other words, in FIG. 5A, large unit face 44A defines the right rear surface of block 28, while unit face 42A defines the right half of the front outer surface. In contrast, unit face 42A in FIG. 6A defines the right rear and unit face 44A defines half of the large front outer surface block 29. Similarly, small faces 46A and 48A alternate between the right half of triangle base 51 and the center of block 28. This inverse relationship between FIGS. 5A and 6A is identical to the relationship between FIGS. 5A and 5B. Going a step further, there is no difference in configuration of outer surfaces between block 29 in FIG. 6A and block 28 in FIG. 5B. For example, triangle base 51 in FIGS. 5B and 6A are both defined by a combination of unit faces 46A and 46B. As such, block 29 in FIG. 6A has the same color pattern as block 28 in FIG. 5B despite moving both ends of connector 60 to corners 34A and 34B.

Moving to FIG. 6B, block 29 includes connector 60 at corners 34A and 34B, as opposed to corners 32A and 32B. Like block 28 in FIG. 5A, block 29 in FIG. 6B has visible corners 32A, 34A, 36A, and 38A, large faces 42A and 44A, and small face 48A on the outside of unit 30B. Small faces 46A and 46B are flush on the inside of block 29 and thus not visible here.

Similar to the relationship between block 28 in FIG. 5B and block 28 in FIG. 6A, it will be apparent that configuration of unit faces on outer surfaces of block 28 in FIG. 5A is identical to the configuration on block FIG. 6B. The four outer surfaces of block 29 in FIG. 6B include two right triangles, large unit faces 44A and 44B, at the rear. Since the two rear surfaces are each defined by a single large unit face, they each have edges with sides measuring about L, SQRT(2)*L and SQRT (3)*L. The remaining two outer surfaces are combinations of two small faces and two large faces respectively. Base 51 is a right isosceles triangle with two sides of length SQRT(2)*L and a hypotenuse of length 2*L formed from a combination of faces 48A and 48B. The second isosceles triangle at the front of FIG. 6B is not a right triangle, and has two sides of length SQRT (3)*L and a third side of length 2*L.

Figure 6C:
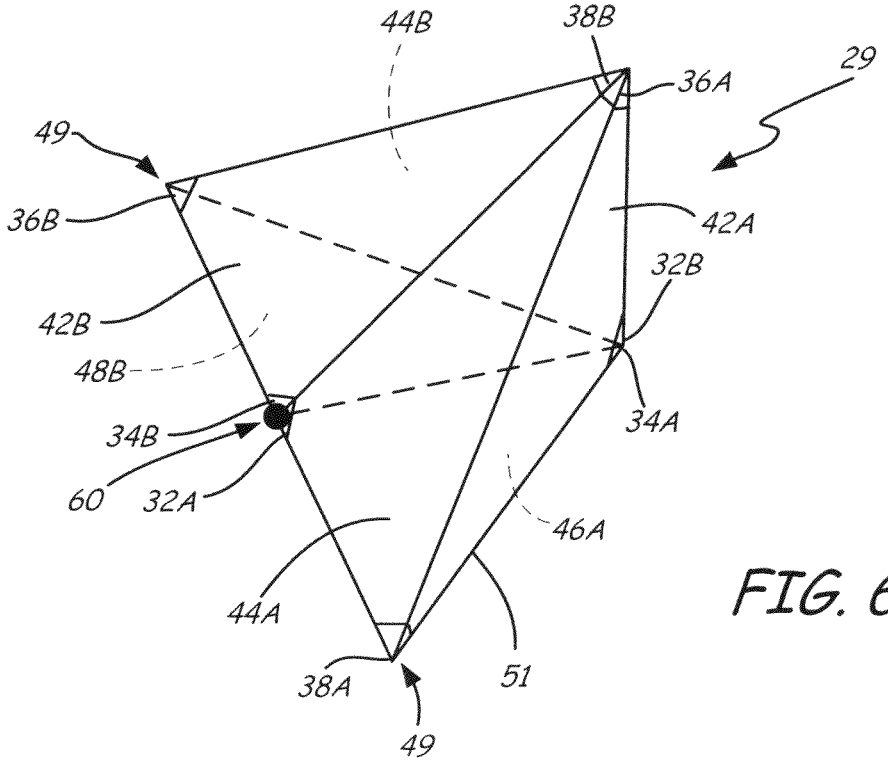

In FIG. 6C, small faces 48A and 46B are flush along a center plane of block 29, similar to block 28 in FIG. 5D. Triangle base 51 is a combination of unit faces 46A and 48B as shown in both FIGS. 5D and 6C. Though connector 60 is repositioned relative to block 28 in FIG. 5D, the large surface at the front of block 29 still includes large unit faces 44A and 42B because units 30A and 30B are also rotated as shown by arrows 6C in FIG. 4C. In this example, the two rear surfaces of block 29 include remaining large unit faces 42A and 44B.

Figure 6D:
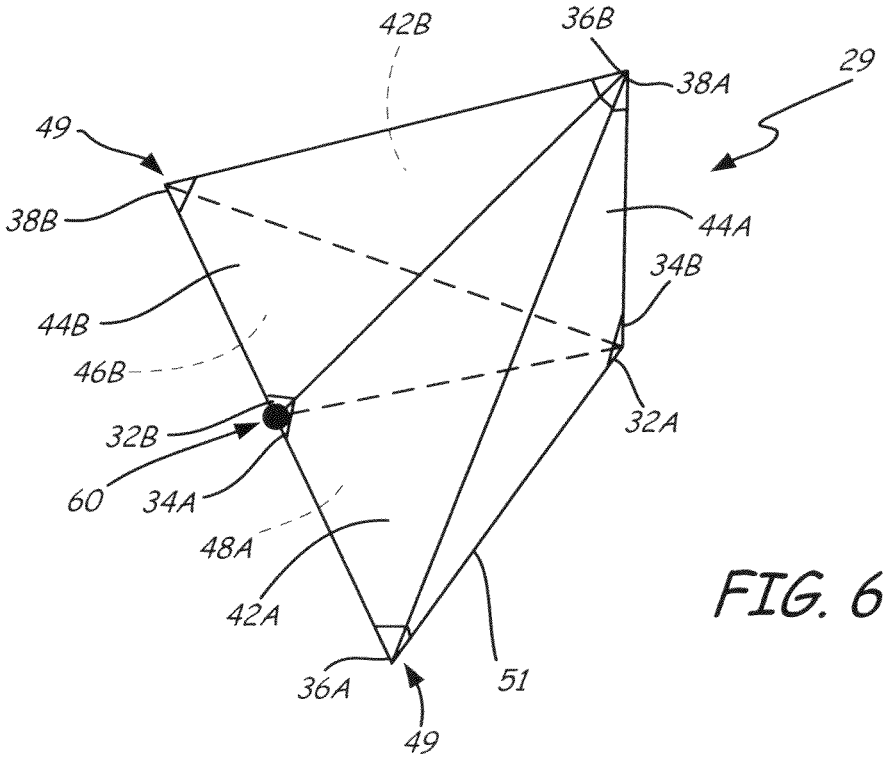

Finally, block 29 in FIG. 6D matches the structure of block 28 in FIG. 5C, save for the position of connector 60 relative to the outer surfaces of each block. Block 29 includes a combination of large unit faces 42A and 44B defining the large outer surface at the front, while the remaining large unit faces 44A and 42B individually form the two rear surfaces of block 29. Triangle base 51 is now formed from a combination of faces 48A and 46B.

In the examples described above, connector 60 is repositionable between two or more corners on units 30A and 30B creating various blocks in closed configurations as shown throughout FIGS. 4-6. In certain other embodiments, one or both ends of flexible connector 60 can be temporarily or permanently fixed at a single corner. While this could reduce the number of solutions in a given set, color codes and corresponding solutions can be created to accommodate connector 60 being fixed in a single position on at least one of units 30A or 30B.

In one example, connector 60 is temporarily fixed at corners 32A and 32B. In those other embodiments, the only relevant versions of blocks 24, 28, and 29 are in FIGS. 4A, 5A, and 6A respectively. In yet other embodiments, connector 60 is only repositionable between two corners on only one of the two linked puzzle units, such that each block 24, 28, and 29 has two of the four possible color patterns shown in the above figures. In yet other embodiments, connector 60 is repositionable between three or four corners of units 30A and/or 30B.

In certain embodiments, connector 60 is one part of a unit connection system that can also include magnets 52 (not shown in FIGS. 4-6). Magnets 52 can be embedded within one or more unit faces used to hold faces of units 30A and/or 30B to metalized portions of other unit faces forming a block in a closed configuration. For example, paired puzzle units 30A and 30B can be configured into closed blocks like blocks 24, 28, and 29 described above and held in place by embedded magnets 52. Magnets 52 can also hold units to other unit faces, such as a part of another puzzle unit pair 30 or, in certain embodiments, an outer surface of virtual block 40.

It will be apparent that magnets 52 can be placed such that units, blocks, and partial solutions can also readily be removed and rearranged using the connection system. For example, magnets 52 allow large portions of solutions to be removed with minimal force, preventing damage or disconnection of other portions of partially solved puzzles. In other embodiments, a number of additional magnets 52 can alternatively be substituted for metalized unit faces and positioned such that the units and blocks remain together only when magnets 52 with opposing polarities on various unit faces are correctly oriented to solve a given challenge.

Construction of Modular Units 30A and 30B

Certain embodiments of the connection system that can include connector 60, embedded magnets 52, and metalized unit faces give the device a very high degree of scalability and flexibility. To further increase this flexibility of the puzzle game, units 30A and 30B can also be built with one or more modular structures that permit changing the various unit faces. Modular structures for units 30A and 30B also can include linking of repositionable connector 60 to an interior surface of modular units 30A and/or 30B without various structural and connector components interfering with one another.

Figure 7A:
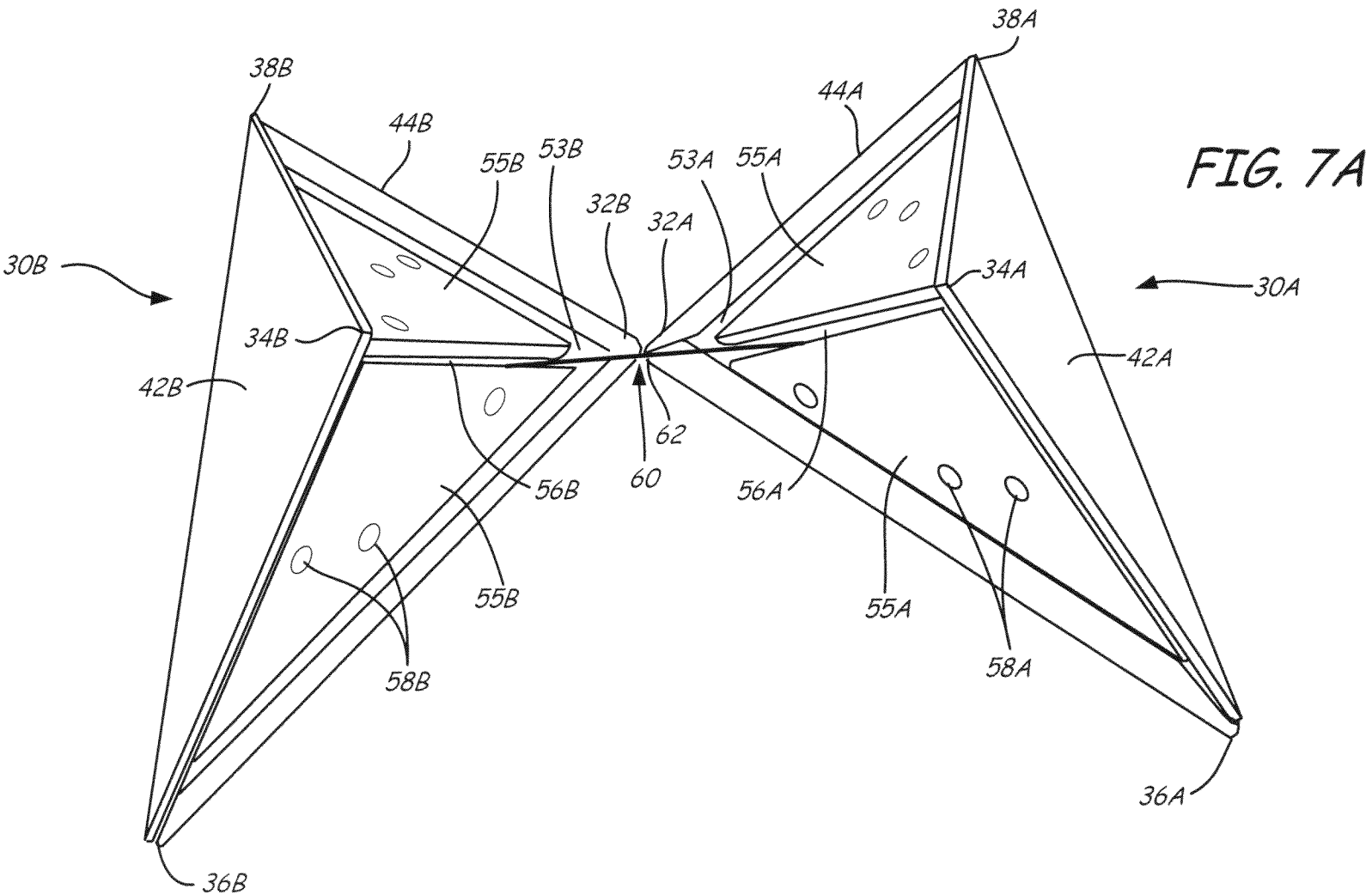
FIG. 7A is a mirror image puzzle unit pair with small unit faces removed.

FIG. 7A shows one embodiment of units 30A and 30B viewed toward respective right angle edges 32A-34A and 32B-34B. On unit 30A, corners 32A, 34A, 36A, and 38A can be seen, as well as large unit faces 42A and 44A. On unit 30B, corners 32B, 34B, 36B, and 38B are visible in addition to large unit faces 42B and 44B. Support member 55A with linear slot 56A and attachment points 58A are seen on the inside of unit 30A. Corresponding mirror image elements 55B, 56B, and 58B are visible on the interior of unit 30B. Connector 60 includes flexible section 62 extending between units 30A and 30B.

Small unit faces 46A and 48A are removed from unit 30A and small faces 46B and 48B are removed from unit 30B to illustrate how one end of connector 60 travels along right angle edge 32A-34A and an opposing end moves along right angle edge 32B-34B without connector 60 being disassembled or detached from units 30A and 30B. In these examples, small unit faces 46A and 48A are held to unit 30A via apertures 58A on support members 54A (not visible in FIG. 7A) and/or 55A, while small faces 46B and 48B are held to unit 30B via apertures 58B on support members 54B (not visible in FIG. 7A) and/or 55B.

Flexible portion 62 of connector 60 moves along linear slots 56A and 56B. As will be seen in more detail in FIGS. 8A-8D, linear slots on unit 30A are actually two linear slots 56A aligned with each other such that support members 54A and 55A attached to an inner surface of the puzzle unit structure will overlap. Unit 30B similarly includes two mirror image linear slots 56B between support members 54B and 55B. As described in reference to FIGS. 8B-8C, certain embodiments of puzzle units 30 also include a small bevel or gap between small faces 46 and 48 to accommodate movement of connector 60.

Figure 7B:
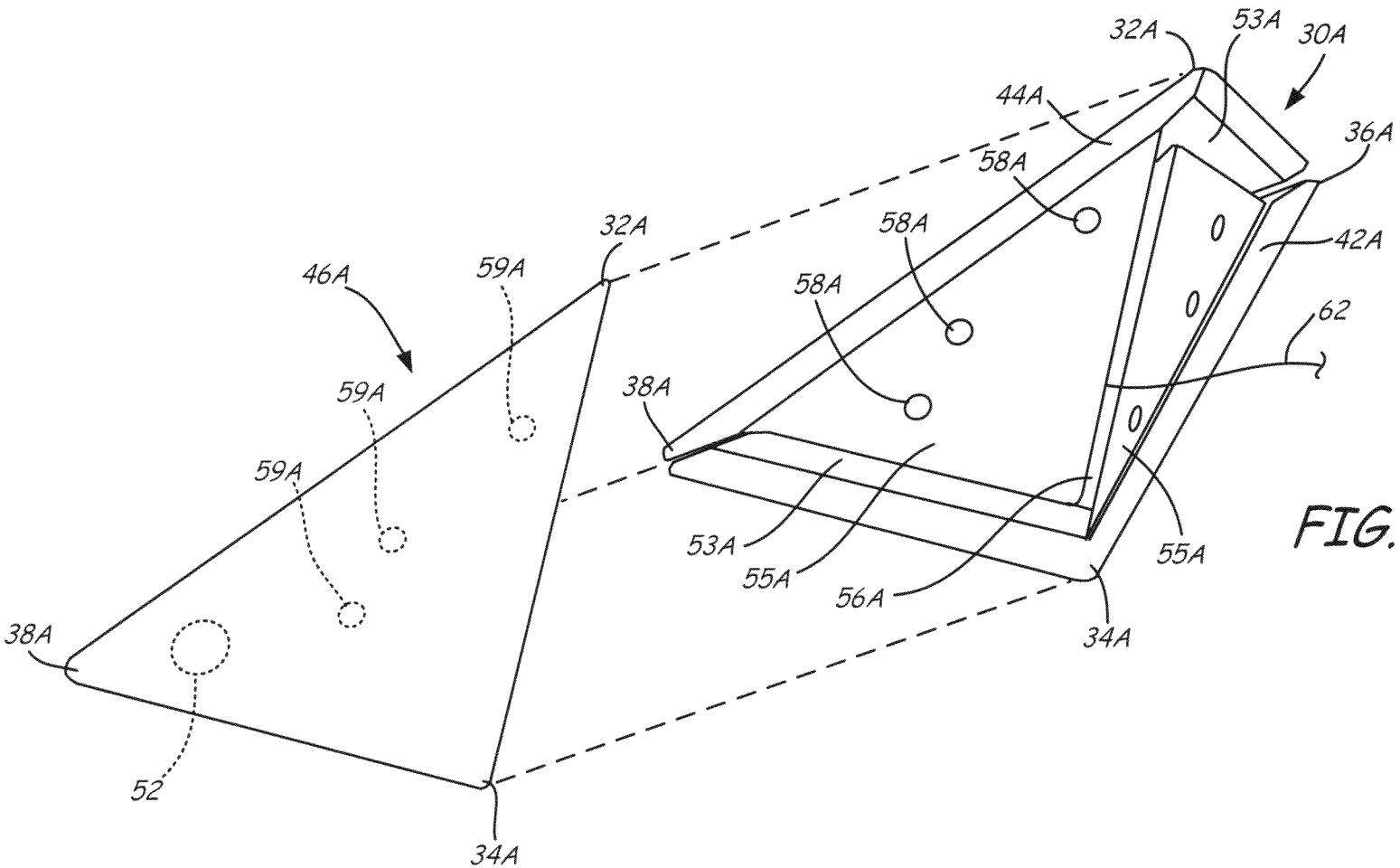
FIG. 7B schematically depicts an exploded view of one of the small unit faces being removed from a first puzzle unit from FIG. 7A
Figure 7C:
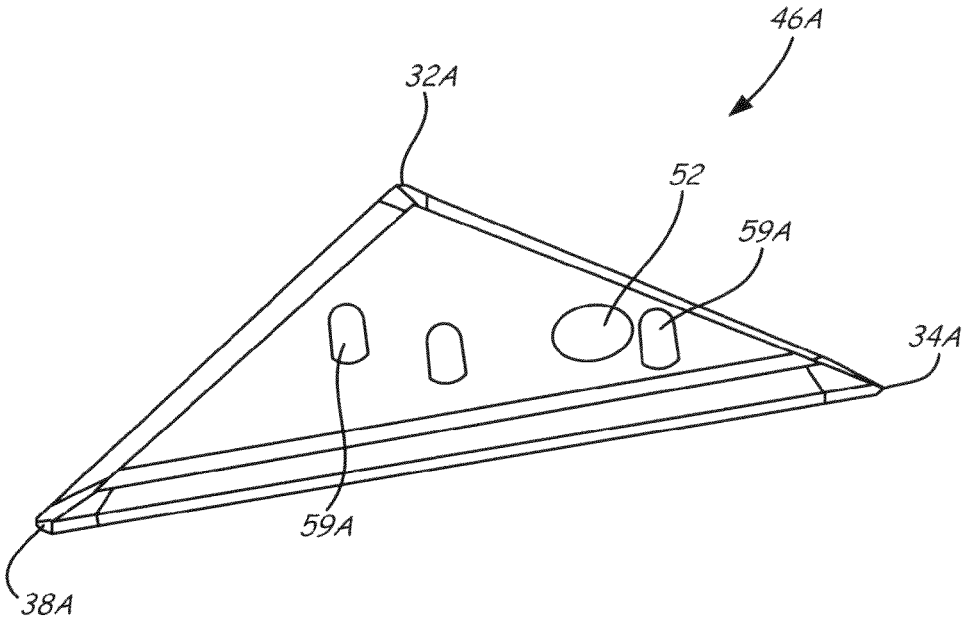
FIG. 7C shows an inner surface of the small unit face removed in FIG. 7B with a magnet and a plurality of pins.

FIG. 7B illustrates an exploded view of small face 46A being removed from unit 30A. Small face 46A includes corners 32A, 34A, and 38A, as does unit 30A. Unit 30A also includes support members 55A, linear slots 56A, face attachment apertures 58A, and connector 60 with flexible section 62. Apertures 58A are engaged by pins 59A located on an inner surface of small unit faces 46A and 48A. FIG. 7C shows this surface of small unit face 46A in detail.

In FIG. 7C, small unit face 46A includes corners 32A, 34A, and 38A, magnet 52, and pins 59A. Magnet 52 is embedded into a bore located on face 46A and is used to hold face 46A against metalized portions of an adjacent unit face. The unit face can be a part of mirror image unit 30B, which would define colored block 28. The adjacent unit face can also be a component of a larger block or solution, or a fastener disposed near an outer surface of a virtual puzzle block such as those shown in FIGS. 9A-9G.

Apertures 58A on support members 54A and 55A receive pins 59A on small unit face 46A. In this example, pins 59A are formed out of a semi-rigid elastic material to facilitate engagement with apertures 58A. The elastic material, such as commonly available polyethylene or polypropylene, temporarily deforms when pressed into apertures 58A. The pressure around the edges of apertures 58A holds pins 59A into place.

Face 46A is also metalized such that one or more magnets 52 in those adjacent unit faces will simultaneously engage with unit 30A. Alternatively, multiple instances of unit faces 46A and/or 48A can include only one of magnets 52 or a metalized portion of the face. The particular distribution of various faces having either a magnet 52 or a metalized portion could be chosen such that only the correct solution would yield the correct combination of unit faces and magnets 52. Magnets 52 and potential alternatives are also included on or proximate embodiments of large unit faces and virtual puzzle blocks as described in more detail below.

In certain embodiments, the geometry of small face 48A is substantially identical to small face 46A. In some embodiments, this identity of faces 46A and 48A also extends to the location of magnet 52 and pins 59A. Uniformity of faces 46A and 48A simplifies manufacturing, and makes small unit faces interchangeable as well as removable. Alternatively, pins 59A can be located according to a plurality of different layouts corresponding to layouts of apertures 58A. Multiple pin patterns on different faces 46A and/or 48A can then indicate, in conjunction with complementary arrangements of apertures 58A whether the player is correctly installing faces for a given color code or other puzzle set.

In certain embodiments, interchangeable unit faces are also coded with a color or design, and a player can recombine the interchangeable faces from different puzzle units to change the color progression on puzzle units 30A or 30B. The player can then disassemble and recombine a plurality of these units to create his or her own codes and corresponding solutions.

In some embodiments, unit 30A includes support members 54A and 55A as part of puzzle unit assemblies 41A and 43A. In one example, shown in FIG. 8A, support members 54A and 55A on each assembly overlap and interlock. Pins 59A on small unit 46A project through apertures or other attachment points 58A aligned on these support members 54A and 55A. When pins 59A engage, both overlapping members assemblies 41A and 43A are locked in place. Alternatively, pins 59A may be deep enough to project through only the outer support member 54A or 55A. In yet other embodiments, only this outermost support member 54A or 55A includes attachment points 58A aligned with pins 59A on a corresponding face 46A or 48A. Each of these alternative embodiments can limit the interchangeable nature of units 30A or 30B.

Figure 7D:
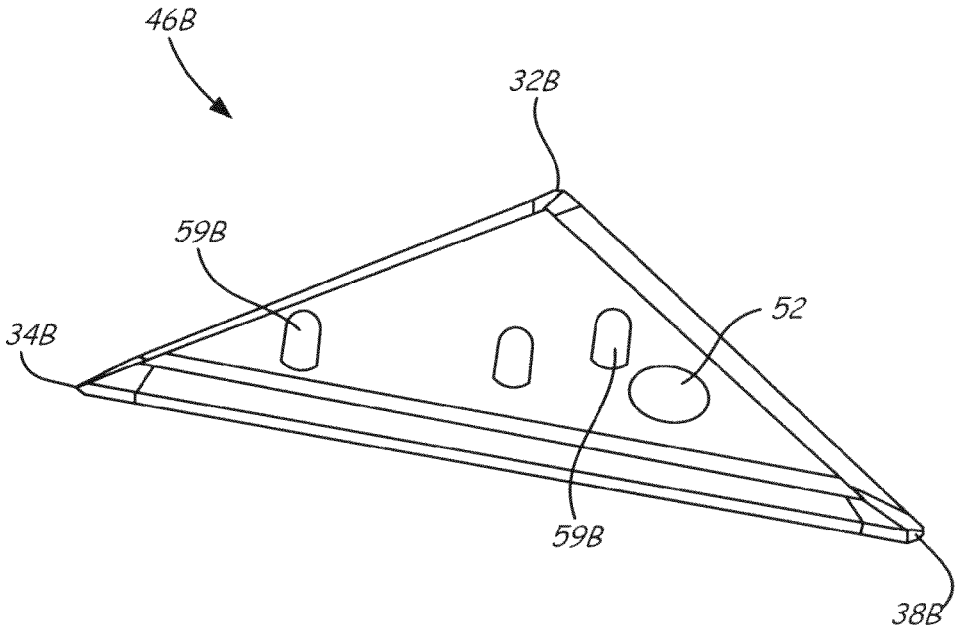
FIG. 7D is an inner surface of a small unit face removed from the puzzle unit pair shown in FIG. 7A.

FIG. 7D shows an inner surface of small unit face 46B, which is removed from the geometric mirror image puzzle unit 30B. Face 46B includes corners 32B, 34B, and 38B, magnet 52, and pins 59B. Pins 59B are arranged into a layout that is a mirror image of pins 59A on unit face 46A. Like pins 59A, pins 59B can also be disposed on the inner surface to engage with apertures 58B through both support members 54A and 55A. In certain embodiments pins 59B only engage when small face is placed correctly to create a set with a particular color code.

However, the mirror image relationship of small unit faces 46A and 46B does not extend to placement of magnet 52. It can be seen from comparing FIGS. 7C and 7D that magnet 52 is on the same (right) side of unit face 46B as magnet 52 in unit face 46A. For example, it will be apparent that placing a unit face 46A flush against unit face 46B, magnets 52 would be forced together if they were placed according to a mirror image relationship between them. Instead, they are placed as shown in FIGS. 7C and 7D such that magnets 52 will be on opposing sides. This permits engagement of magnets 52 with metalized portions of the complementary unit face and prevents magnets 52 from repelling each other in the event their poles are aligned.

Figure 7E:
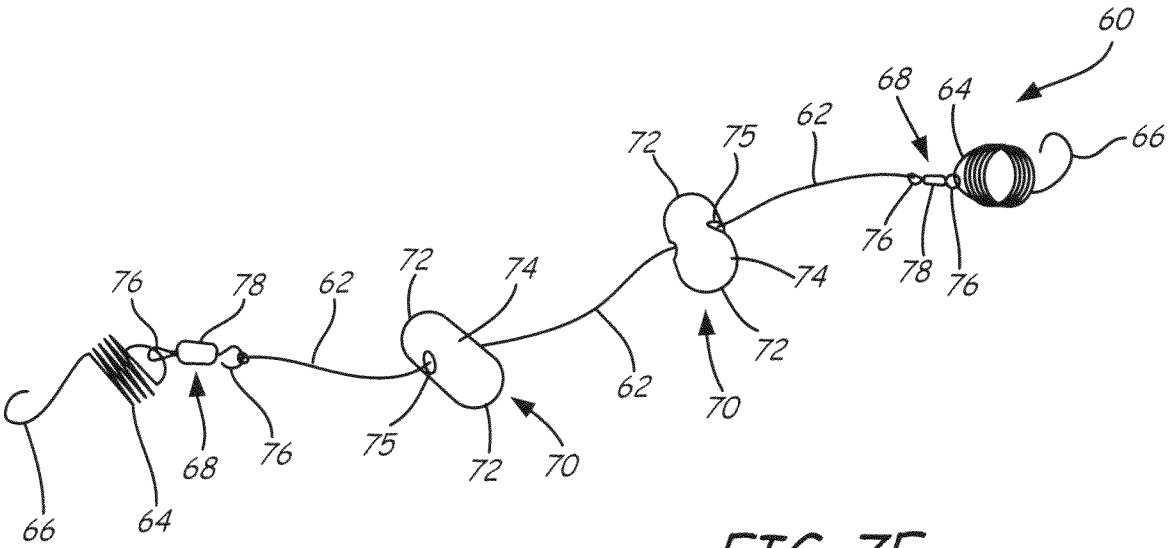
FIG. 7E is a repositionable connector used to link the units shown in FIG. 7A.

FIG. 7E depicts an example of repositionable connector 60 with flexible section 62, springs 64, linkage 66, coupling 68, and slider 70. Slider 70 includes ends 72, cylinder 74, and passage 75. Coupling 68 has eyes 76 and swivel 78.

The components shown in FIG. 7E, as well as those on the inside of puzzle units 30A and 30B guide connector 60 with little difficulty. Flexible section 62 forms a substantial part of the length of connector 60 extending into units 30A and 30B, and is attached at one or both ends to an elastic section. As seen in FIG. 7A, the player simply pulls on one end of connector 60 to move it toward the selected corner. These elastic sections, such as springs 64, absorb excess forces from pulling connector 60 to each corner. The elastic counterforce of springs 64 also assists in holding connector 60 in place at a selected corner once the player has stopped applying force. The counterforce tends to pull one end of flexible section 62, attached directly or indirectly to one end of spring 64, into the interior volume of the given puzzle unit and reducing the length of section 62 outside units 30A and 30B. Linkage 66, at or near the other end of spring 64 hold connector 60 to one or more surfaces on an interior volume of each puzzle unit. Alternatively, a separate hook or linkage 66 can be attached to spring 64, which will engage a strut or other inside surface of each unit. While FIG. 7E depicts two springs 64 on connector 60, alternative embodiments include a single spring 64.

Slider 70 has ends 72, cylinder 74, and passage 75. Slider 70 is installed within unit 30 to help facilitate movement of connector 60 between corners, such as corners 32 and 34. In certain embodiments, such as shown in FIGS. 8C-8E, slider 70 moves along cylindrical channel 80 (not shown in FIG. 7E). Cylinder 74 retains slider ends 72. In certain embodiments, slider ends 72 include metal to engage with magnetic structures proximate either end of channel 80, such as magnets 52. This helps retain slider 70, and thus connector 60, at the selected corner. Depending on the balance of forces applied to connector 60, flexible section 62 is either pulled through passage 75, or against slider body 72. When pulled against slider body 72, slider 70 is pulled along channel 80. Operation of slider 70 is discussed in more detail with respect to interaction of connector 60 and units 30 in FIGS. 8C-8E.

Coupling 68 rotatably links springs 64 to flexible section 62, reducing wear and tear and simplifying manipulation of puzzle unit pair 30. Coupling 68 includes eyes 76 at either end of swivel 78. With swivel coupling 68, units 30A and 30B are free to rotate relative to connector 60 a virtually unlimited number of times, with the twisting motion absorbed by swivel coupling 68. Eyes 76 are freely rotatable within coupling 68, thus reducing torsional stresses on flexible portion 62. If unit 30A or 30B is rotated repeatedly in the same direction without coupling 68, these forces can cause unwanted detachment of connector 60, or cause damage to linkages 66 or spring 64 at either end of connector 60, such as from unwinding or overwinding.

Alternative embodiments of connector 60 can include a greater or lesser number of the above components, including springs 64, couplings 68, and sliders 70. It will also be apparent that flexible section 62 need not be a single string, filament or other flexible apparatus as shown. Flexible section 62 can alternatively be a plurality of flexible elements between other elements of connector 60 as needed to increase the distance between units 30A and 30B or to prevent interference among the several components of connector 60. For example, a portion of flexible section 62 can be disposed between spring 64 and linkage 66, which could simplify removal of slider 70 from channel 80 when faces of units 30A and 30B are reconfigured to create additional color codes. Similarly, a portion of flexible section 62 can also be used to join swivel coupling 68 and slider 70. In that example, and passage 75 would be replaced by two connection points on the outside of slider body 72 for fixing flexible section 62 to slider 70.

As noted above, adapting puzzle unit pair 30 to include repositionable connector 60 allows different combinations of unit faces to be visible on outer surfaces of colored blocks 24, 28, and 29. When connector 60 is positionable at more than one corner of unit 30A or 30B, a greater variety of puzzle challenges can be presented, as well as raising the level of difficulty by introducing an element of misdirection, especially to more experienced players. Repositionable connector 60 can also make it simpler to develop new color or design code schemes with fewer pieces by increasing the available permutations of the available colors or designs.

Any repositionable connector may be used to configure puzzle unit pairs 30 into the example blocks shown in FIGS. 4-6. However, certain embodiments of repositionable connector 60, such as the example shown in FIG. 7E, are readily moved along selected edges of the puzzle unit with relatively minimal effort while being held securely once the corner is selected. Repositioning connector 60 between corners can be done without removing or detaching linkages at either end from units 30A and 30B because the combination of components work together. This helps to prevent premature damage and wear on the connector components compared to other designs. For example, repeated removal and movement of a rigid connector inserted into a bore can cause a fracture of the unit or the connector near the selected corner, or near the connector linkage to unit from stress concentrations or fatigue. The fractured segment can be next to impossible to remove from the bore, making that part of the puzzle inoperable.

Further, because example connector 60 is rather unobtrusive, it is less likely to interfere with adjacent parts of the puzzle that have already been placed. Units 30A and 30B can be freely translated while reducing the risk of accidentally knocking over or pulling apart the wrong sections of a partially solved puzzle. Magnets 52, described below, also allow large portions of solutions to be readily disassembled and repositioned without undoing a significant amount of work, none of which can be done with units fixed into a chain.

These elements also contribute to making example connector 60 more resilient than other connectors, and solving larger puzzles. For example, a rigid connector with a single pivot point can protrude from the puzzle at odd angles, complicating formation of the desired geometric shape. A small, thin, flexible filament, such as flexible section 62, is unobtrusive and can be concealed easily between the two mirror image faces of units 30. Spring 64 also allows a substantial portion of flexible section 62 to be stored on the interior volumes of the respective puzzle units when spring 64 is unloaded, while still keeping additional length available when needed for rotating and repositioning the units. Coupling 68 and slider 70 also contribute to free motion of puzzle unit pair 30. All of these elements of connector 60 can be readily integrated with a modular and interchangeable construction of units 30A and 30B, shown in FIGS. 8A-8E.

Figure 8A:
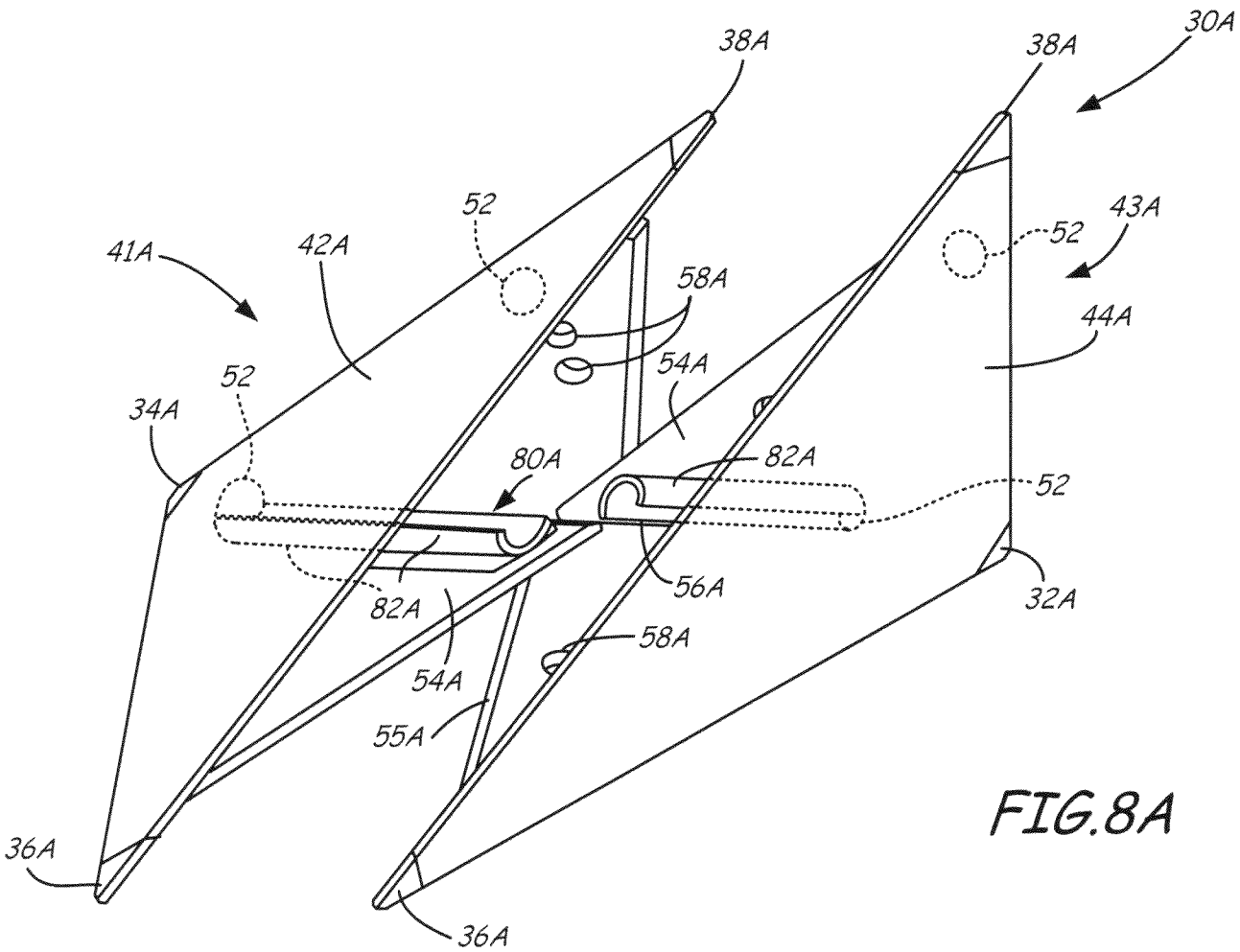
FIG. 8A schematically depicts two puzzle unit assemblies each with a large unit face and overlapping support members interlocking to form a modular and interchangeable structure of the first puzzle unit shown in FIG. 7A.

FIG. 8A shows two puzzle unit assemblies 41A and 43A being combined to form the internal structure of interchangeable unit 30A seen in FIG. 7A. One instance of assembly 41A includes large unit face 42A with corners 34A, 36A, and 38A, while assembly 43A includes face 44A with corners 32A, 36A, and 38A. Each assembly also has embedded magnets 52, as well as two projecting support members 54A and 55A. Support members are separated by linear slot 56A and both include face attachment apertures 58A. On both assemblies 41A and 43A, support member 54A includes radial channel section 82A.

As seen at the front of FIG. 8A, faces 42A and 44A come together at an angle of about 60° to define common edge 36A-38A. The structure of interchangeable unit 30A is formed by arranging puzzle unit assemblies 41A and 43A relative to each other such that linear slots 56A on each assembly are axially aligned as shown in FIG. 8A. Assemblies 41A and 43A are then engaged to define the structure of unit 30A, prior to addition of small unit faces 46A and 48A. A completed version of this unit 30A structure is also seen in FIG. 7A. Also seen in FIG. 7A is the mirror image counterpart structure of unit 30B linked by connector 60, which can be constructed in a similar manner as described below in reference to FIG. 8C.

Returning to FIG. 8A, channel sections 82A are approximate half cylinders shown in phantom on unit faces 42A and 44A, with respective channel ends proximate unit corners 32A and 34A. When assemblies 41A and 43A are arranged as described above, sections 82A form a substantially cylindrical channel 80A (shown in FIG. 8E). Slider 70 travels between ends of channel 80A, guiding the corresponding end of connector 60 between corners 32A and 34A. Channel 80A is not a closed cylinder because it also includes two radially opposing longitudinal conduits 86 (in FIGS. 8D-8E) for flexible section 62 to travel along and through channel 80A.

Also shown in phantom are magnets 52 proximate either longitudinal end of channel sections 82A. In certain embodiments, these magnets 52 can serve dual duty. Magnets 52 attract and hold a metalized end 74 of slider 70 to help retain slider 70 and thus the corresponding end of connector 60 at a selected corner of unit 30A. Magnets 52 can also be a component of the unit connection system described above where they hold unit 30A flush against a metalized portion of other puzzle units 30A or 30B, or against a metalized fastener located in or proximate an outer surface of a virtual puzzle block 40. Channel sections 82 are seen in more detail in FIG. 8D, and a cross section of completed channel 80 is shown below in FIG. 8E. Examples of virtual puzzle blocks are shown in FIGS. 9A-9G.

Also seen in FIG. 8A, linear slots 56A are aligned to define a single path for flexible connector section 62 to pass between overlapping pair of support members 54A and 55A. As part of aligning linear slots 56A, both pairs of support members overlap with each other, effectively interlocking assemblies 41A and 43A. Support member 54A on each assembly overlaps with support member 55A on the counterpart assembly. As seen in FIG. 8A, support member 54A on assembly 41A and support member 55A on assembly 43A overlap such that support member 55A on assembly 43A is closer to the outer surface of unit 30A. At the same time, support member 54A on assembly 43A and support member 55A on assembly 41A also overlap such that support member 55A is also closer to the outer surface of unit 30A. In other words, support member 55A on puzzle unit structure 41A will be adjacent to small unit face 46A, while small unit 48A will be adjacent to support member 55A on puzzle unit structure 43A. This arrangement ensures that channel sections 82A are inside the structure created by engagement of unit assemblies 41A and 43A.

To facilitate overlap of the two pairs of support members, support member 54A can be set back further from edge 34A-36A than support member 55A disposed along edge 34A-38A. This setback is better illustrated in FIG. 8B. Alternatively, the relative setbacks of the support members on each puzzle assembly can be reversed from the setback of support members 54A and 55A shown in FIGS. 8B-8C. In that alternative example, support member 55A is further from its adjacent edge 34A-36A such that the units overlap in the order opposite the order shown in FIG. 8A. In either case, the same support member 54A or 55A is set back from its adjacent edge on both assemblies such that assemblies 41A and 43A can engage without interference from support members 54A and 55A. It will also be apparent that, if the setbacks are reversed, in embodiments including radial channel sections 82A, such sections are disposed on support members 55A instead of support members 54A. This is to ensure that channel 80A remains located on the interior of unit 30A and to prevent interference between support members 54A and channel sections 82A during engagement of puzzle unit assemblies 41A and 43A.

In certain embodiments, such as in the example shown in FIG. 8A, puzzle unit assembly 41A is geometrically identical to assembly 43A. The symmetry and dimensions selected for tetrahedral puzzle units 30A and 30B permits many of the internal components to be easily duplicated including both assemblies as well small faces 46A and 48A described above. As will also be apparent from FIGS. 8A-8E, two instances of mirror image puzzle unit assembly 41B, shown in FIG. 8C, can be engaged with each other in a similar manner to define the structure of puzzle unit 30B, shown in FIG. 7A.

Figure 8B:
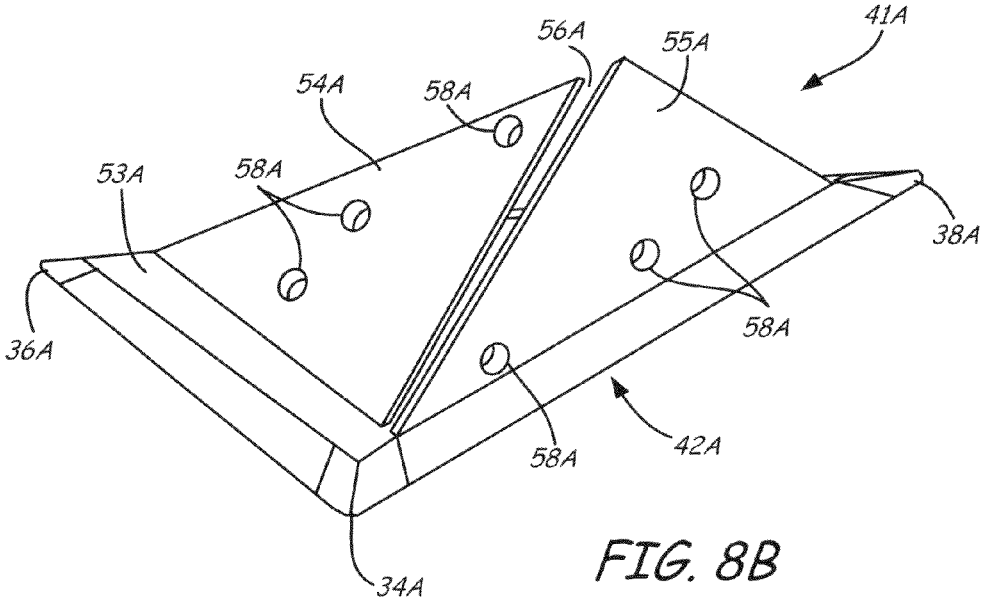
FIG. 8B is an outer view of one of the interlocking puzzle unit assemblies shown in FIG. 8A with a large unit face and two support members projecting from an inner surface.
Figure 8C:
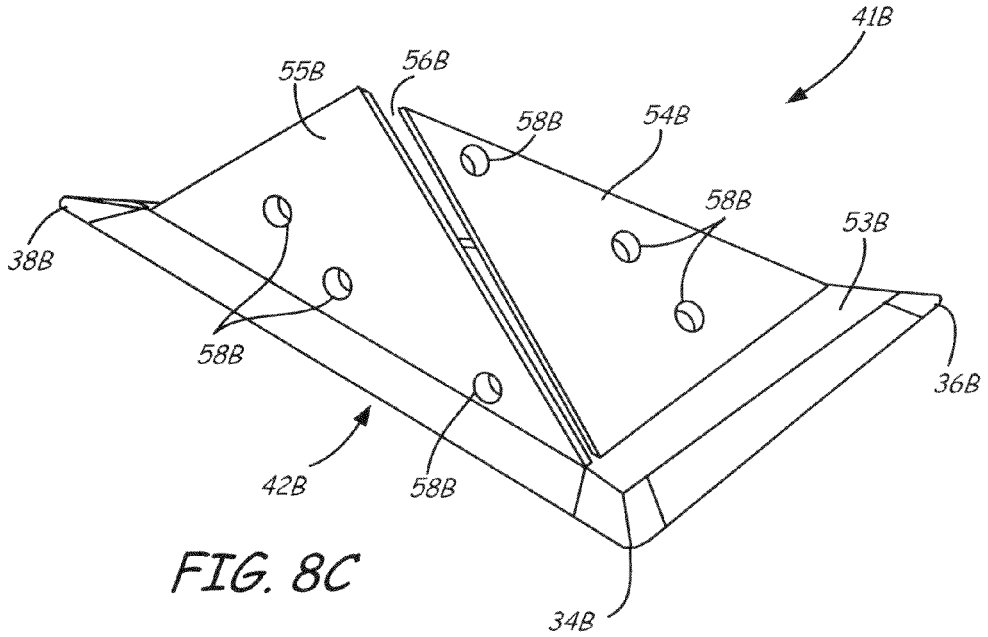
FIG. 8C is an outer view of a puzzle unit assembly that is the mirror image of the puzzle unit assembly shown in FIG. 8B
Figure 8D:
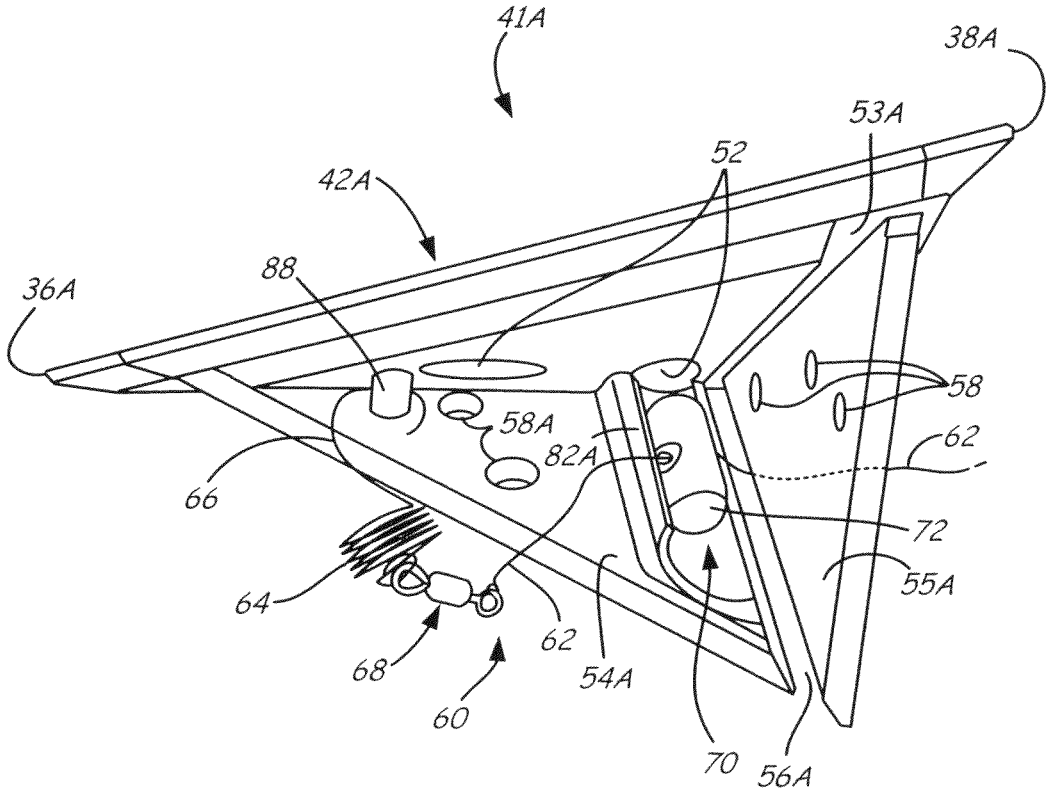
FIG. 8D depicts the internal structure of puzzle unit assembly shown in FIG. 8B, including a unit connector and a channel for a slider.
Figure 8E:
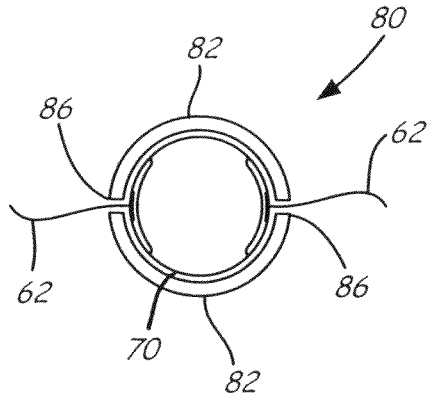
FIG. 8E is a cross section of a completed slider channel on the inside of the modular puzzle units.

FIG. 8B is a detailed rear view of a puzzle unit assembly 41A, which includes large unit face 42A and inner surface 53A. Unit face 42A has corners 34A, 36A, and 38A, while support members 54A and 55A project from inner surface 53A. Support members 54A and 55A both include apertures 58A, and are perpendicular to each other at linear slot 56A.

Support members 54A and 55A project from inner surface 53A proximate edges 34A-36A and edge 34A-38A respectively. Support member 55A extends substantially perpendicular from an inner surface of face 42A, while support member 54A extends at an angle of about 45°. This provides surfaces for engagement of small faces 46A and 48A. They are substantially the same size as each other and are proportional and parallel to faces 46A and 48A. Overlapping support members 54A and 55A on assemblies 41A and 43A are oriented in substantially parallel planes to the respective faces to allow face 46A and/or 48A to sit flush against them, such as when pins 59A engage apertures 58A (shown in FIG. 7B).

To further secure assemblies 41A and 43A, attachment apertures 58A are laid out on support members 54A, 55A to align with the layout of pins 59A, such as those on inner surfaces of unit faces 46A and 48A (shown in FIGS. 7C-7D). Pins 59A having a sufficient depth to pass through corresponding apertures 58A on both overlapping support members 54A and 55A can prevent structures 41A and 43A from being separated until pins 59A are removed. In alternative embodiments described above, apertures 58A need not match up with pins 59A on every instance of units 30A in a given puzzle set. For example, puzzle unit assemblies 41A and 43A and small unit faces 46A and 48A can be created with a fixed number of matching layouts of apertures 58A and pins 59A to restrict units 30A and 30B to specific color progressions.

Certain embodiments of interchangeable units 30, such as the examples described above, inner surfaces of faces 42, 44, 46, or 48 include mitered edges. Edges are mitered, such as by machining or molding, into angles of approximately half the angle between the adjacent unit faces. For example, faces 42A and 44A, which form a 60° angle, include mitered edge 36A-38A on or near inner surfaces 53A, at opposing angles of about 30°. This allows faces 42A and 44A to fit tightly together when assemblies 41A and 43A are engaged as in FIG. 8A.

In yet other embodiments, such as those with example repositionable connector 60, one or more unit faces are additionally beveled along one or more common edges, causing such unit faces to have dimensions slightly less than the nominal dimensions of the unit face. In one example, small unit faces 46 and 48 are right triangles having a height slightly less than L to accommodate movement of connector 60 between right angle corners 32 and 34. The total reduction in the height of unit faces 46 and 48 approximate a cross-sectional dimension, such as the diameter, of flexible section 62. In any case, the reduction is small enough to retain the substantially tetrahedral shape of units 30A and 30B. In other embodiments where connector 60 moves beyond corners 32 and 34, other corresponding faces and edges can be similarly modified.

The relative dimensions and symmetry of the tetrahedral puzzle shape, with the uniform and mirror image geometry of assemblies 41 and 43, as well as small unit faces 46 and 48, also simplifies manufacturing of puzzle unit pair 30. Unit faces and assemblies can be constructed using most conventional material processing techniques. For example, large and small unit faces can be constructed by forming the basic triangle shape out of a readily available inexpensive thermoplastic such as polyethylene by conventional heat-assisted molding or pressing. This step can include formation of pins 59A and/or inner surface 53A as well. A thin metal sheet is then placed over what will eventually become the colored face. Holes for magnets are then bored or drilled through the thermoplastic and the metal sheet, and the magnet is inserted flush with the outer surface. This surface can be further processed to be flat and even. Edges of the triangle are mitered and/or beveled as described above. Another thin thermoplastic sheet can then be wrapped over the metal and magnet and affixed to the inner surface near the outer edges of the triangle. The final plastic sheet can be colored or marked with the desired design either before or after placement. In one example, the final plastic sheet is two separate sheets, a strong clear thermoplastic to secure the elements including magnet 52, and a second thin colored sheet to mark the unit face with the selected color. Alternatively, the unit face and inner surface 53A can be molded or otherwise formed as a single entity with colored thermoplastic pellets or other raw material.

As described above, support members 54A and 55A are fixed to inner surfaces 53A. They can alternatively or additionally be adapted and fixed to other surfaces, such as unit faces 46A and/or 48A. Puzzle unit assembly 41A can be fabricated as a single entity or be made separately and later assembled. For example, support members 54A and 55A can be formed as part of a single mold with unit face 42A and/or inner surface 53A. Alternatively, support members 54A and 55A are made in a separate mold and bonded later to inner surface 53A. This increases the number of parts for manufacturing, but may be preferable based on individualized manufacturing considerations such as cost, speed, existing equipment, quantity, tolerance, etc.

Another alternative embodiment includes large unit face 42A being separable from the puzzle unit assembly 41A. It will be apparent that unit face 42A can be adapted to be removable from the rest of assembly 41A, such as face 42A being engaged via pins into apertures in a manner similar small unit faces 46A, 48A engaged with support members 54A, 55A. Yet other embodiments have all four faces being held to a single integral support structure via pins. In these embodiments, a complete set of interchangeable unit faces eliminates the need to detach connector 60, allowing it to be permanently fixed to unit 30A or the support structure.

As seen in FIG. 8C, puzzle unit structure 41B is a geometric mirror image of puzzle unit structure 41A. For example, when face 42B is viewed from above right angle corner 34B, edge 34B-38B is on the left while edge 34B-36B is now on the right. Similarly, perpendicular support member 54B is now located on the left while support member 55B, disposed at an acute angle from face 44B, is on the right. As will also be apparent from the description and the figures, faces 42B and 44B are geometrically identical.

Next, FIG. 8D is a view of connector 60 linked to puzzle unit assembly 41A. This perspective view of assembly 41A includes face 42A with corners 36A, 38A, and magnets 52 embedded in inner surface 53A. Support members 54A, 55A, separated by linear slot 56A, project from inner surface 53A and include apertures 58A. Connector 60 includes flexible section 62, spring 64, linkage 66, swivel coupling 68, and slider 70. Swivel coupling 68 includes eyes 76 and swivel 78, while slider 70 with ends 72, is disposed within radial channel section 82.

FIG. 8D is taken from a perspective opposite the perspective view of FIG. 8B, to better illustrate the different elements on the interior volume of interchangeable puzzle unit 30A. Connector mount or linkage 88 is attached to a surface on the inside of assembly 41A. Connector linkage 88 is a strut extending between inside surface 53A and support member 54A proximate corner 36A. In this example, connector 60 is secured to unit 30A by wrapping hook or linkage 66 around or assembly 41A under connector linkage 88. The opposing end of spring 64 and flexible section 62 are tied, hooked, or otherwise attached to eyes 76 of coupling 68. In this example, linkage 66 is one end of spring 64 molded into a hook-type arrangement. It will be apparent that linkage 66 can instead be a separate hook or other semi-permanent mechanical attachment. In certain embodiments, detachment of connector is done by removing swivel coupling 68 from spring 64 rather than removing linkage 66 from strut 88.

Alternatively, connector 60 can be joined to unit 30A in several other ways. For example, connector mount 88 can also or alternatively be included in the structure of face 44A. In some other examples, connector mount 88 is disposed on only one surface of face 42A (or 44A). Hook 66 can semi-permanently attach spring 64 to units 30 while attachment and detachment of connector 60 is done by disconnecting coupling 68 from spring 64. Also, as noted above, hook 66 need not be integral with spring 64, and can instead be a separate component. Also noted above are alternative embodiments where connector 60 includes a single spring 64 and/or coupling 68 instead of two as shown in example connector 60 of FIG. 7E. Each example provides a connection point on an inner surface permitting relatively free motion of connector 60 between two or more corners without disassembling or detaching it from units 30A or 30B.

As can be seen in FIG. 8D, flexible section 62 of connector 60 extends out of gap 56A between support members 54A and 55A. As shown in FIG. 8A, gaps 56A are aligned on assemblies 41A and 43A. Also, as described above, faces 46A and 48A can be beveled along common right angle edge 32A-34A. Together, these create a wider path for movement of flexible section 62 between corners 32A and 34A, reducing wear on connector components, including flexible section 62. It will be apparent that the relevant components can be similarly adapted to create such a path for flexible section 62 between any two corners of unit 30A or 30B.

Magnets 52 are embedded into holes bored or otherwise created in inner surface 53A. Alternatively, holes can be created during manufacturing, such as being integrated into an injection mold of assembly 41A or face 42A. Magnets 52 are secured to assembly 41A by any number of means, including adhesive bonding. Alternatively, they can be secured by reducing the effective diameter of the hole after insertion of magnet 52, such as by adding a thermoplastic or rubber insert around the circumference to partially or completely enclose magnet 52.

As described above, magnet 52 proximate channel 80A serves dual purposes. Magnets 52 can hold large unit face 42A of unit 30A to a similarly sized face on an adjacent unit 30A or 30B. This adjacent unit can be the counterpart puzzle unit 30B linked by connector 60. The adjacent unit can also be one that is part of other colored puzzle blocks 24 or 28, or a part of an even larger solution. In certain embodiments, magnets 52 can also engage with fasteners on virtual puzzle blocks 40, examples of which are shown in FIGS. 9A-9G.

Magnet 52 also holds slider 70 at either end of channel 80, helping to retain connector 60 at selected corner 32A or 34A. Slider 70 is located in radial channel section 82 and moves along channel 80. One side of channel 80 is located proximate face 42A, while the other side is located proximate face 44A (not shown in FIG. 8D). As was seen in FIG. 7E, slider ends 72 can be metal and in the shape of a half sphere having a radius approximating that of embedded magnets 52. This permits slider 70 to engage a larger surface area of magnet 52 and enables retention of slider 70 near selected corner 42A or 44A. Alternatively, magnets 52 are not located proximate ends of channel 80. In these other alternative embodiments, slider ends 72 and channel sections 82 can include an interlocking or other mechanism to hold slider 70 in place until slider 70 is released by the player, such as by pressing a button.

Recall that unit assembly 41B, shown in FIG. 8C, is the geometric mirror image of unit assembly 41A shown in FIG. 8B, and thus includes the same relative arrangement of elements in mirror image format. It will therefore be apparent from the description that taking a mirror image view of unit assembly 41A as shown in FIG. 8D will yield the correct arrangement of elements in unit assembly 41B. It should also be noted that the structure of unit 30B can be built with two geometrically identical instances of unit assembly 41B oriented and engaged in the same manner as identical assemblies 41A and 43A. Therefore, the features and operation of unit assemblies 41B relative to each other and to connector 60 will be substantially identical to the description of assembly 41A.

FIG. 8E is a radial cross-section of slider 70 and slider channel 80 having channel sections 82 and axial connector path 86. This view of channel 80 is applicable to both units 30A and 30B and thus reference numbers do not include the 'A' or 'B' designation. Located within cylindrical channel 80 are portions of connector 60 including flexible portion 62 and slider 70. As described above, radial channel sections 82A engage axially to form channel 80 for slider 70. Channel 80 forms a substantially cylindrical shape along most of its radial and axial dimensions.

However, in certain embodiments, channel 80 does not include a full radius due to axial connector conduits 86. Connector conduits 86 provide an axial path along channel 80 for flexible portion 62 of connector 60 to move along with slider 70. In one example, each of the two radial channel sections 82 occupies about 170° of the circumferences of channel 80, leaving about 10° for each connector conduit 86. But given a flexible filament 62 with a sufficiently small diameter and/or made from a friction resistant material, each connector conduit 86 occupies between about 1° and about 5° of the circumference, allowing channel sections 82 to each be between about 175° and about 179°. In certain embodiments, each conduit 86 need only occupy less than about 1° of the radius, leaving between 179° and 180° for each channel section 82. Further, in some embodiments, edges of channel sections 82 defining the limits of connector conduit 86 can be rounded or beveled to prevent premature wearing or damage to connector 60.

As described above, with connector 60 repositionable between two corners of each unit 30A and 30B, there are four possible combinations of locations where connector 60 can be readily fixed in a single unit pair 30. This compares to a single version of blocks 24, 28, or 29 with a fixed connector. Linking units 30A and 30B into pairs makes the puzzle more challenging than separate units because it requires both units 30A and 30B be a part of the solution. This also improves the flexibility, challenge, and amusement provided by the puzzle because a greater variety of faces are available on blocks 24 and 28, and 29, seen in FIGS. 4-6. These potential variations lead to a larger number of possible challenges as compared to puzzle units with multiple connectors fixed to one corner. This in turn offers greater challenges and flexibility in creating and deciphering different puzzle solutions. It also enables and simplifies the creation of various color codes and corresponding puzzle sets described below.

Uniformity of faces and other components of units 30, including unit assemblies 41, 43, unit faces 46, 48, support members 54, 55, and channel 80, simplifies manufacturing by requiring a minimal number of distinct components. This reduces the number of dies or molds required. Uniformity also reduces tolerance between unit faces by ensuring dimensions closely track the example multiples of 6 described above. In more complex puzzle solutions, such as large hybrid cube 12, significant departure in dimensions can cause misalignment of unit pairs 30 and virtual blocks, leading to out-of-balance solutions.

The connection system is also resilient and adaptable. By incorporating the above features into the support assembly, space is also saved inside each puzzle unit, making them readily adaptable to include connector 60. Slider 70 and channel 80 facilitate a single movable link to reposition connector 60 within units 30A and 30B without detaching or disassembling the connector. Magnets 52 and metalized unit faces allow sets of different unit pairs 30 or blocks to be reconfigured into different geometries or color patterns without substantial effort and wear.

The unit faces are modular and interchangeable, allowing a player to readily disassemble and reassemble units to create his or her own puzzle codes and solutions. It also permits integration of certain embodiments of the unit connection system by providing room and stable connections for magnets 52 and other components of connector 60 in units 30A and 30B. The examples above describe adjacent units 30 as being held together by magnets 52 disposed within or proximate metalized faces 42, 44, 46, and 48. FIGS. 8A-8D depict large faces 42 and 44 as having two magnets 52 while FIGS. 7B and 7C show one magnet 52 embedded in faces 46 and 48. In certain embodiments, there can be a greater or lesser number of magnets 52, such as several small magnets 52 dispersed throughout each face. Metalized faces can be alternatively formed solely from metal or from a thermoplastic with a metal veneer. In one example, of each face is metalized. Metalization can be done by adding a metal sheet as described above either during or after fabrication. In other embodiments, the pieces can be fabricated primarily from metal and covered with a colored and/or protective thermoplastic.

Puzzle units can alternatively be held together in ways other than by magnets 52. This is determined in part by the composition of the material comprising units 30A and 30B. In one example, if unit faces are substantially formed from a flexible thermoplastic or other similar material, portions of faces and/or edges can include interlocking elements to secure puzzle units.

Other alternative structures include modifying puzzle unit pair 30 and connector 60 such that connector 60 is not limited to corners 32 and 34. In one alternative, slider 70 is a substantially spherical metal bearing on flexible section 62. Unit 30A and/or 30B then include at least two additional channels 80 to guide slider 70 to corners 36 and 38. Channels 80 can also include a substantially spherical transition area proximate one corner with one or more connector conduits to allow slider 70 to traverse channel 80 along at least three edges of unit 30A or 30B.

The geometry of puzzle unit pairs 30 and connector 60 all contribute to scalability and flexibility of the puzzle. In certain embodiments, larger or more complex puzzles can be held in place using one or more virtual puzzle blocks as support structures. In other embodiments, those support structures can also become part of the puzzle solution, such as was seen in FIGS. 1A and 1B. In yet other embodiments, a plurality of virtual puzzle blocks can be used in their own geometric solutions. Examples of virtual blocks are shown in FIGS. 9A-9G.

Virtual Puzzle Blocks

As described above, puzzle units 30A and 30B can be oriented into a wide variety of geometric shapes. And as will be described below, those puzzle unit pairs 30 can be marked with colors or designs according to a predetermined code such that those geometric shapes also have a color pattern when a user takes some or all of the unit pairs 30 in a set and correctly orients them into various color arrangements. In solving such puzzles, a user may want to solve a complex geometric challenge first, or may need additional structural support for a larger puzzle solution. Virtual puzzle blocks can be created to match those reference shapes and volumes, which are substantially geometrically equivalent to reference combinations of an integer quantity of at least one of each puzzle unit 30A and 30B. Virtual blocks have a continuous volume substantially geometrically equivalent to combinations of the above-described units 30.

Figure 9A:
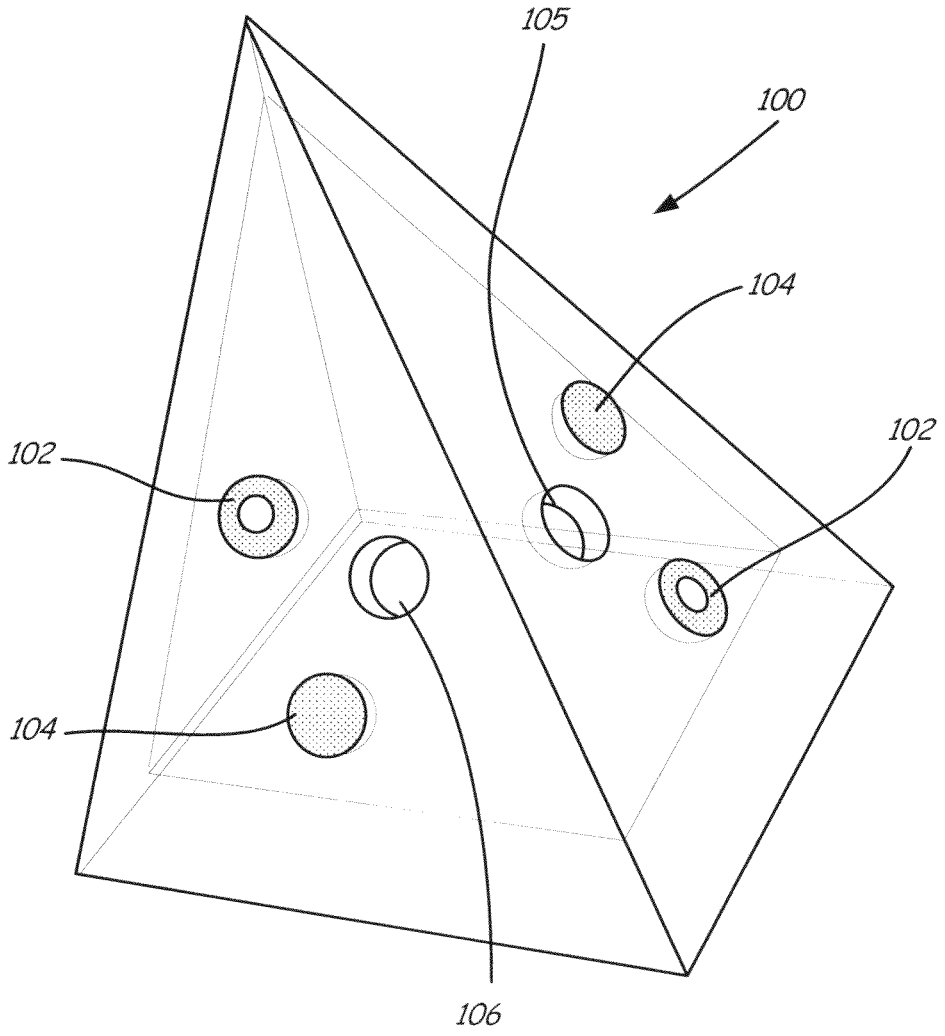
FIGS. 9A-9G schematically depict various examples of virtual puzzle blocks.

FIG. 9A shows one example embodiment, virtual block 100. With a plurality of fasteners, including metalized contacts 102 and magnets 104 as well as bores 105. Fasteners can be located in or proximate outer surfaces of the virtual block to align with potential locations for a corresponding magnet 102 or metalized surface 104 of another virtual puzzle block. Fasteners can also be located to align with magnets 52 and/or metalized colored unit faces In the examples shown in FIGS. 9A-9G, fasteners are adhesively bonded within several bores 105 made on outer surfaces of the various structures. However, in certain embodiments, fasteners can be held within bores 105 using other methods such as taking advantage of friction between the fastener and the outer surface by sizing metalized contacts 102 and magnets 104 to substantially match bores 105. In yet other embodiments, fasteners are only temporarily retained within bores 105 and can be removed and rearranged. More bores can be made in virtual blocks to include additional fasteners or introduce an element of misdirection.

The exact number and distribution of fasteners in a virtual puzzle block is determined according to the number and orientation of potential virtual and hybrid puzzle solutions available in a given puzzle set. In many cases, such as in block 100 as well as the following examples, virtual puzzle blocks will include at least one, and potentially several additional bores due to the large number of possible combinations of units 30 and virtual puzzle blocks. Magnets 104 and metalized surfaces 102 of virtual blocks can alternatively be distributed in a pattern on the outer surfaces such that they engage only when oriented into a correct predetermined puzzle solution.

As can be seen in FIG. 9A, virtual block 100 represents the shape of puzzle unit pair 30 arranged into square base block 24. Virtual block 100 can be used as a geometric substitute or structural support for block 24. For example, as described above large hybrid cube 12 in FIGS. 1A and 1B includes several small hybrid cubes 23 at the middle of each of its twelve major edges 18. Each small hybrid cube 23 includes two colored puzzle unit pairs 30 configured to two colored blocks 24, and one small puzzle block 100, the three blocks then oriented in the manner shown in FIGS. 2A-2B.

Figure 9B:
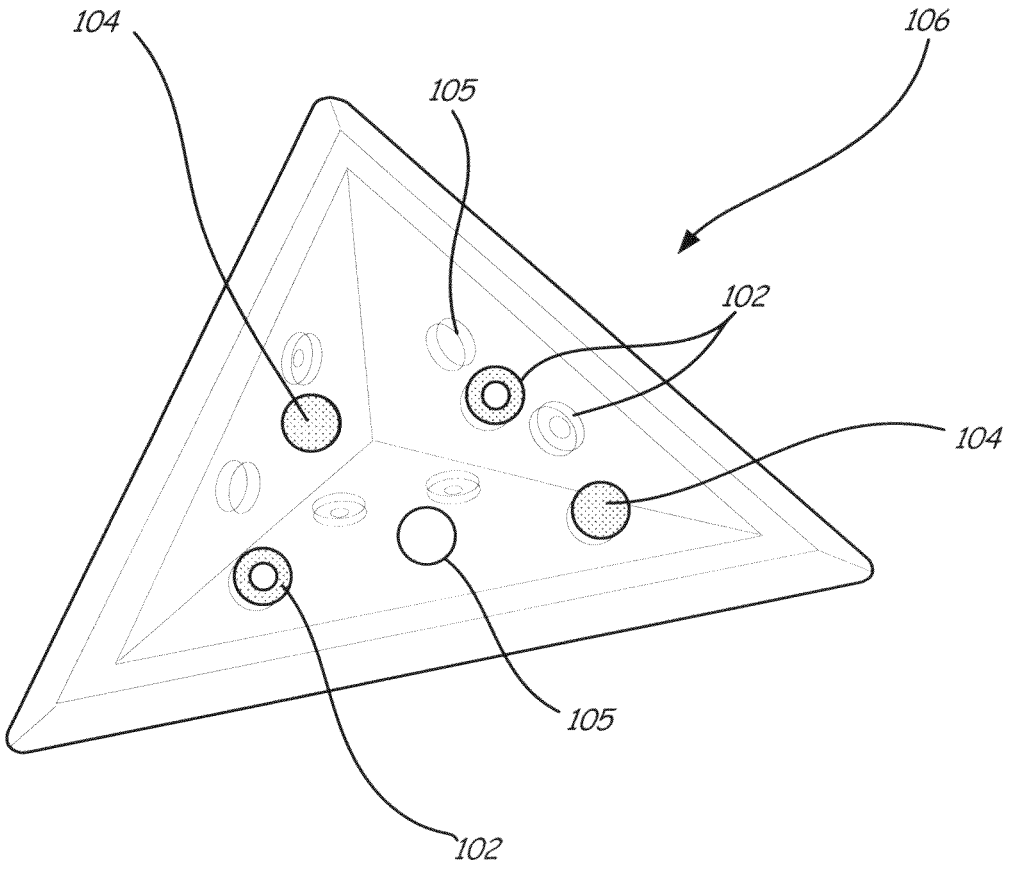

In FIG. 9B, virtual block 106 also represents puzzle unit pair 30 with one unit 30A and one mirror image unit 30B. Here, the reference units are configured into colored block 28. Similar to virtual block 100, virtual block 106 can be a geometric substitute for one or more blocks 28, such as by taking the place of one or more blocks 28 in pyramid 26 from FIG. 2D.

Figure 9C:
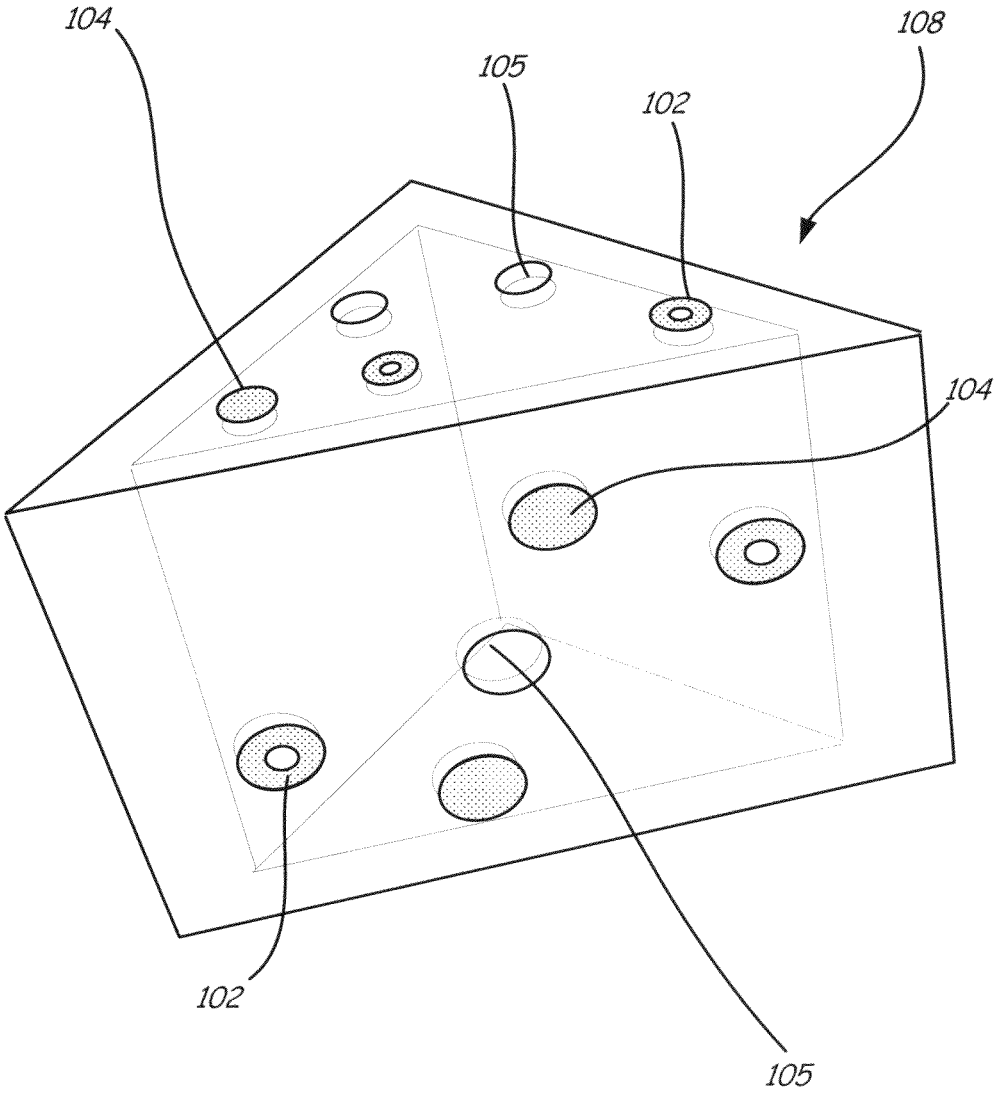

FIG. 9C shows virtual puzzle block 108. As seen in Table 1 below, block 108 represents a total of three puzzle units 30, at least one of which is unit 30A and at least one of which is unit 30B. Another way of describing virtual block 108 is that it represents cube 22 cut in half along a diagonal of two opposing cube surfaces. It can also be described as geometrically representing the volume of either puzzle block 24 with an additional single unit 30A or 30B aligned along one large unit face. For example, block 24 has two outer surfaces visible at the front of FIGS. 4A-4D with dimensions defined by a large unit face (42 or 44) from each of units 30A and 30B. One of these surfaces can be placed flush against a large unit face (42 or 44) of a third puzzle unit 30A or 30B to create the shape represented by block 108.

Figure 9D:
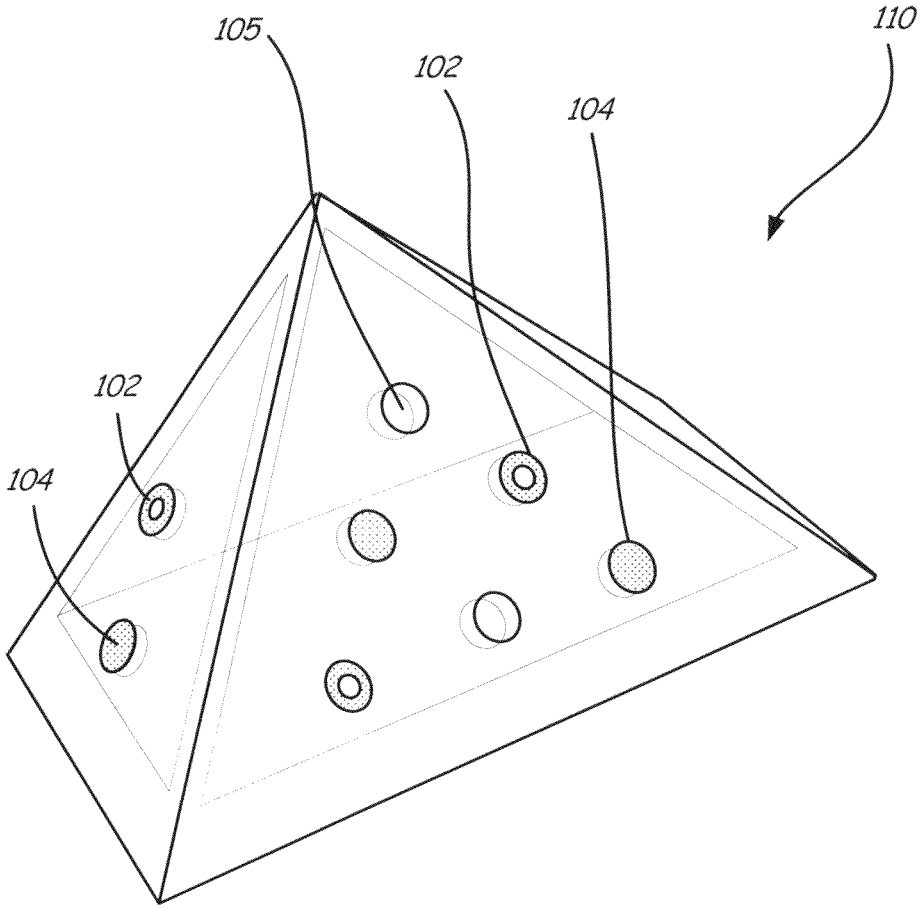

FIG. 9D shows virtual block 110. As seen in Table 1, block 110 represents a total of four puzzle units, two each of unit 30A and unit 30B. Another way of describing virtual block 110 is that it represents the volume of two puzzle blocks 24 arranged into the shape of half of pyramid 26. The equivalent structure with puzzle units 30A and 30B can be readily seen as a closed block 28 from FIGS. 5A-5D inserted between the gap of block 24' in FIG. 2E.

Figure 9E:
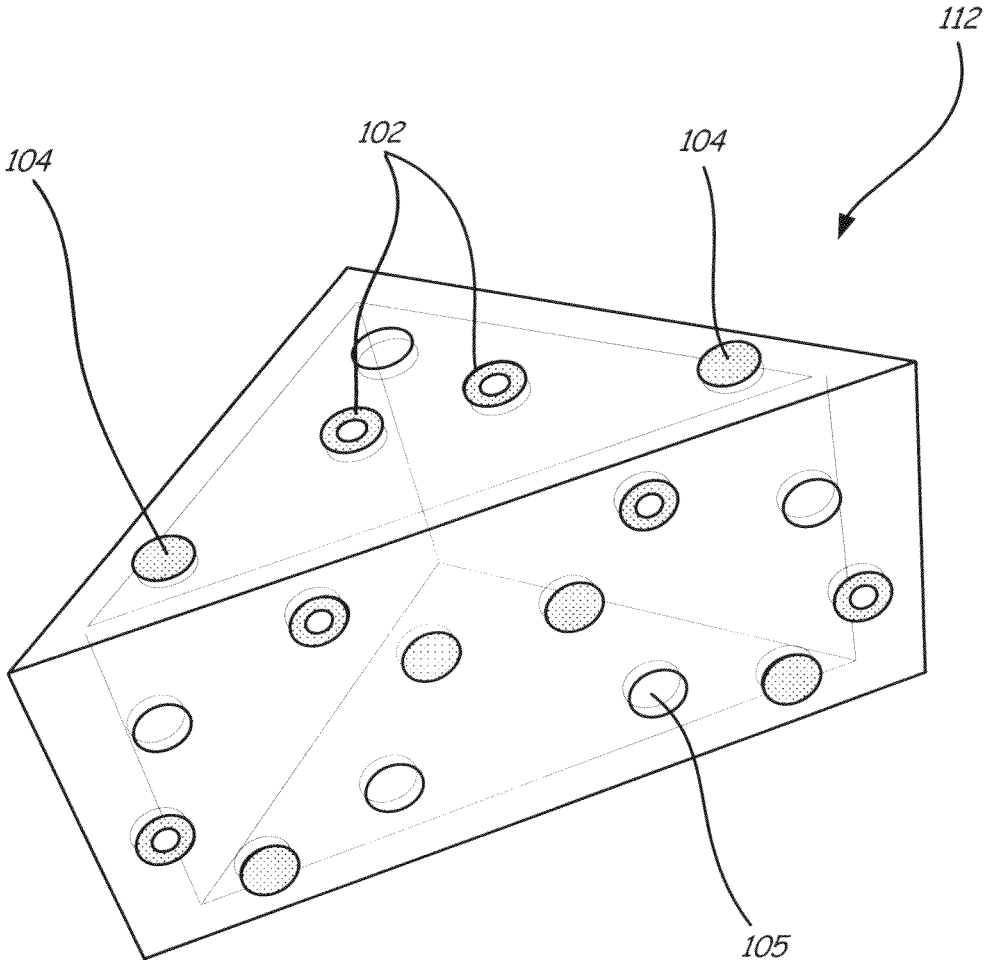

FIG. 9E shows virtual block 112. As seen in Table 1, block 112 represents a total of six puzzle units, three each of unit 30A and unit 30B. Another way of describing virtual block 112 is that it represents two puzzle blocks 24 and one block 28 arranged into a triangular solid. The structure is equivalent to rotating virtual block 110 such that the large triangular outer surface visible at the front of FIG. 9D is flush against the corresponding large triangular surface of block 106 in FIG. 9B.

Figure 9F:
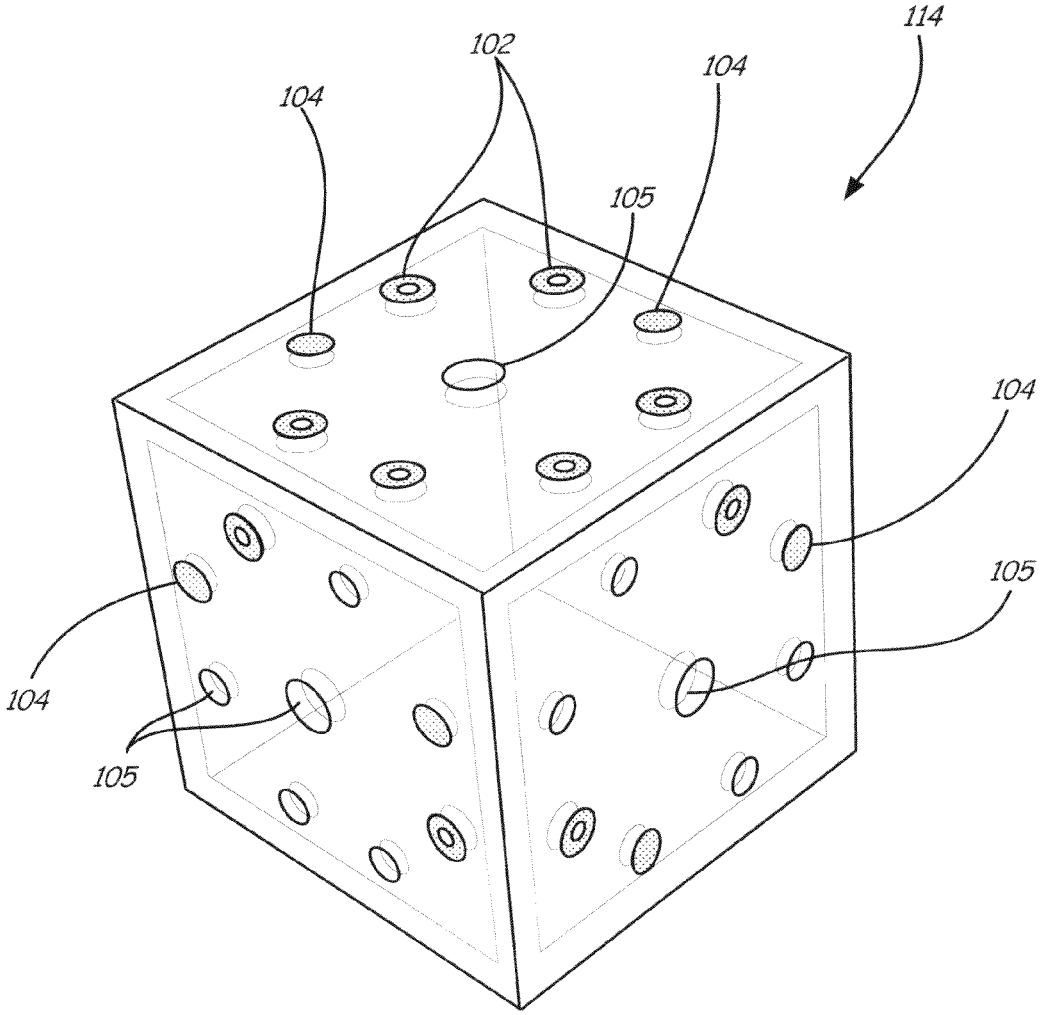

FIG. 9F shows virtual small cube 114. As seen in Table 1, virtual small cube 114 represents a total of six puzzle units, three each of units 30A and unit 30B. Unlike virtual block 112, virtual small cube 114 represents a total of three puzzle blocks 24. Virtual small cube 114 is identical in shape and volume to small cube 22. An example construction of small colored cube from three blocks 24 is shown in FIGS. 2A and 2B.

Figure 9G:
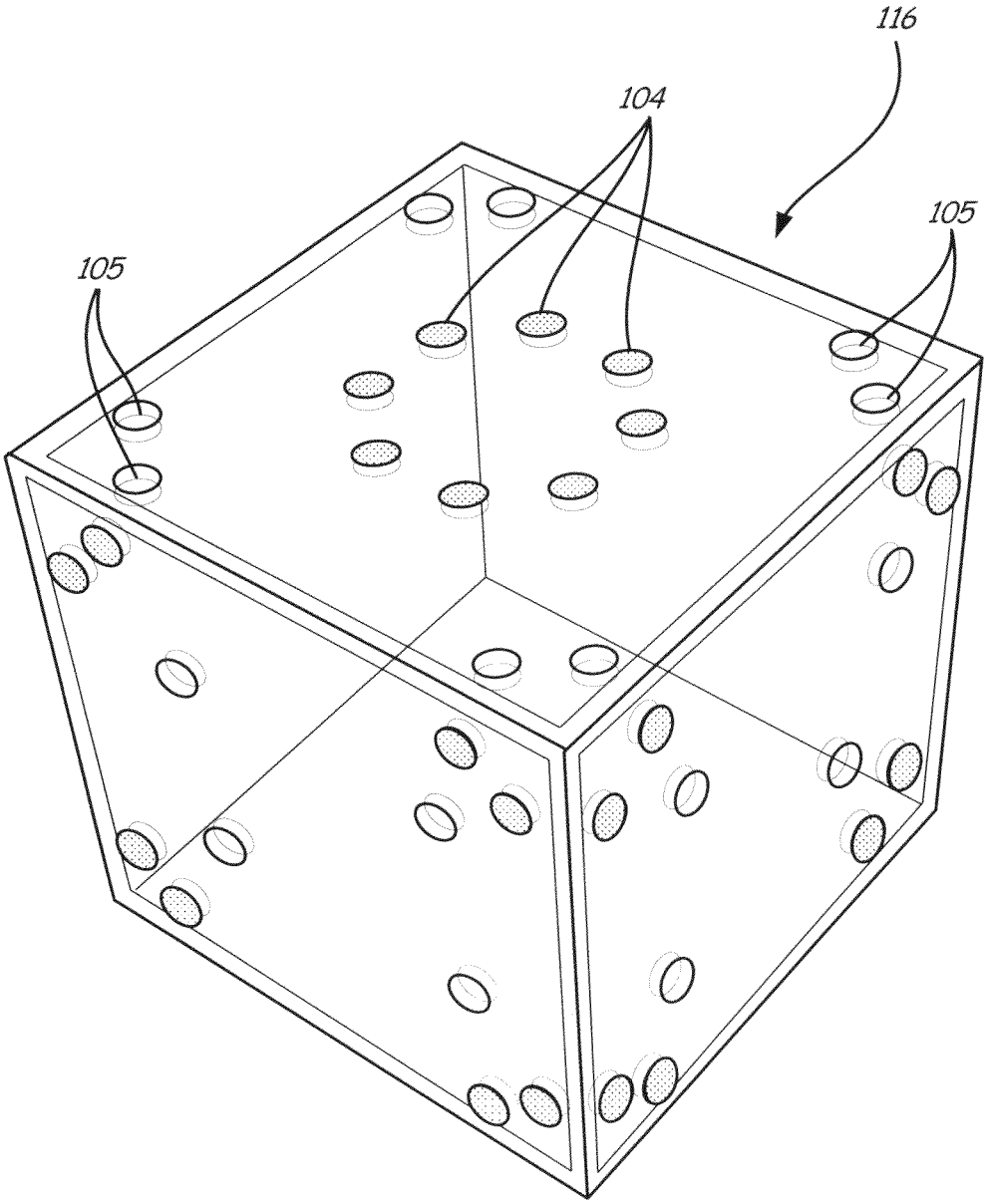

FIG. 9G shows virtual large cube 116, which is identical in shape to a cube having sides with lengths of 2*L. As seen in Table 1, virtual block 116 can replace twenty-four puzzle unit pairs 30. Its shape and volume is also equivalent to a total of eight smaller cubes, such as cubes 22 from FIG. 2A and virtual small cubes 114. An example of this cube built using colored puzzle units 30A and 30B can be seen later in FIGS. 13A-13B as cube 130.

As noted above, there may be additional bores 105 to provide room for fasteners for multiple solutions. Additional bores 105 can also introduce an element of misdirection, particularly when the fasteners can be removed and replaced in different bores 105 as part of the puzzle challenge. Bores 105 can also be arranged in a grid or concentric circle patterns, such as example unit 114 in FIG. 9F. In certain embodiments, such as on example virtual large cube 116 in FIG. 9G, only magnets 104 are present in bores 105. In alternative embodiments, virtual blocks include only metalized pieces 102. Alternatives to magnets 104 and metalized surfaces 102 are also possible. Examples include thermoplastic pins and apertures as described above, or interlocking hook and loop fasteners, sold commercially as Velcro™ and other trade names.

Virtual blocks can be built from any relatively low cost material. One material includes as sheets of molded plastic cut into shapes of the outer surfaces and bonded along each edge such that the blocks are hollow in the center, taking advantage of its durability, low cost, and ease of manufacture. A harder material provides heavier and more durable virtual blocks, offering sufficient structural support for various large scale hybrid and virtual blocks. In one example, virtual blocks are made from a hard polyacrylate material. In such embodiments, the weight of such a material can be reduced by introducing additional bores 105 to reduce the total volume of material. It will also be recognized that a virtual puzzle block can alternatively be a plurality of puzzle units 30A and 30B permanently bonded together at one or more unit faces.

Virtual puzzle blocks can have several functions when used in conjunction with unit pairs 30. For example, virtual blocks can be used as a support structure or space filler. With a proper arrangement of magnets 104 and metal contacts 102, a virtual block can fill an otherwise hollow space beneath supporting groups of colored puzzle units 30, to build large scale hybrid solutions. For example, cube 116 can be used in place of cube 130 in FIGS. 13A and 13B as support in the center of 12-surface puzzle solution 150 shown below in FIGS. 15A and 15B.

Referring back to FIGS. 1A and 1B, large hybrid cube 12 is the equivalent of eighty-one blocks 24 (27 cubes*3 blocks per cube). However, as will be seen later, a full set of puzzle unit pairs 30 built according to example Color Code 1 can only have forty-eight possible blocks 24. The remaining equivalent of thirty-three blocks 24 can come from a combination of virtual blocks 100 and 114. Twenty-four of the blocks 24 define the eight small cubes 22 of side length L at each major corner 16, and the other twenty-four small square-base blocks 24 are arranged with twelve virtual blocks 100 into twelve hybrid cubes as described above. Seven virtual cubes 114 of side length L provide the remaining volume of large hybrid cube 12. Six of these are disposed at the center of the six major faces 14 and a seventh virtual cube 114 is at the center of the cube itself (not visible in FIGS. 1A and 1B).

Virtual puzzle blocks are also useful in planning complex solutions involving a large number of puzzle unit pairs 30. With a set of virtual blocks, a user can first solve the geometric challenge. The player can determine which puzzle unit pairs 30 are required to be configured into the appropriate blocks (e.g., blocks 24, 28) with the appropriate color patterns to solve the color challenge. Since they geometrically represent many combinations of puzzle units 30A and 30B, multiple instances of one or more types of virtual puzzle blocks can be combined to form larger support structures or into their own group of virtual solutions.

TABLE 1

Example Set of Virtual Puzzle Blocks

| Virtual Solution | Number of Unit 30A | Number of Unit 30B | Total Number of Units 30 | Total Number in an Example Set | Units 30 Represented |
|---|---|---|---|---|---|
| 100 | 1 | 1 | 2 | 12 | 24 |
| 106 | 1 | 1 | 2 | 4 | 8 |
| 108 | 1 or 2 | 1 or 2 | 3 | 16 | 48 |
| 110 | 2 | 2 | 4 | 4 | 16 |
| 112 | 3 | 3 | 6 | 4 | 24 |
| 114 | 3 | 3 | 6 | 8 | 48 |
| 116 | 24 | 24 | 48 | 1 | 48 |
| Total | | | | 49 | 216 |

Virtual puzzle blocks can also be grouped into a set that corresponds to various solutions using different combinations of units 30. Table 1 summarizes one such example set with the quantity of puzzle units 30A and 30B represented by each block, as well as the total number of equivalent units 30 represented by virtual puzzle blocks in the example set. Virtual blocks can be selected, such as from the example set in Table 1, and oriented into solutions without colored puzzle units 30A or 30B.

Figure 9H:
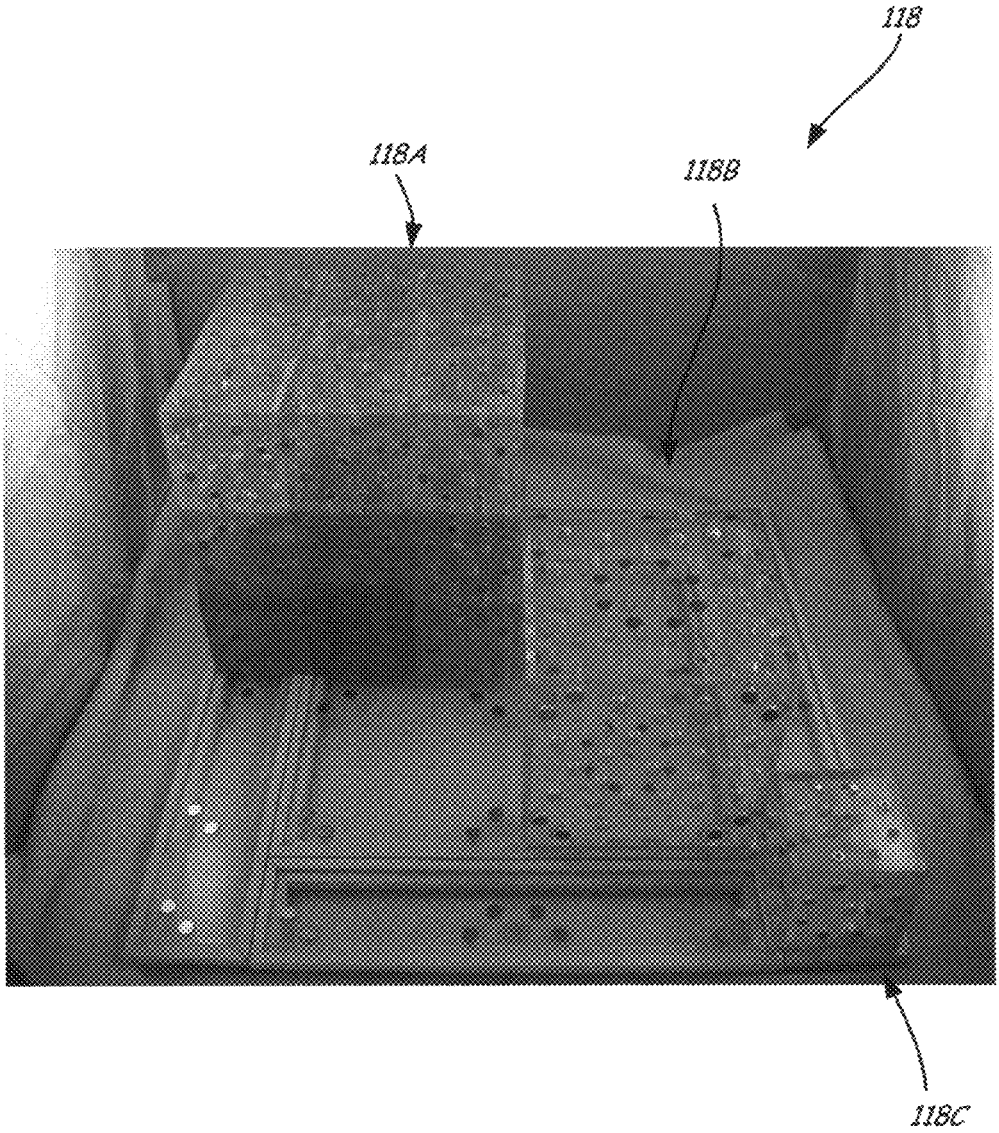
FIG. 9H is a photograph of an example set of virtual puzzle blocks oriented into a virtual puzzle solution, which includes three cubes of different sizes.

FIG. 9H illustrates an example of the set of virtual blocks arranged into cube family 118. The largest cube 118A has sides of length 3*L, the next largest cube 118B has sides of length 2*L, and the smallest cube 118C has sides of length L. It should be apparent from the description and from Table 1 that cube 118C is equivalent to six units, three each of units 30A and 30B. Cube 118B, having twice the dimensions as cube 118C, therefore requires eight times the number of equivalents, for a total of forty-eight. Finally, cube 118A, having triple the dimensions as cube 118C, requires (27*6) or 162 tetrahedral equivalents. Together, cubes 118A, 118B, and 118C total 216 tetrahedral unit equivalents, equal to the set of virtual blocks shown in Table 1. These 49 blocks can be used for other shapes as well. For example, a virtual version of hybrid pyramid 160 (in FIGS. 16A-16B) can be built using a complete virtual set.

The description has focused on geometric aspects of the puzzle, including the structure of interchangeable and modular units 30A and 30B, linking the units into pairs with connector 60, arranging the units into blocks and the blocks into basic solutions, as well as various embodiments of virtual puzzle blocks. The remainder will describe how color can also be integrated into the puzzle game by adding colors to one or more faces of puzzle unit pairs 30.

Puzzle Faces Including Example Color Codes and Solutions

The following FIGS. 10-19 are color photographs of example solutions using combinations of the above described puzzle components. Each example solution includes a plurality of paired units 30A and 30B, faces of which are marked according to two different examples of predefined Color Codes, listed in Tables 2-4. Unless otherwise noted, each pair of photographs (e.g., FIGS. 10A and 10B) depict respective front and rear views of the example solution. In such photographs, each individual structure in a photograph is rotated 180° around a vertical axis so that it is in the same position as in its counterpart figure, (e.g., respective front and rear views of cube 122.1 are at the top left corner of both FIGS. 10A and 10B). It will be apparent that such solutions can be made using other predetermined color codes as well.

Example Color Code 1

Faces of units 30A and 30B can include a plurality of distinct colors or designs, referred to as a color code. For simplicity and by manner of example only, the following example color codes include six distinct colors or designs in a set. To further simplify the description, the following examples use a basic rainbow color progression of white (W), red (R), orange (O), yellow (Y), green (G) and blue (B). This rainbow progression is one helpful clue and factor in creating color codes and solving corresponding puzzle challenges utilizing these color codes. It will be apparent that other colors or features can be added, deleted, or substituted for one or more colors such that the total number need not equal six.

One example system using the above six colors is Color Code 1, having a total of 96 three-dimensional units 30A and 30B. In certain embodiments, Color Code 1 can be divided into four subsets each having twelve unit pairs 30A and 30B. In these embodiments, Subset I includes a total of twelve unit pairs marked according to Table 2. Table 2 also indicates which basic solutions can be built with a given unit pair 30. Table 2 is split into two major columns, one for unit 30A and one for unit 30B. Units 30A and 30B are paired together across each row, and linked typically by connector 60. Other columns (Cube ID and Pyramid ID) are explained further with respect to certain example puzzle solutions shown and described in more detail below with respect to FIGS. 10A-10B and 12A-12B.

TABLE 2

Color Code 1, Subset I - Pairing of Mirror Image Puzzle Units
Color Code 1 - Subset I

| | | | Face ID | | | |
|---|---|---|---|---|---|---|
| Unit ID | Cube ID | Pyramid ID | 42 α | 44 β | 46 γ | 48 δ |
| Unit 30A | | | | | | |
| A1 I | 1 | X | Y | G | W | B |
| A2 I | 2 | X | W | R | B | G |
| A3 I | 3 | X | R | B | Y | G |
| A4 I | 4 | X | O | Y | G | B |
| A5 I | 1 | Y | R | O | G | Y |
| A6 I | 2 | Y | G | B | Y | O |
| A7 I | 3 | Y | Y | B | O | R |
| A8 I | 4 | Y | W | R | O | Y |

TABLE 2-continued

Color Code 1, Subset I - Pairing of Mirror Image Puzzle Units
Color Code 1 - Subset I

| | | | Face ID | | | |
|---|---|---|---|---|---|---|
| Unit ID | Cube ID | Pyramid ID | 42 α | 44 β | 46 γ | 48 δ |
| A9 I | 1 | Z | W | B | R | O |
| A10 I | 2 | Z | O | Y | R | W |
| A11 I | 3 | Z | R | Y | W | B |
| A12 I | 4 | Z | G | B | W | R |
| Unit 30B | | | | | | |
| B1 I | 1 | X | W | R | B | G |
| B2 I | 2 | X | Y | G | W | B |
| B3 I | 3 | X | O | Y | G | B |
| B4 I | 4 | X | R | B | Y | G |
| B5 I | 1 | Y | G | B | Y | O |
| B6 I | 2 | Y | R | O | G | Y |
| B7 I | 3 | Y | W | R | O | Y |
| B8 I | 4 | Y | Y | B | O | R |
| B9 I | 1 | Z | O | Y | R | W |
| B10 I | 2 | Z | W | B | R | O |
| B11 I | 3 | Z | G | B | W | R |
| B12 I | 4 | Z | R | Y | W | B |

The listed units can be numbered in any order, but are numbered in the order above for convenience according to their use in these particular basic solutions. In certain embodiments with interchangeable units 30A and 30B, these unit and face identifications can be included on an inner surface of the components to facilitate re-creation of the original set. Alternatively, a version of the corresponding table(s) is included with the set(s).

To differentiate the faces on each of the puzzle units in the subset while retaining consistent descriptions, each face of each unit 30A and 30B requires a uniform nomenclature. The first unit 30A in each example Color Code (Unit ID) is designated A1, while the unit paired to A1 is designated as B1. Successive unit identification in Tables 2 and 3 refers to subsequent units in the set (e.g., units A2 and B2 are the second pair of units in the subset). The subset number (here, Subset I) is then appended to the unit ID.

Referring to FIG. 3, each unit 30A and 30B has four faces (42, 44, 46, and 48). The Face ID columns in Table 2 above identify the four faces of the tetrahedral puzzle units according to a convention of Greek letters corresponding to their reference numbers. In this case, faces 42A and 42B are faces α. Faces 44A and 44B are faces β. Faces 46A and 46B are γ, while faces 48A and 48B are listed as δ. Thus when referring to the color of a particular face on a particular unit 30 in the example color codes, the identification of a particular face is appended to the unit identification. For example, the color of face A5α is determined by referring to Table 2. In this case, face A5α is listed under the column for face α in the table as red (R). In another example, face 48B (δ) on unit B7 is called B7δ, which is colored yellow (Y).

It can be seen in Table 2 that in example Color Code 1, each unit 30A having a first color progression, also has a corresponding unit 30B in the same subset with a mirror image color progression. This can be seen by looking at the mirror image unit for an adjacent unit pair. For example, unit A1 in Subset I has a color progression of YGWB. Unit B2 also has a color progression of YGWB. Similarly, the color progression of unit A2 is the same as B1 (WRBG). This pattern of alternating mirror image pairs holds true throughout certain predetermined Color Codes, such as Color Code 1. This color symmetry, is one factor in the wide variety of possible solutions, can helping a player determine the correct configuration of puzzle unit pair 30 into various blocks. It can also generally help a player or designer define new color codes by exploiting the relationship as one criterion of a new code.

Figure 10A:
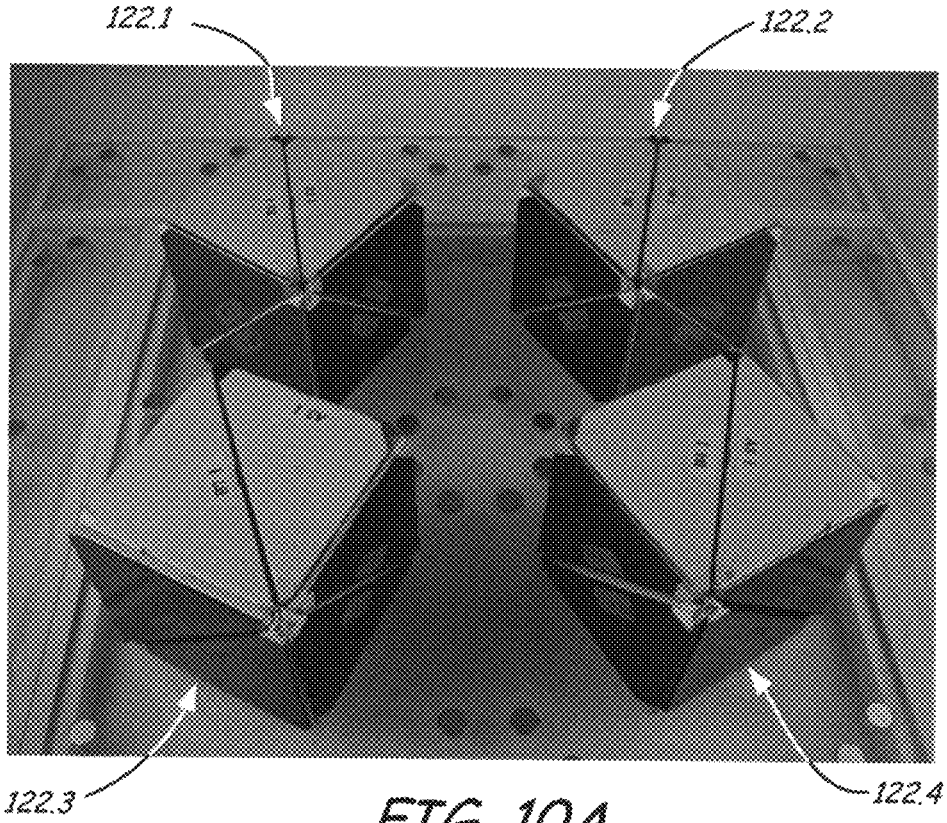
FIGS. 10A-10B are front and rear color photographs of four cubes having a single color on each surface, an example puzzle solution built using a single subset of Color Code 1.
Figure 10B:
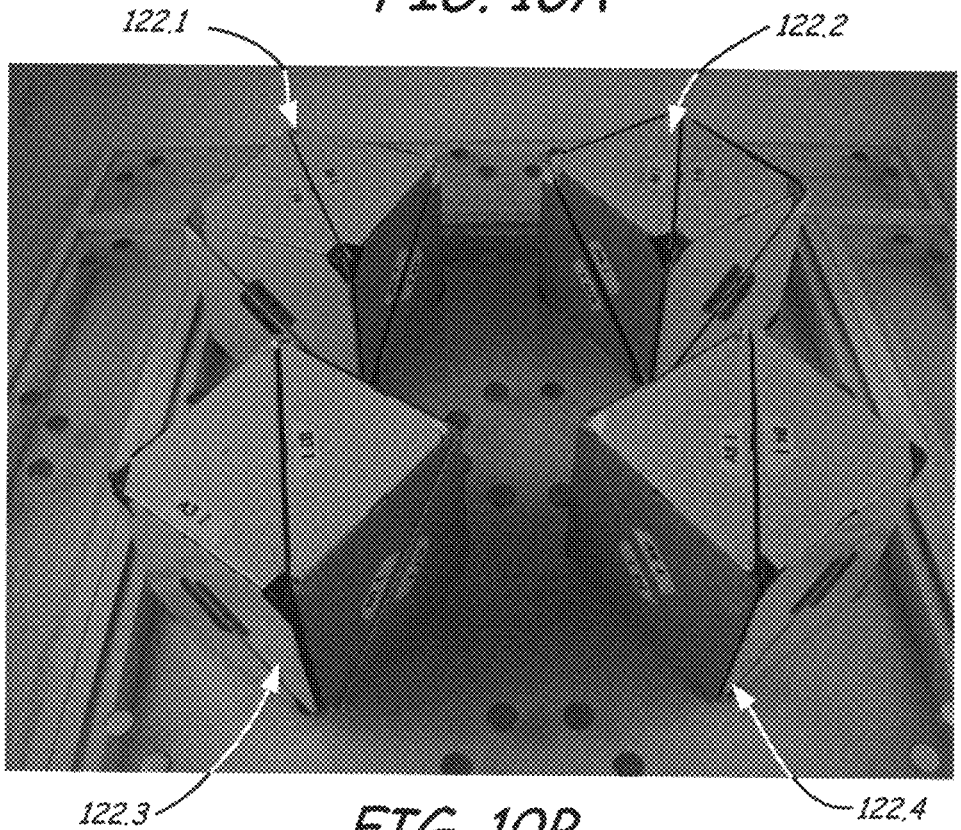

The remaining columns in Table 2 identify certain example solutions. One example, shown in FIG. 10A, is a front view of four small cubes 122.1, 122.2, 122.3, and 122.4 built from Subset I. FIG. 10B shows opposing sides of the same cubes. Cubes 122.1 and 122.3 are coordinated with identical color arrangements, which include a single color unique to each of the six surfaces. Cubes 122.2 and 122.4 also have identical color arrangements. These two pairs of identical color arrangements are further coordinated as mirror images of each other.

As seen in FIGS. 2A-2B, square base 50 of each block 24 defines one outer surface of cube 22. To build cube 22 with a single color on each face, square base 50 must itself be a single color. Recall from FIGS. 4A-4D that square base 50 is defined by one small face from unit 30A and one small face from counterpart unit 30B. Also note that the particular small face (46 or 48) on each unit that defines base 50 is determined by the position of connector 60.

In Table 2, the number listed under the Cube ID column corresponds to the subscript of the particular cube 122 (e.g., cube 122.1 is formed from units A1, B1, A5, B5, A9, and B9.) Therefore, to form cube 122.1, units A1, B1, A5, B5, A9, and B9 are first arranged into blocks 24 with square bases 50, each base 50 having a single color. Starting with units A1 and B1, there are four small faces (A1γ, A1δ, B1γ, B1δ) between them, and only one common color among them. Faces A1δ and B1γ are both blue, and therefore will define square base 50 of the first puzzle block 24. The first colored block 24 can be formed with a blue square base 50 by ensuring that faces A1δ and B1γ, corresponding to general reference numbers 48A and 46B, are on the bottom of block 24. This arrangement corresponds to FIG. 4C, where units A1 (30A) and B1 (30B) are linked by connector 60 at corners 32A and 34B.

The remaining two blocks 24, are configurations of unit pairs A5/B5 and A9/B9. Units A5 and B5 have common small faces that are yellow (A5δ and B5γ). These faces also happen to correspond to FIG. 4C where connector 60 is located at corners 32A and 34B. Unit pair A9/B9 has common small red faces (A9γ and B9γ). This version of block 24 corresponds to FIG. 4B, where connector 60 is at corners 34A and 34B. As will be apparent from FIGS. 2A and 2B, the other six small faces will join together to form the remaining outer white, orange, and green surfaces of cube 122.1. It will also be clear that the remaining cubes 122.2, 122.3, and 122.4 can be made using a similar approach. As will be described below, variations on cubes 122 with a single color unique to each surface can be made with other predetermined codes, including the other subsets of Color Code 1 as well as a Color Code 2 set.

Figure 11A:
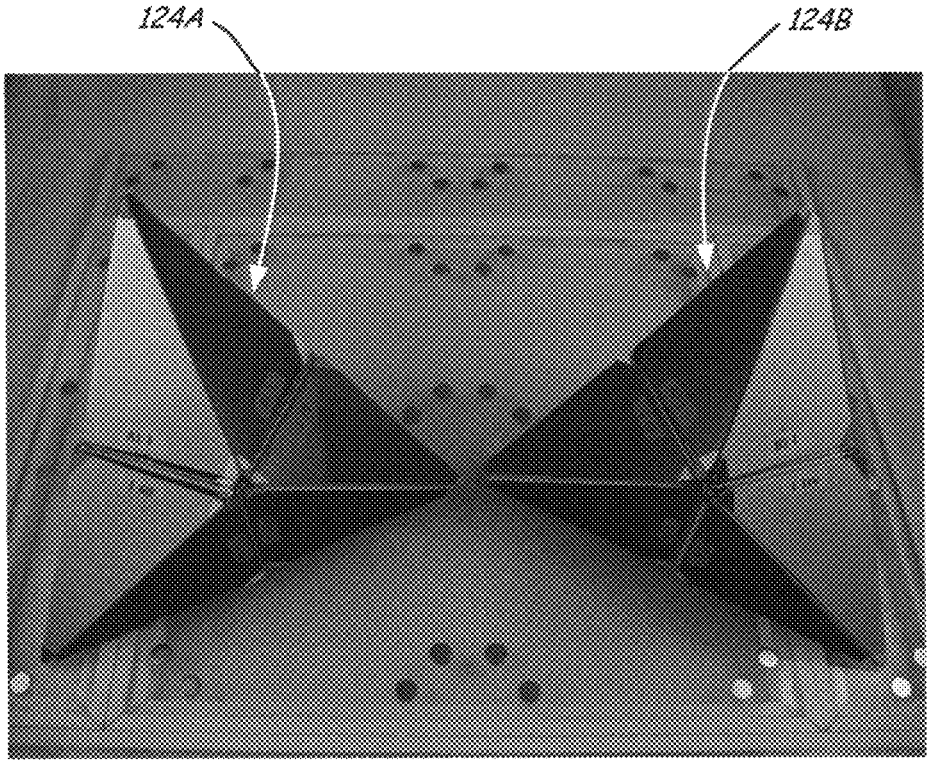
FIGS. 11A-11B are front and rear color photographs of two six-surface diamond structures, an example puzzle solution built using a single subset of Color Code 1.
Figure 11B:
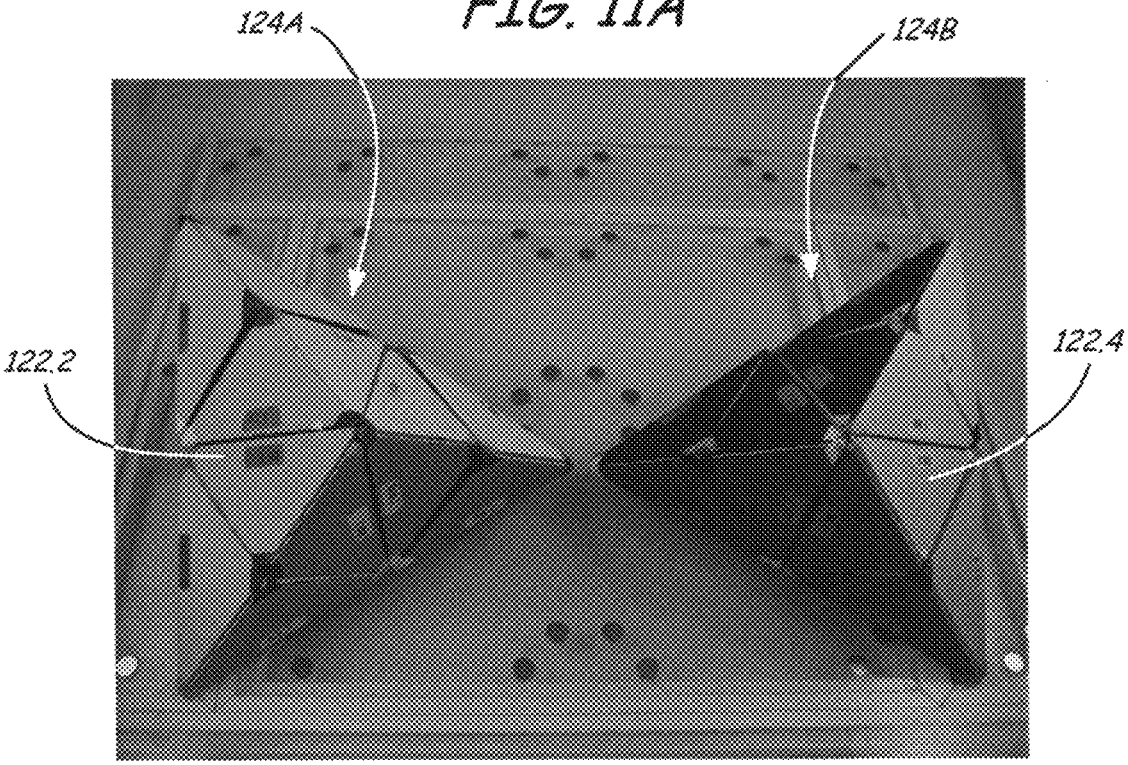

In addition to the set of cubes described above, units 30 in Subset I can be arranged into other groups of geometrically identical shapes, several of which also include coordinated color arrangements. One example shape is shown in FIGS. 11A and 11B with diamonds 124A and 124B. Their color arrangements include the same three colors (red, yellow, blue) unique to each of three upper surfaces on both diamonds 124A and 124B.

Diamonds 124A and 124B can be created by orienting six colored blocks 24. In one example, diamonds 124A and 12413 can also be formed by rearranging components of one small cube onto another small cube 22. Diamonds 124 each begin with a completed small cube 22 having a single color on each face. Three colored blocks 24 are placed on cube 22, with square bases 50 against a square face of cube 22. Blocks 24 are arranged so that the top of each block 24, opposite square base 50, defines an outer corner. Tops of diamonds 124 are defined by front corners of blocks 24 (e.g. corners 36A, 36B in FIG. 4A) aligning at a corner of cube 22.

To integrate these coordinated color arrangements between the two diamonds 124A and 124B, cube 122.2, having a single color on each face as shown in FIGS. 10A-10B, is used in place of cube 22. Blocks 24 are selected from cube 122.1 such that the six large faces at the front of selected blocks 24 (e.g. faces α and/or β) have a total of three colors. These colors are arranged so that when square base 50 of each block 24 is in place on cube 122.2, the visible large face from unit 30A is the same color as the visible face for unit 30B on the adjacent unit and vice versa. For example, diamond 124A includes red, yellow, and blue faces around the top. Diamond 124B is made in a similar manner, with cube 122.3 broken up into constituent blocks 24 and arranged on the outside of the foundation, cube 122.4, the foundation of diamond 124B. Like cubes 122, other predetermined color code sets, including the remaining subsets of Color Code 1 can include challenges to build variations on diamonds 124 with three colors unique to three upper surfaces. A nine-block Color Code 2 set is sufficient to build one such diamond 124.

Figure 12A:
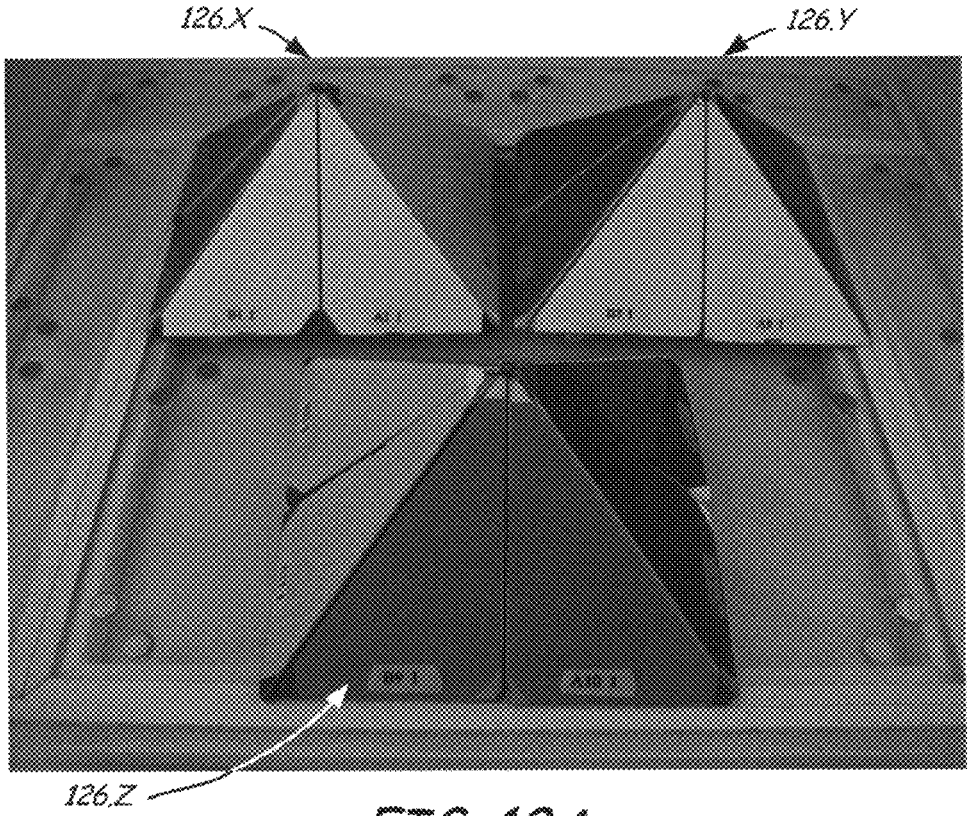
FIGS. 12A-12B are front and rear color photographs of three solid square-base pyramids, an example puzzle solution built using a single subset of Color Code 1.
Figure 12B:
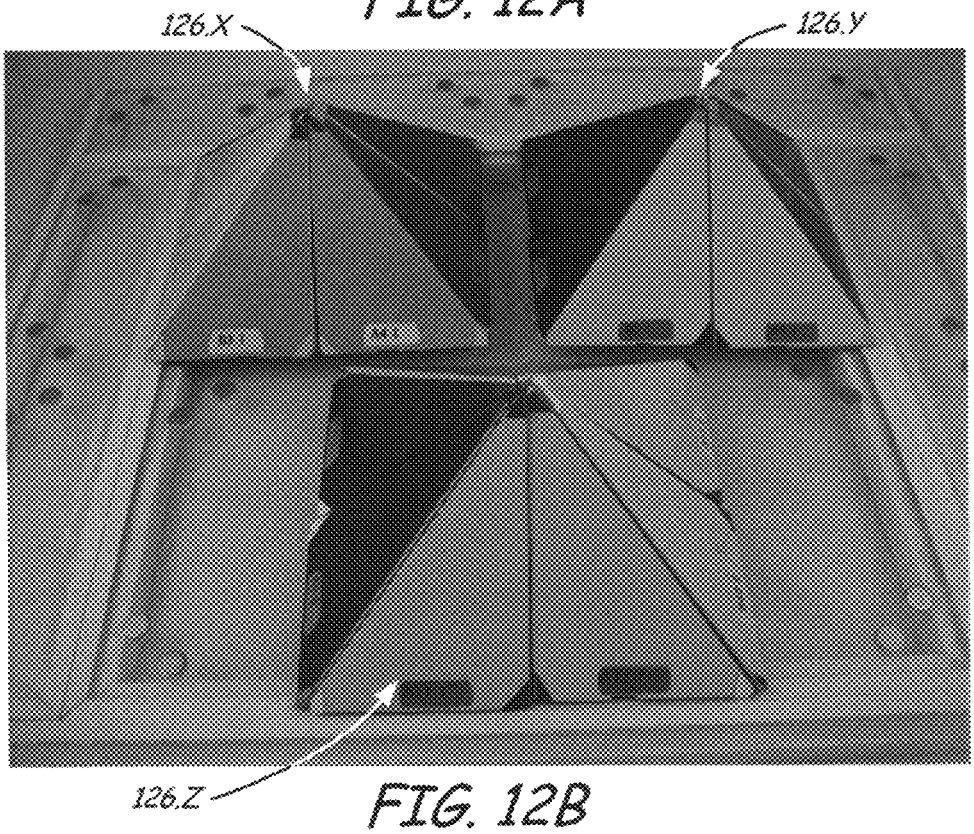

Subset I also forms other intermediate solutions including a plurality of pyramids 126. FIGS. 12A and 12B respectively show front and rear views of three pyramids 126.X, 126.Y, and 126.Z. Subscripts (X, Y, and Z) correspond to the Pyramid ID column in Table 2. Like many other solutions, pyramids 126 are embodiments of pyramids 26 with basic coordination of their color arrangements on the outer surfaces. In this particular solution, the color arrangements are coordinated such that each pyramid 126.X, 126.Y, and 126.Z has a two-colored base while each side surface includes only one of the remaining four colors in the set.

Analogous to cubes 122, pyramids 126 are a combination of a plurality of colored blocks 28 as shown in FIGS. 2C and 2D. As seen in these figures, a total of four units 30A and four units 30B are arranged such that the large surface at the front of colored blocks 28 and 29 (See FIGS. 5A-5D and 6A-6D respectively) defines a side surface of pyramid 26. As seen in FIGS. 12A and 12B (at the upper left hand corner), pyramid 126.X has four side surfaces with a clockwise color progression of WROY. Indicators similar to indicators 49 in FIG. 3, at the top of pyramid 126.X reveal the base includes blue and green sections separated along a diagonal.

Table 2 can offer insight into configuration of unit pairs 30 into correct blocks 28. Table 2 shows units A1-A4 and B1-B4 from Subset I are used in pyramid 126.X. Triangle bases 51 on each block 28 will be blue and green to match a blue and green base of pyramid 126.X. Table 2 shows that unit pairs A1/B1 and A3/B3 each have between them a blue small unit face and a green small unit face (γ or δ). Unit pairs A1/B1 and A3/B3 are configured into two blocks 28 as seen in FIG. 5C, with connector 60 at corners 32A and 34B. These cause faces A1δ/B1γ and A3δ/B3γ to form blue and green bases 51. Similarly, small faces on unit pairs A2/B2 and A4/B4 are configured into blocks 28 with blue and green bases 51, as shown in FIG. 5D.

However, when the blocks 28 are all in a closed configuration as described in the previous paragraph, each side surface has two colors instead of one. For example, the two side surfaces defined by unit pairs A1/B1 and A2/B2 would each be yellow and white. Each of the other two side surfaces (from units A3/B3 and A4/B4) each include both red and orange. The base of pyramid 126.X would also appear as four alternating squares instead of the two correct contiguous blue and green triangles.

To solve the challenge correctly, some blocks 28 must therefore be in an open configuration like block 28' in FIG. 2F. As described above, units A1 and B2 have mirror image color progressions (YGWB), as do units A2 and B1 (WRBG). Similarly, units A3 and B4, as well as units A4 and B3 have mirror image color patterns. By configuring unit pairs into two blocks 24 and two blocks 28', this mirror image relationship can be exploited to solve the puzzle.

By arranging unit pairs A1/B1 into an open block 28', closed block 24 made from unit pairs A2/B2 can be placed into the space between the respective open blocks as described above, and defining a half pyramid with solid yellow and white side surfaces. With pair A3/B3 also configured into block 28' and pair A4/B4 forming block 24, the second half of pyramid 126.X is completed with red and orange side surfaces. It will be apparent that the remaining unit pairs in Subset I can be configured in a similar manner to build pyramids 126.Y and 126.Z.

Pyramids can vary in their geometry as well as their coordinated color arrangements, such as including a rhombic base. Rhombic pyramids are narrower and taller than square base pyramids 126, with the sides of the rhombic base about SQRT (3)*L, and a height of about SQRT(2)*L. Subset I can include up to three such pyramids, each having two or four colors on the four side surfaces. In rhombic pyramids with only two colors on the side surfaces, each pair of opposing surfaces have the same color. The rhombic base can include either two or four colors using this or other subsets of Color Code 1.

Table 3 shows the remaining subsets of Color Code 1. Each Subset II, III, and IV can be used to substitute or supplement Subset I according to the above descriptions. Subsets II, III, and IV follow the same geometry and general descriptions of the color arrangements as those using Subset I above, but the exact colors in a given solution can differ from the example solutions in FIGS. 10-12. Variations of cubes 122, diamonds 124, and pyramids 126 can be built with similar challenges using example Color Code 2 sets described below. In addition to the above described example solutions using a single subset, multiple subsets of Color Code 1 can be combined to create larger geometric shapes with unique and interesting color arrangements.

TABLE 3

Color Code 1 - Subsets II-IV
Color Code 1 - Subsets II-IV

| Unit ID | Cube ID | Pyramid ID | Face ID 42 α | 44 β | 46 γ | 48 δ |
|---|---|---|---|---|---|---|
| Unit 30A | | | | | | |
| A1 II | 1 | X | O | G | W | B |
| A2 II | 2 | X | W | R | G | B |
| A3 II | 3 | X | W | B | Y | G |
| A4 II | 4 | X | O | Y | B | G |
| A5 II | 1 | Y | W | O | G | Y |
| A6 II | 2 | Y | G | B | O | Y |
| A7 II | 3 | Y | Y | G | O | R |
| A8 II | 4 | Y | W | R | Y | O |
| A9 II | 1 | Z | W | G | R | O |
| A10 II | 2 | Z | O | Y | W | R |
| A11 II | 3 | Z | R | O | W | B |
| A12 II | 4 | Z | G | B | R | W |
| A1 III | 1 | X | Y | G | B | O |
| A2 III | 2 | X | W | O | B | Y |
| A3 III | 3 | X | O | B | R | Y |
| A4 III | 4 | X | R | G | Y | B |

TABLE 3-continued

Color Code 1 - Subsets II-IV
Color Code 1 - Subsets II-IV

| Unit ID | Cube ID | Pyramid ID | Face ID 42 α | 44 β | 46 γ | 48 δ |
|---|---|---|---|---|---|---|
| A5 III | 1 | Y | O | G | Y | R |
| A6 III | 2 | Y | Y | B | R | G |
| A7 III | 3 | Y | R | B | G | W |
| A8 III | 4 | Y | W | O | G | R |
| A9 III | 1 | Z | O | B | W | G |
| A10 III | 2 | Z | R | G | W | O |
| A11 III | 3 | Z | W | G | O | B |
| A12 III | 4 | Z | Y | B | O | W |
| A1 IV | 1 | X | R | Y | O | B |
| A2 IV | 2 | X | W | O | Y | B |
| A3 IV | 3 | X | W | B | R | Y |
| A4 IV | 4 | X | R | G | B | Y |
| A5 IV | 1 | Y | W | G | Y | R |
| A6 IV | 2 | Y | Y | B | G | R |
| A7 IV | 3 | Y | R | Y | G | W |
| A8 IV | 4 | Y | W | O | R | G |
| A9 IV | 1 | Z | O | Y | W | G |
| A10 IV | Z | 2 | R | G | O | W |
| A11 IV | Z | 3 | W | R | O | B |
| A12 IV | Z | 4 | Y | B | W | O |
| Unit 30B | | | | | | |
| B1 II | 1 | X | W | R | G | B |
| B2 II | 2 | X | O | G | W | B |
| B3 II | 3 | X | O | Y | B | G |
| B4 II | 4 | X | W | B | Y | G |
| B5 II | 1 | Y | G | B | O | Y |
| B6 II | 2 | Y | W | O | G | Y |
| B7 II | 3 | Y | W | R | Y | O |
| B8 II | 4 | Y | Y | G | O | R |
| B9 II | 1 | Z | O | Y | W | R |
| B10 II | 2 | Z | W | G | R | O |
| B11 II | 3 | Z | G | B | R | W |
| B12 II | 4 | Z | R | O | W | B |
| B1 III | 1 | X | W | O | B | Y |
| B2 III | 2 | X | Y | G | B | O |
| B3 III | 3 | X | R | G | Y | B |
| B4 III | 4 | X | O | B | R | Y |
| B5 III | 1 | Y | Y | B | R | G |
| B6 III | 2 | Y | O | G | Y | R |
| B7 III | 3 | Y | W | O | G | R |
| B8 III | 4 | Y | R | B | G | W |
| B9 III | 1 | Z | R | G | W | O |
| B10 III | 2 | Z | O | B | W | G |
| B11 III | 3 | Z | Y | B | O | W |
| B12 III | 4 | Z | W | G | O | B |
| B1 IV | 1 | X | W | O | Y | B |
| B2 IV | 2 | X | R | Y | O | B |
| B3 IV | 3 | X | R | G | B | Y |
| B4 IV | 4 | X | W | B | R | Y |
| B5 IV | 1 | Y | Y | B | G | R |
| B6 IV | 2 | Y | W | G | Y | R |
| B7 IV | 3 | Y | W | O | R | G |
| B8 IV | 4 | Y | R | Y | G | W |
| B9 IV | 1 | Z | R | G | O | W |
| B10 IV | 2 | Z | O | Y | W | G |
| B11 IV | 3 | Z | Y | B | W | O |
| B12 IV | 4 | Z | W | R | O | B |

Figure 13A:
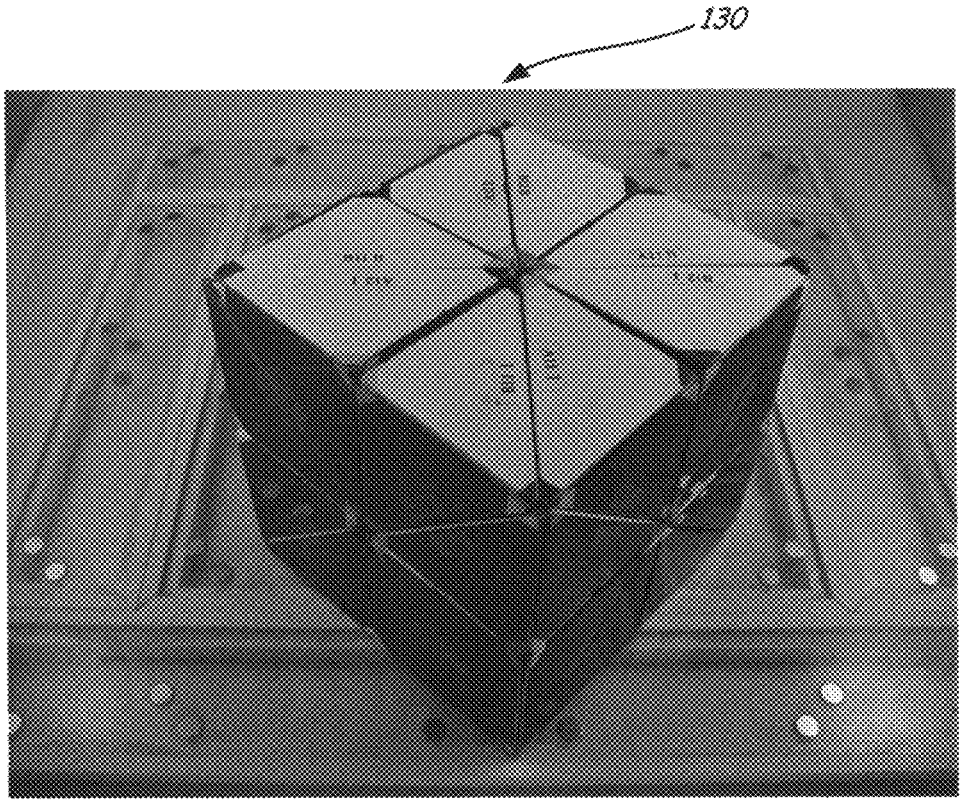
FIGS. 13A-13B are front and rear color photographs of a cube of side length 2*L having a single color unique to each outer surface, an example puzzle solution built using two subsets of Color Code 1.
Figure 13B:
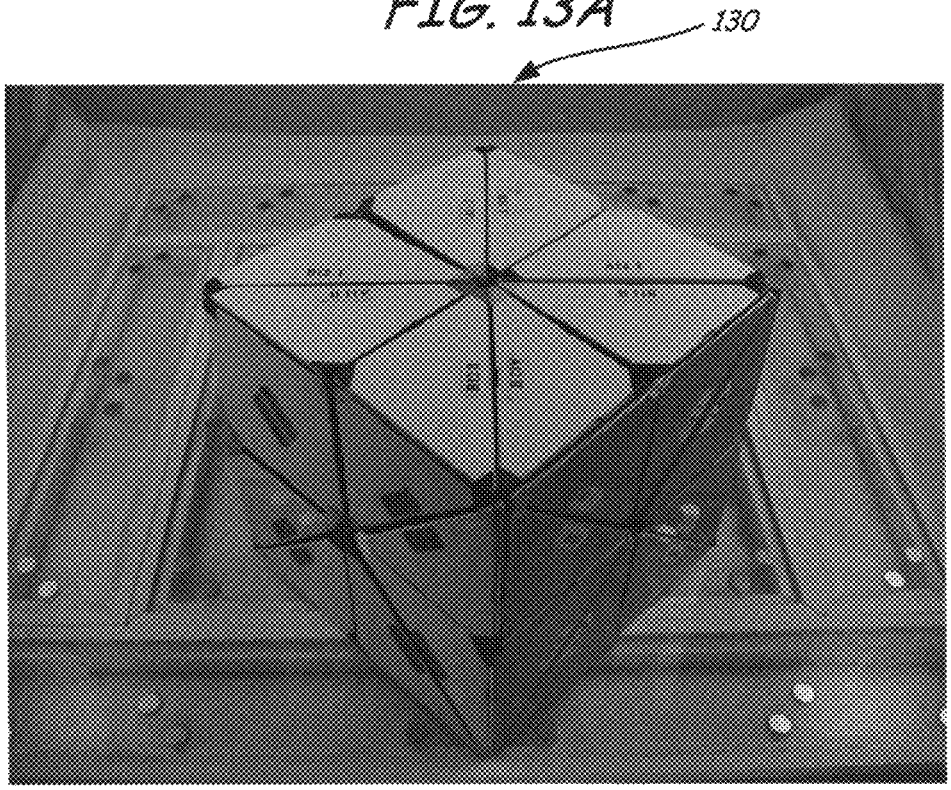

FIG. 13A is a front view of cube 130 having side length 2*L, while FIG. 13B is a rear view of cube 130. Cube 130 is one example solution using Subsets I and II. With side length 2*L, cube 130 has a volume eight times greater than small cubes 22 or 122. Since each subset in Table 3 has 24 units that can form four cubes of volume $L^3$, cube 130 of volume 8 $L^3$ can be made, at least geometrically, from 48 total units, equivalent to two complete subsets.

In this example, units from subsets I and II are joined to form cube 130 having sides with lengths of about 2*L. Cube 130 is shown with six colors, and a different color on each surface. Any two of the above subsets can be combined to form alternative embodiments of cube 130. Examples of alternative embodiments can include a different arrangement of the six colors on cube 130, as well as embodiments with only three, four, or five total colors. In certain of those embodiments, with cubes having less than six total colors, colors can match each other on one more pairs of opposing surfaces.

In FIGS. 13A-13B, cube 130 is formed from two complete subsets due to the particular color combinations required. In other embodiments, cube 130 is an assemblage of eight cubes 122 selected from more than two subsets. In yet other embodiments, a variety of puzzle unit pairs 30 can be selected from Color Code 1 to build cube 130 with two or more colors on each face and such colors being arranged in a checkerboard pattern or diamond pattern.

Figure 14A:
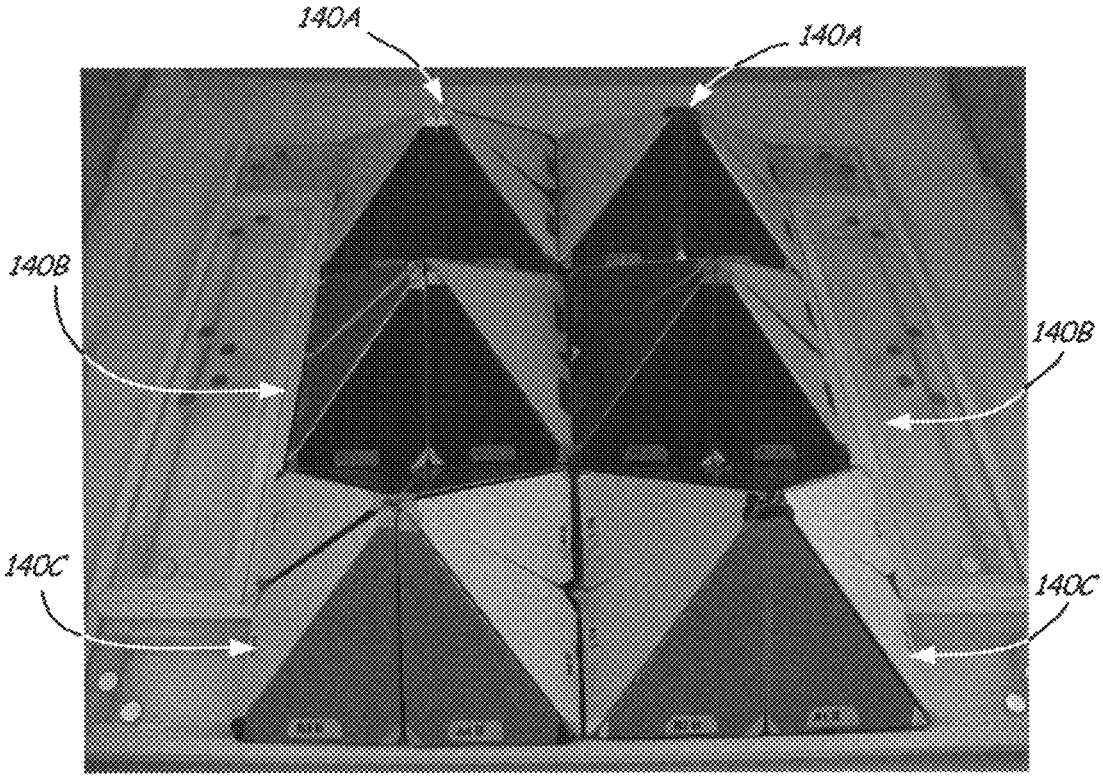
FIGS. 14A-14B are front and rear color photographs of six square-based pyramids, an example puzzle solution built using two subsets of Color Code 1.
Figure 14B:
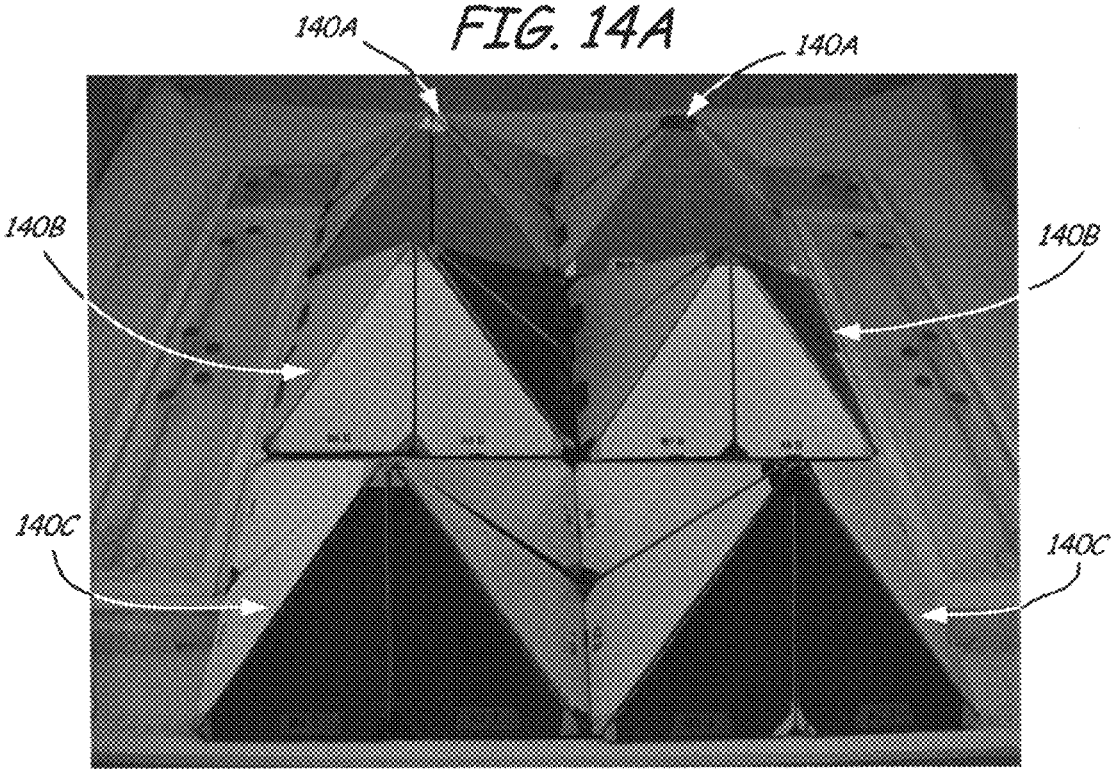

In addition to cube 130, two complete subsets can have many other challenges. It will be recognized that a full Color Code 1 set can produce two cubes 130. In certain embodiments, the two cubes can have identical or mirror image color arrangements. For example, FIGS. 14A and 14B show six pyramids built from a combination of Subsets I and II: two each of pyramids 140A, 140B, and 140C. Each pyramid 140 has a single color on the square base and a single unique color on each side surface. Pairs of pyramids 140A have identical color arrangements on their side surfaces only, as do pairs 140B and 140C. Selection of unit pairs and arrangement into pyramids 140 can be done in a similar manner as described with reference to pyramids 126 in FIGS. 12A and 12B. Unit pairs 30 can be manipulated and connector 60 positioned at the correct corners to satisfy the color requirements above.

Figure 15A:
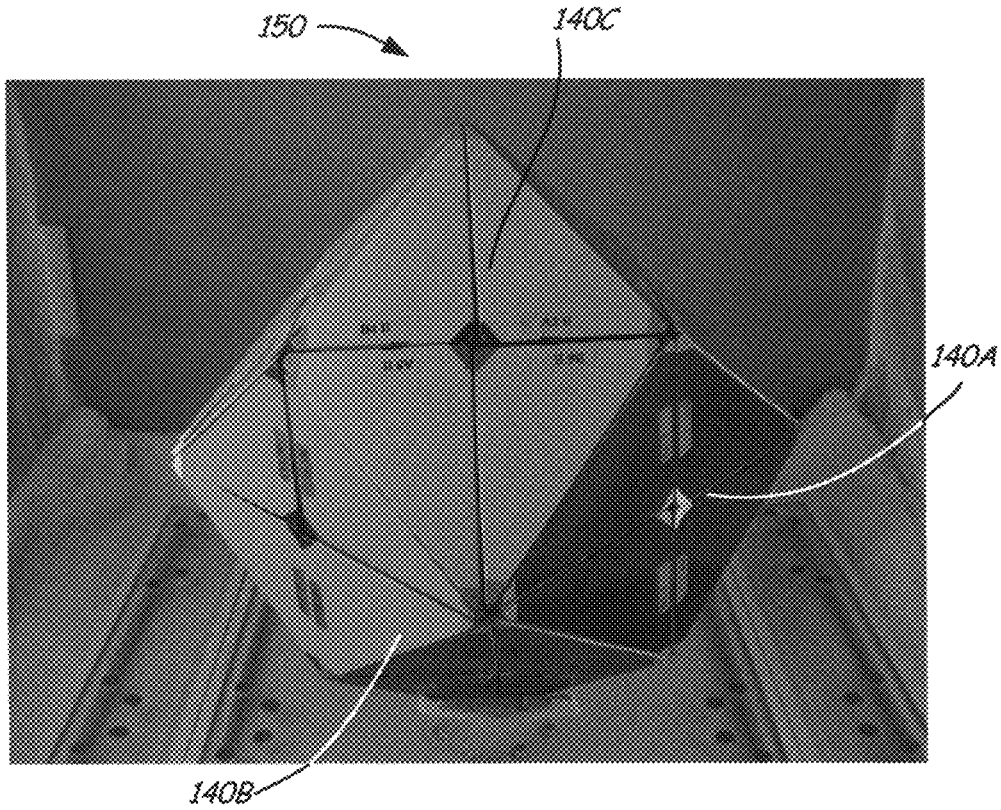
FIGS. 15A-15B are front and rear color photographs of a 12-surface hybrid puzzle solution using the six pyramids of FIGS. 14A-14B and a cube having sides of length 2*L.
Figure 15B:
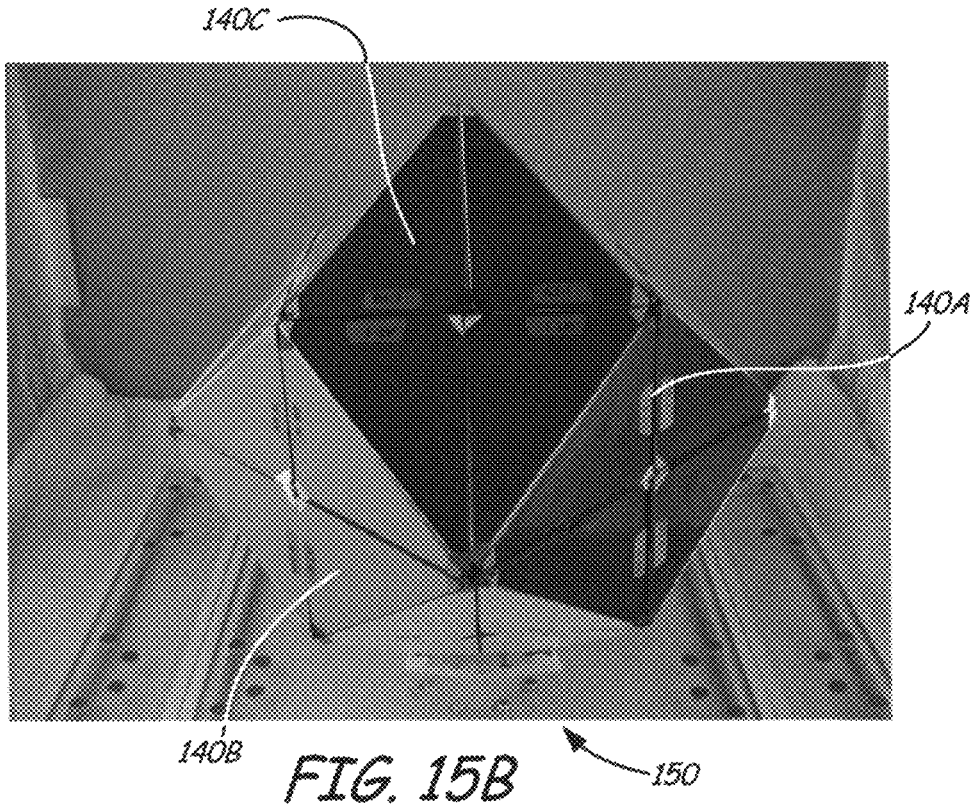

Cube 130 and pyramids 140 can be integrated with other solutions into 12-surface rhombie structure 150, shown in FIGS. 15A and 15B. Rhombic structure 150 has the square base of six pyramids, such as pyramids 140A, 140B, and 140C against each outer surface of a cube of side length 2*L, such as cube 130. Each opposing rhombus in this structure 150 has the same color. Each of cube 130 and six pyramids 140 can be built using two of the four subsets.

Since the inner cube is not visible in FIGS. 15A-15B, any suitable cube of substantially identical dimensions can be used in its place. One example is a cube with sides of length 2*L built out of one or more virtual puzzle blocks. In one example embodiment, center cube 130 is entirely replaced with virtual block 116, shown in FIG. 9G or its geometric equivalent. In such embodiments, six pyramids 140 are sufficient to create a first rhombic structure 150. In certain of those embodiments, a second structure 150 is built using a second set of pyramids 140 using subsets III and IV placed on a second virtual 2*L cube like large cube 116 or its equivalent. As should thus be apparent, as a combination of cube 130 and pyramids 140, rhombic structure 150 can be built using four subsets of Color Code 1. The four subsets can be used for two rhombic structures 150 if virtual structures like large virtual cube 116 are included.

Figure 16A:
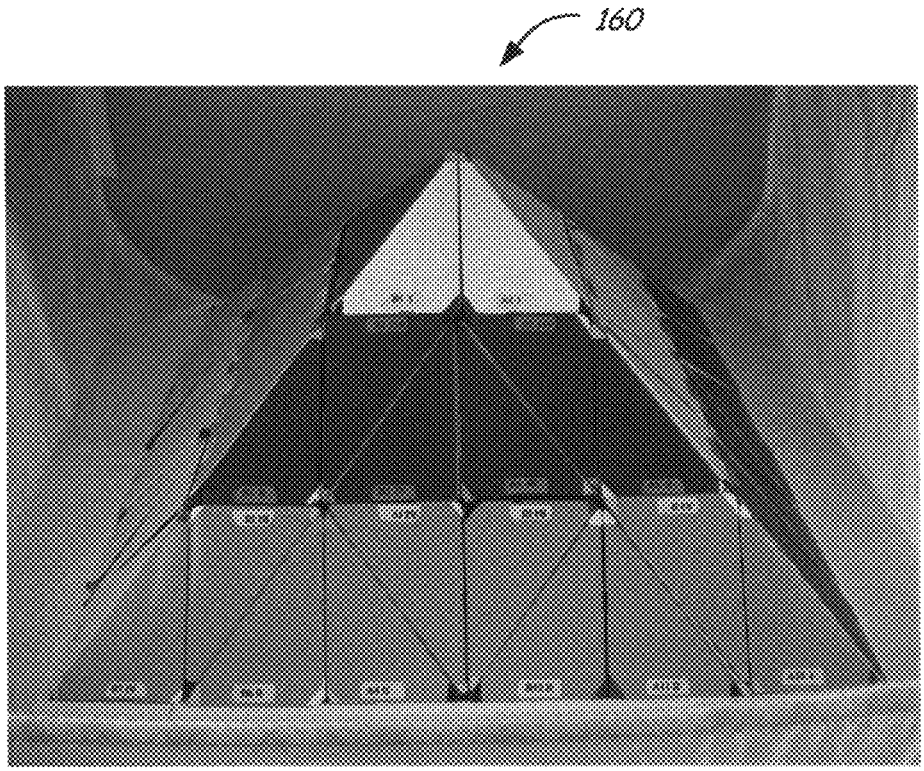
FIGS. 16A-16B are front and rear color photographs of a hybrid rainbow pyramid with a square base having sides of length 6*L and a height of 3*L built with a Color Code 1 set.
Figure 16B:
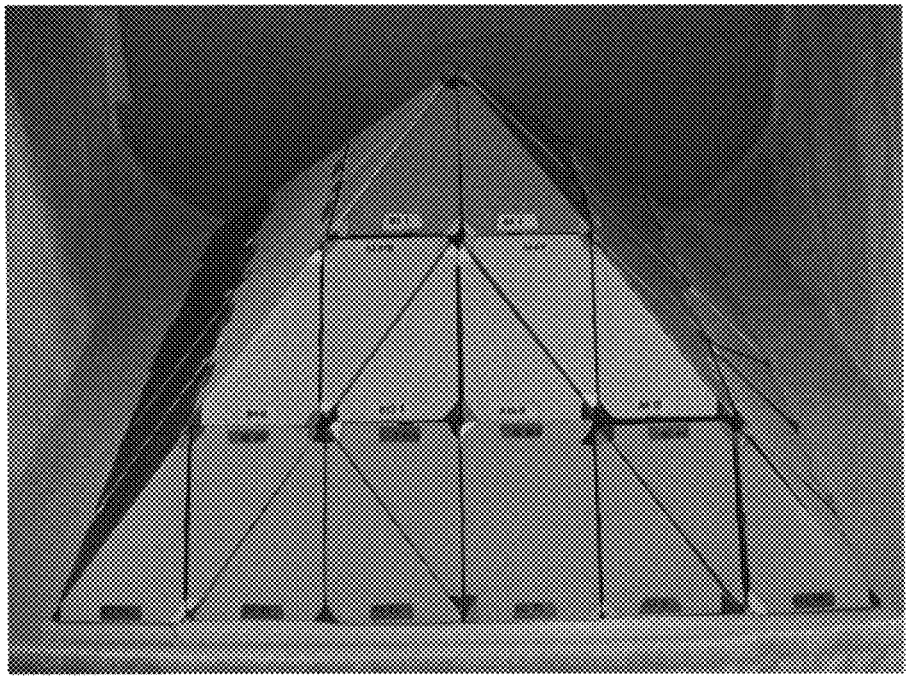

Other combinations of four subsets and a plurality of virtual puzzle blocks can also result in added solutions. FIGS. 16A and 16B are respective front and rear views of a large hybrid rainbow pyramid 160. Pyramid 160 includes a square base having sides with lengths of about 6*L and has an overall height of about 3*L. Forty-eight puzzle unit pairs 30, marked according to the complete set of Color Code 1 as listed in Tables 2 and 3, are arranged on a virtual support base to solve this particular puzzle challenge.

This challenge is a large scale version of the challenge used to build smaller square-base pyramids 140 shown in FIGS. 14A-14B as well as 12-surface rhombic structure 150. Hybrid pyramid 160 is the solution to an example color challenge including four side surfaces, each with three different colors. Each of the three colors on each side surface covers a height of about L. For example, the top third of the side surface shown at the front of FIG. 16A is white, while the middle third is red, and the bottom third is orange. It will be recognized that a similar three level rainbow progression is also seen on the other side surfaces of pyramid 160. Similar rainbow progressions also appear through many color codes and solutions. Other codes, puzzles, and challenges can be created with other related color patterns, progressions, or other criteria.

But since pyramid 160 is a hybrid puzzle solution, a number of virtual blocks are also used in this structure. For example, the color arrangement for this instance of pyramid 160 does not require specific colors on the base. Here, nearly the entire base consists of virtual blocks except the perimeter. Recall that large cube 12 in FIGS. 1A-1B is another example hybrid challenge using all four subsets of Color Code 1. As described above, large hybrid cube 12 uses all ninety-six instances of units 30A and 30B in Color Code 1 and a plurality of virtual blocks 100 and 114 complete the structure of cube 12. It will be apparent that different configurations of virtual puzzle blocks can create different skeletal structures for alternate embodiments of cube 12.

In addition, a complete set need not include one each of Subsets I, II, III, and IV to create large scale challenges. For example, with certain virtual block configurations, a hybrid 3*L cube can be built with two pairs of subsets from Color Code 1 (e.g., two sets each of Subsets I and II). This alternative to 3*L hybrid cube 12 can be built with no virtual blocks on the outer surfaces and as few as forty-five linked puzzle unit pairs 30, or ninety puzzle units 30A and 30B.

It will also be apparent that virtual blocks can replace or supplement puzzle unit pairs 30A and 30B to create countless other hybrid puzzle solutions. Further, it will be noted that several example solutions can be combined or modified into other interesting shapes such as houses or spacecraft, among others.

Example Color Code 2

In addition to the 96-unit example Color Code 1, additional solutions can be made with a set using example Color Code 2. Table 4 lists eighteen units in an example set along with possible solutions for each unit pair. As described above, a set organized according to Color Code 2 can include several puzzle challenges similar to those for single subsets of Color Code 1.

TABLE 4

Color Code 2

| | | Pyr- | Dia- | Unit 30A Faces | | | | Unit 30B Faces | | | |
|---|---|---|---|---|---|---|---|---|---|---|---|
| Unit Pair | Cube ID | amid ID | mond ID | 42 α | 44 β | 46 γ | 48 δ | 42 α | 44 β | 46 γ | 48 δ |
| A1/B1 | 1 | 2, 3 | 2 | O | G | B | R | B | G | Y | R |
| A2/B2 | 2 | 1, 4 | 1 | W | O | R | B | R | O | W | B |
| A3/B3 | 3 | 1, 4 | 1, 2 | R | Y | W | B | W | Y | R | B |
| A4/B4 | 1 | 2, 3 | 2 | G | B | Y | O | R | B | G | O |
| A5/B5 | 2 | 1, 4 | 1 | O | R | W | G | Y | R | O | G |
| A6/B6 | 3 | 1, 4 | 1, 2 | Y | R | O | G | O | R | W | G |
| A7/B7 | 1 | 2, 3 | 2 | B | Y | G | W | O | Y | B | W |
| A8/B8 | 2 | 3 | 1 | R | W | O | Y | B | W | R | Y |
| A9/B9 | 3 | 2 | 1, 2 | G | W | R | Y | G | W | O | Y |

One example challenge includes building square base pyramids similar to pyramids 126 seen in FIGS. 12A-12B. Table 4 lists four example pyramids under the Pyramid ID column. As can be seen from Table 4, a single set of Color Code 2 can be used to build two pyramids simultaneously: either square base pyramids 1 and 2, or alternatively rhombic base pyramids 3 and 4. Pyramid 1 is a square base pyramid with two colors on the base and a single color on each side surface, the same arrangement as pyramids 126 in FIGS. 12A and 12B. Other pyramids include square base pyramid 2 with the same three colors on the base as used on the four side surfaces. Pyramids 3 and 4 have rhombic bases with varying color arrangements. Pyramid 3 has two colors on the base and the remaining four colors are on the side surfaces. Like pyramid 2, pyramid 4 also includes three total colors; however, pyramid 4 includes a single color on the base and the remaining two colors are on the four side surfaces.

A group of cubes with coordinated color arrangements can also be created from a set of Color Code 2 units. Certain cube solutions are similar to those for single subsets of Color Code 1. For example, cubes 1 and 2, as identified by the cube ID number in Table 4, have identical first color arrangements, while cube 3 has a second color arrangement that is a mirror image of the first. Similar to cubes 122, each cube has a single unique color on each surface.

Figure 17A:
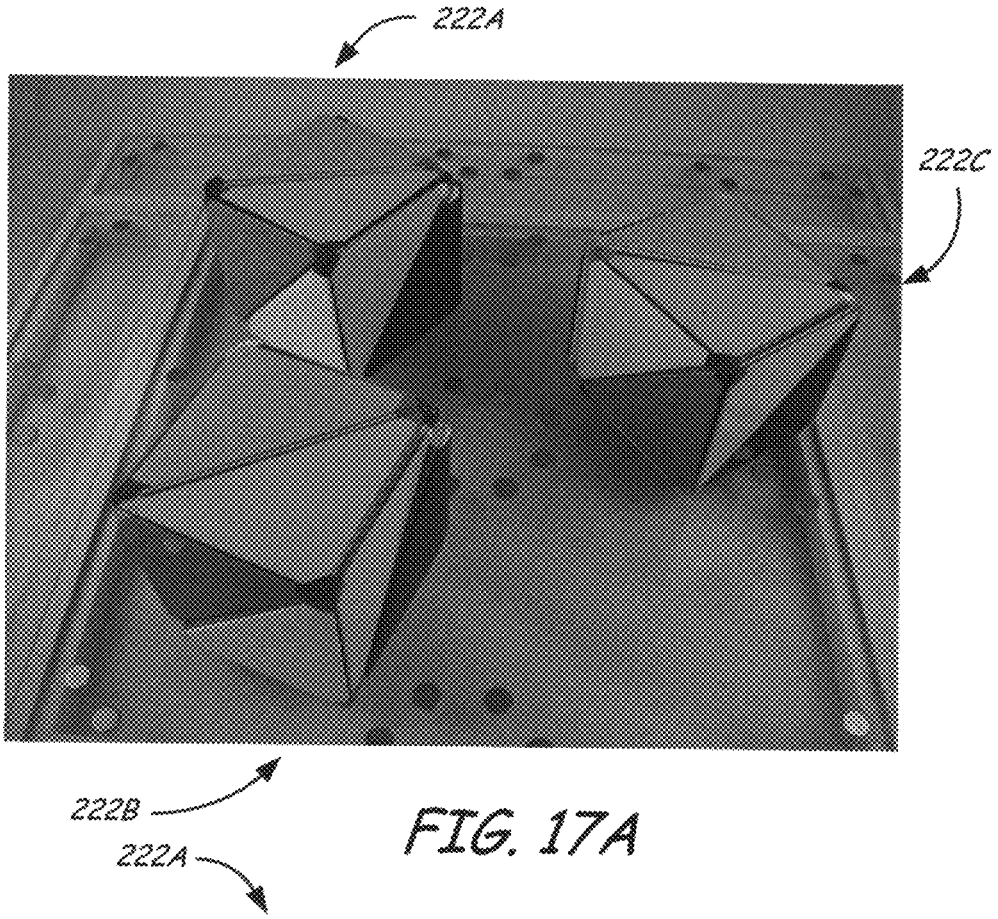
FIGS. 17A-17B are front and rear color photographs of three cubes each with two colors on each surface, an example puzzle solution built using a Color Code 2 puzzle set.
Figure 17B:
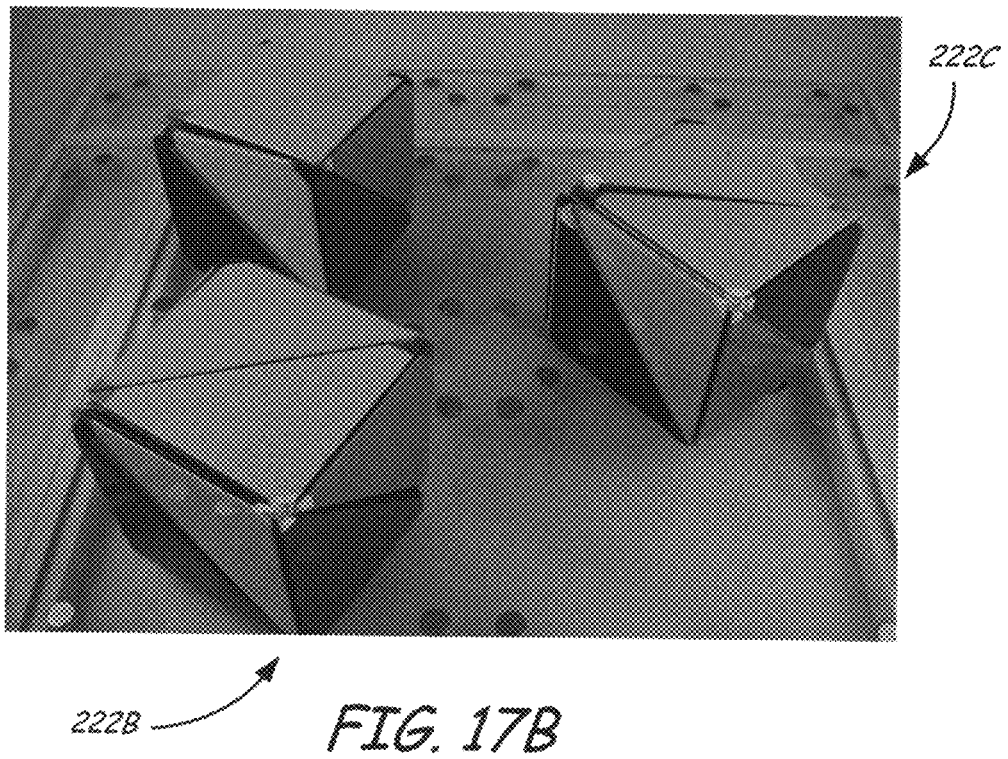

FIGS. 17A and 17B depict front and rear views of cubes 222A, 222B, and 222C with coordinated color arrangements. Each cube 222 has two colors on each surface, with colors evenly distributed (e.g., each color appears twice). Like cubes 122 in FIG. 10, as well as those from Table 4, cubes 222A and 222B have identical color arrangements. In this case, however, cube 222C has the same two colors on each of the outer surfaces of cubes 222A and 222B, but not necessarily in the same orientation. For example, the front left surfaces of both cubes 222A and 222C in FIG. 17A are both orange and white, but the positions of the orange and white triangles are reversed on the two cubes.

Other solutions using a Color Code 1 set can also be adapted to Color Code 2. For example, units in Color Code 2 can be oriented into diamond shapes like diamonds 124 in FIGS. 11A and 11B. Diamonds 1 and 2, listed under the Diamond ID column, both have color arrangements similar to diamond 124A, each with three distinct colors on the upper three surfaces, and the remaining three colors on the lower three surfaces. The color arrangement of diamond 1 is the opposite of diamond 2. In other words, the three colors present on the upper surfaces of diamond 1 are the three colors on the lower surfaces of diamond 2 and vice versa. Diamonds 1 and 2 are both solutions using Color Code 2, but because each requires six unit pairs, only one can be built using a single set of nine puzzle unit pairs 30 shown in Table 4.

For example, Table 4 indicates that diamond 1 includes unit pairs A2/B2, A3/B3, A5/B5, A6/B6, A8/B8, and A9/B9. As described above with respect to FIGS. 11A-11B, diamonds can be built by orienting three blocks 24 around a cube 22, forming a classic diamond shape with three upper surfaces and three lower surfaces. Unit pairs A3/B3, A6/B6, and A9/B9 define cube 3 from Table 4, while the three blocks 24 from cube 2 are reconfigured into blocks 24 and placed with their square bases 50 onto three outer surfaces of cube 3 as described above.

Figure 18A:
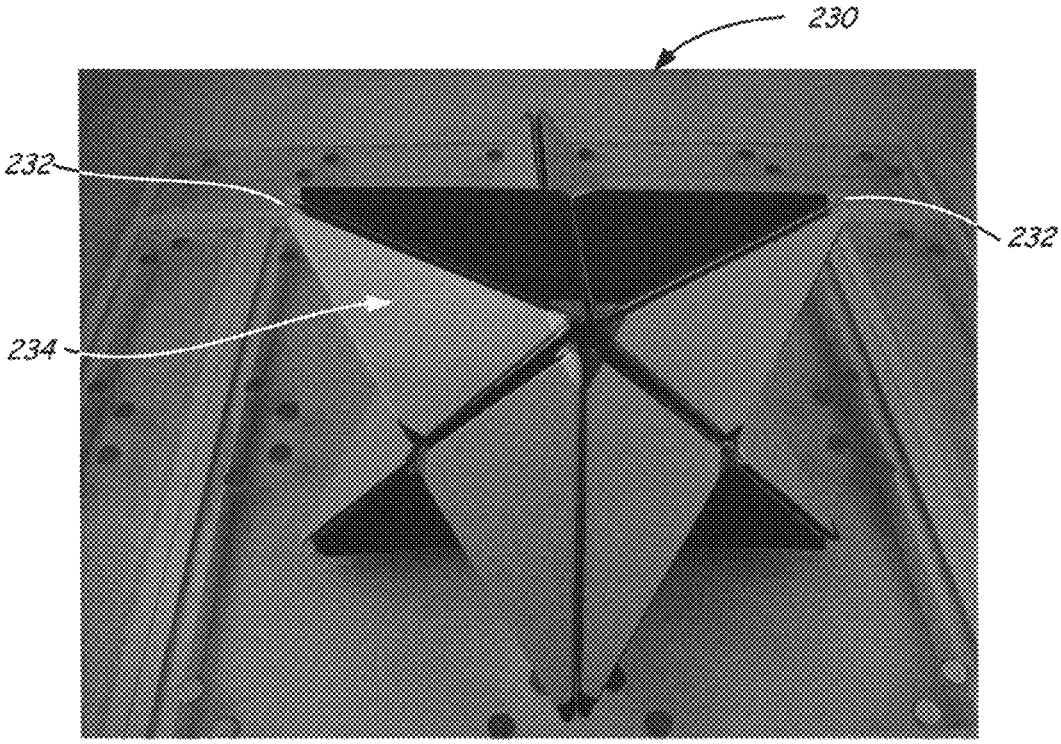
FIGS. 18A-18B are front and rear color photographs of an example puzzle solution with a star structure built using a Color Code 2 puzzle set.
Figure 18B:
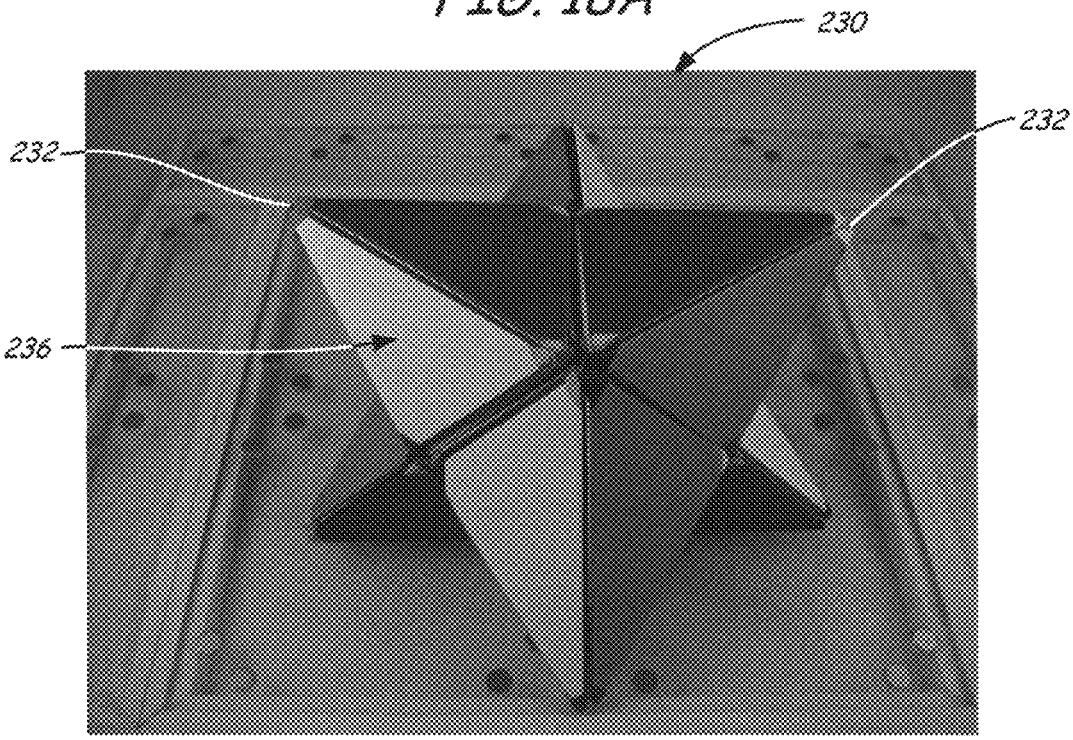

Other example solutions using all nine pairs in a Color Code 2 set are shown in FIGS. 18A-18B and 19A-19B. FIG. 18A shows star 230, which includes corners 232, and top surfaces 234. FIG. 18B shows star 230 with corners 232 and bottom surfaces 236. Star 230 has a total of eighteen outer surfaces, and can be built using all three small cubes listed in Table 4. In one example, a diamond, such as diamond 124, is built first as described above. Square bases 50 of three blocks 24 are placed onto three adjacent surfaces of cubes 22 as described above. This defines corners 232 and top 234 as seen in FIG. 18A. To convert the interim diamond shape into star 230, blocks 24 from the remaining cube are arranged on the remaining three square surfaces of the diamond in a similar manner, with the three front corners of the last three blocks 24 defining bottom 236 as seen in FIG. 18B. The color arrangement of bottom 236 has three colors when viewed from above and the remaining three colors when viewed from below.

Figure 19A:
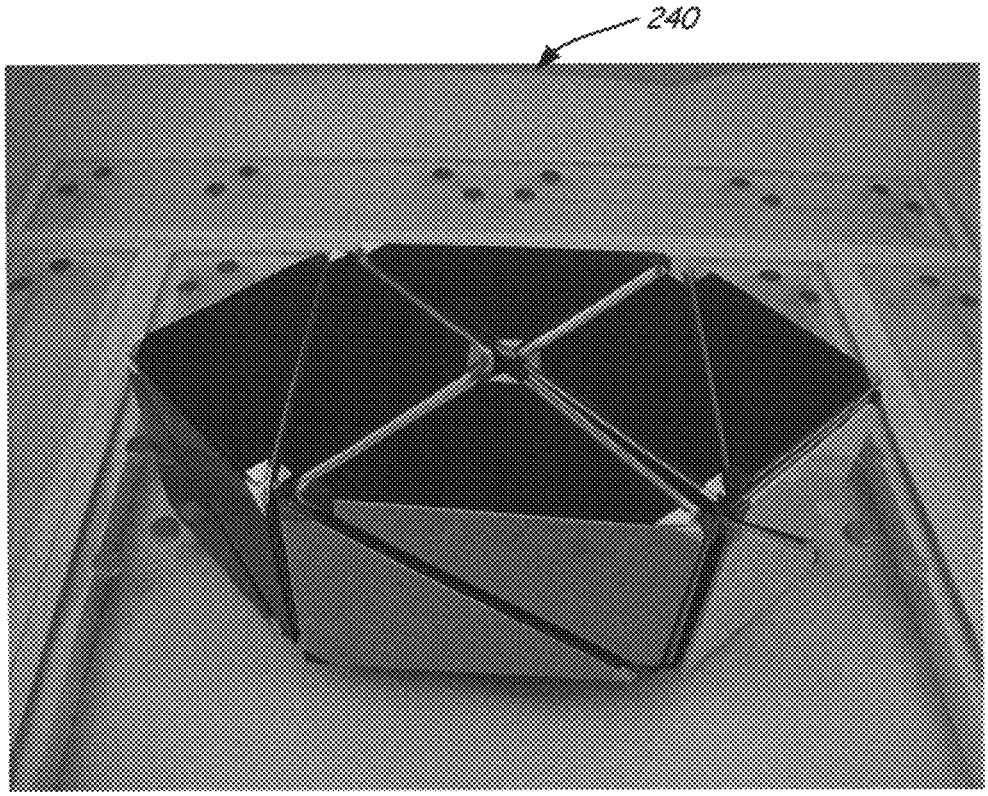
FIGS. 19A-19B are color photographs of a three-dimensional solid, a hexagonal base, and height L, an example puzzle solution built using a Color Code 2 puzzle set.
Figure 19B:
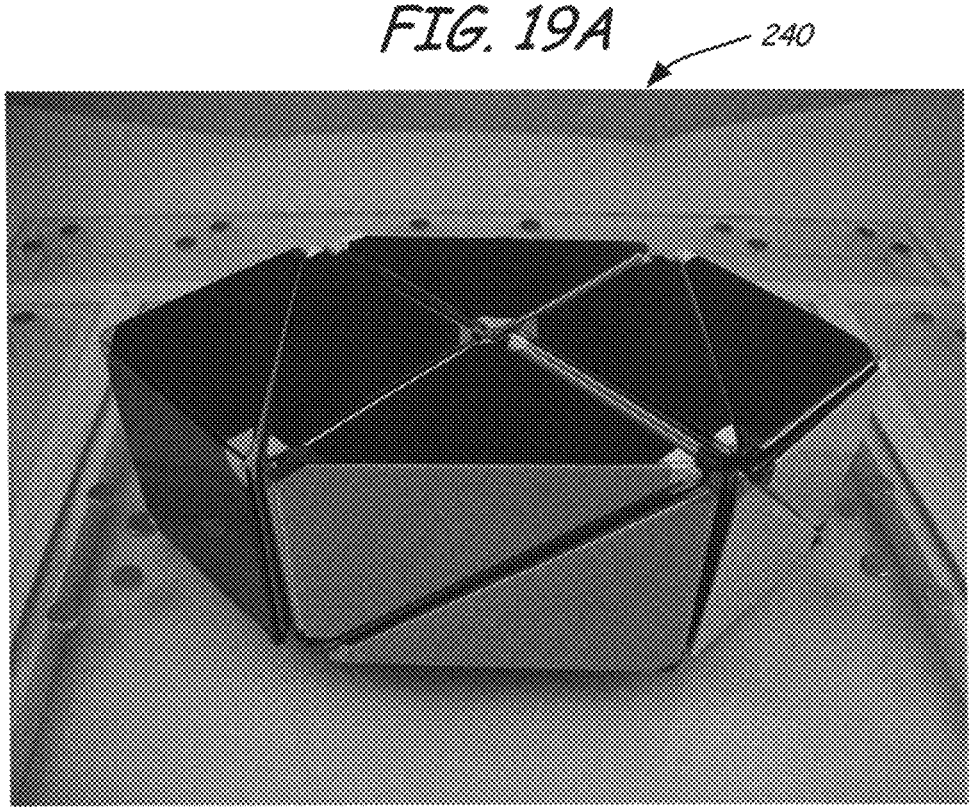

In another example challenge shown in FIGS. 19A and 19B, all eighteen units in a Color Code 2 set can define a three-dimensional solid 240 with a total of four colors. Solid 240 has hexagonal top and bottom with four sides of length L, two sides of length SQRT(2)*L, and a height of L. Viewed from the front (FIG. 19A) or the rear (FIG. 19B), solid 240 has the same color arrangement. Two opposing side surfaces of solid 240 have one color (red) while the other four side surfaces are yellow. In both figures, the top of solid 240 is blue and the base is orange.

Players will find a smaller handheld puzzle useful for amusement while traveling. A puzzle set according to example Color Code 2, or another color code having similar numbers of units, can be readily made into a portable and/or handheld device. Transportability of the puzzle can be enhanced by sizing the units such that the set fits into a small box or container.

Generally, with the example puzzle units described herein, a six-color system offers flexibility in puzzle design while providing a manageable number of puzzle solutions and ease of use for the puzzle user. However, the number of colors can be adjusted based on the number of faces on the subject puzzle units and the desired level of difficulty. It should also be apparent that faces need not be created with solid colors. Rather, it will be quickly recognized that any combination of unique colors, patterns, letters, numbers, symbols, photographs, or other features can be placed on unit faces without departing from the scope or spirit of the invention.

The above described solutions are only a small fraction of the interesting shapes and challenges that can be created. For example, one or more groups of pyramids and cubes can be combined into shapes resembling houses, spacecraft, or other large complex structures. And it will be apparent that color arrangements of the smaller solutions can be coordinated such that the larger solutions have a coherent color arrangement as well. In addition, the example solutions described are not limited to being built with sets organized using Color Code 1 or Color Code 2, but rather any code or organization for paired geometric mirror image puzzle units.

It will also be apparent that pyramids 26, or other example solutions described herein are not limited to the ratios of the faces on units 30A and 30B. For example, geometric mirror image puzzle units 30A and 30B can alternatively be created in the shape of blocks 28, which are also tetrahedrons. These can be linked by a similar connector, and be configurable into various larger blocks. In such a case, it will be apparent that only two of these large tetrahedral blocks can be used to build pyramids 26 or their related colored puzzle solutions.

It should be noted that other color codes are possible apart from the two disclosed codes. A manufacturer or designer can build sets using their own color code. A user can create a color code of his or her own by disassembling and reassembling puzzle sets organized into an existing color code. Alternatively, the user can create new codes and/or solutions by mixing and matching components from multiple sets organized by other criteria (e.g. by size, color, etc.).

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

What is claimed is:

1. A first puzzle unit comprising:

a first puzzle unit assembly including a first support member and a second support member projecting from a first inner surface of the first unit assembly, and a first triangular unit face on an outer surface of the first unit assembly, with a space between the first support member and the second support member defining a first linear slot;

a second puzzle unit assembly geometrically identical to the first unit assembly, including a third support member and a fourth support member projecting from a second inner surface of the second unit assembly, and a second triangular unit face on an outer surface of the second unit assembly, with a space between the third support member and the fourth support member defining a second linear slot, the second unit assembly, rotated relative to the first unit assembly such that the second linear slot aligns with the first linear slot, a portion of the first support member overlaps with a portion of the fourth support member, a portion of the second support member overlaps with a portion of the third support member, and a common edge defines an angle of about 60° between the first unit face and the second unit face;

a third removable unit face engaged with the first support member or the fourth support member such that the third unit face occupies a plane substantially parallel to planes occupied by overlapping first and fourth support members; and a fourth removable unit face engaged with the second support member or the third support member such that the fourth unit face occupies a plane substantially parallel to planes occupied by overlapping second and third support members.

2. The first puzzle unit of claim 1, wherein one or more pins projecting from a third inner surface of the third removable unit face are received by one or more corresponding apertures on the first and fourth support members, the apertures aligned with the one or more pins, locking the first unit face and second unit face along the common edge.

3. The first puzzle unit of claim 1, wherein the first and second unit faces are right triangles with sides measuring about L, about SQRT(2)*L, and about SQRT(3)*L, and the third and fourth unit faces are right triangles with side lengths measuring about L, about L, and about SQRT(2)*L such that the first puzzle unit is a tetrahedral solid.

4. The first puzzle unit of claim 1, wherein the first unit face includes a color or design selected according to a predetermined code.

5. The first puzzle unit of claim 4, wherein a first corner of the puzzle unit is marked to identify the color or design on the first unit face, the first unit face located opposite the first corner.

6. The first puzzle unit of claim 1, further comprising a unit connection system including a single flexible connector having a flexible section, a slider with a passage for movement of the flexible section through a body of the slider, and a first linkage securing the flexible section to the first puzzle unit at a strut fixed to at least one surface on an interior volume of the puzzle unit, the connector repositionable between at least a first corner and a second corner of the first puzzle unit without detaching or disassembling the connector, the slider guiding the connector between the corners by traveling along a predefined path on the interior volume of the first puzzle unit.

7. The first puzzle unit of claim 6, wherein the strut is fixed between the first inner surface and the first support member.

8. The first puzzle unit of claim 6, wherein the unit connection system also includes one or more magnets proximate one or more unit faces.

9. The first puzzle unit of claim 6, wherein at least the third face or the fourth face are beveled along a right angle edge to accommodate the flexible section of the connector traveling between the first corner and the second corner.

10. The first puzzle unit of claim 6, wherein the predefined path for the slider comprises a first longitudinal channel section bonded to the first support member and a second longitudinal channel section bonded to the third support member, the channel sections defining a substantially cylindrical channel having a first longitudinal conduit and a second longitudinal conduit radially opposite the first conduit.

11. The first puzzle unit of claim 10, wherein a metallic portion of the slider is held by a first magnet to a first end of the first channel proximate the first corner of the first puzzle unit or by a second magnet to a second end of the channel proximate the second corner of the first puzzle unit to assist in retaining the slider proximate a selected first corner or second corner.

12. The first puzzle unit of claim 11, wherein the connector also includes a first elastic section operably attached between the first linkage and the flexible section.

13. The first puzzle unit of claim 12, wherein the connector also includes a swivel coupling operably attached between the flexible section and the first elastic section.

14. A puzzle unit pair comprising:

a first tetrahedral puzzle unit with faces marked in a first color progression according to a predetermined color code;

a second tetrahedral puzzle unit with faces marked in a second color progression according to the predetermined color code, the second puzzle unit being a geometric mirror image of the first puzzle unit; and a connector having a first linkage attached to a first surface on an interior volume of the first puzzle unit, and a second linkage attached to a second surface on an interior volume of the second puzzle unit, the connector being repositionable between a first corner and a second corner of the respective puzzle units without detaching or disassembling the connector;

wherein the connector also includes a flexible filament section disposed between the first linkage and the second linkage.

15. The puzzle unit pair of claim 14, wherein the first and second puzzle units each have two large triangular faces and two small triangular faces, the large triangular faces having sides measuring about L, about SQRT(2)*L, and about SQRT(3)*L, and the small triangular faces having sides measuring about L, about L, and about SQRT(2)*L.

16. The puzzle unit pair of claim 15, wherein the predetermined code is selected from one of: Color Code 1, Subset I in Table 2; Color Code 1, Subset II in Table 3; Color Code 1, Subset III in Table 3; Color Code 1, Subset IV in Table 3; and Color Code 2 in Table 4.

17. The puzzle unit pair of claim 15, wherein the puzzle unit pair is configured into a first colored puzzle block by placing at least one portion of the first puzzle unit adjacent to a corresponding portion of the second puzzle unit.

18. The puzzle unit pair of claim 17, wherein the first colored puzzle block has an open configuration with an edge of the first puzzle unit flush against a corresponding edge of the second puzzle unit, such that a face of the first puzzle unit and a face of the second puzzle unit define a first continuous surface of the first colored puzzle block.

19. The puzzle unit pair amusement device of claim 17, wherein the first colored puzzle block has a closed configuration including five outer surfaces and five corners, with a large face of the first puzzle unit flush against a corresponding large face of the second puzzle unit, such that a small face of the first puzzle unit and a small face of the second puzzle unit define a square base with sides of length L.

20. The puzzle unit pair of claim 17, wherein the first colored puzzle block has a closed configuration including four outer surfaces and four corners, with a small face of the first puzzle unit flush against a corresponding small face of the second puzzle unit, such that a second face of the first puzzle unit and a second face of the second puzzle unit define a triangular base.

21. The puzzle unit pair of claim 17, wherein the first colored puzzle block has a first geometry and a first color pattern when a first end of the connector is positioned at the first corner of the first puzzle unit and a second end of the connector is positioned at the first corner of the second puzzle unit.

22. The puzzle unit pair of claim 21, wherein the first colored puzzle block has a first geometry and a second color pattern different from the first color pattern when a first end of the connector is positioned at the second corner of the first puzzle unit and a second end of the connector is positioned at the first corner of the second puzzle unit.

23. The puzzle unit pair of claim 21, wherein the first colored puzzle block has a first geometry and a third color pattern different from the first color pattern when a first end of the connector is positioned at the first corner of the first puzzle unit and a second end of the connector is positioned at the second corner of the second puzzle unit.

24. The puzzle unit pair of claim 21, wherein the first colored puzzle block has a first geometry and a fourth color pattern when a first end of the connector is positioned at the second corner of the first puzzle unit and a second end of the connector is positioned at the second corner of the second puzzle unit.

25. The puzzle unit pair of claim 24, wherein the fourth color pattern is different from the first color pattern.

26. A tetrahedral puzzle unit comprising:

a first triangular unit face having an inner surface and an outer surface;

a second triangular unit face having an inner surface and an outer surface, the second triangular unit face geometrically identical to the first triangular unit face, the first and second triangular unit faces arranged along a common edge to define an angle of about 60° therebetween;

a first support member projecting away from the inner surface of at least one of the first triangular unit face and the second triangular unit face;

a second support member projecting away from the inner surface of the other of the first triangular unit face and the second triangular unit face, the first and second support members aligned such that a space between the first support member and the second support member defines a first linear slot;

a third removable triangular unit face engaged with one of the first support member and the second support member such that the third triangular unit face occupies a plane substantially parallel to a plane occupied by the one of the first and second support members; and a fourth removable triangular unit face engaged with the other of the first support member and the second support member such that the fourth triangular unit face occupies a plane substantially parallel to a plane occupied by the other of the first and second support members.

27. The tetrahedral puzzle unit of claim 26, wherein the first and second unit faces are right triangles with sides measuring about L, about SQRT(2)*L, and about SQRT(3)*L, and the third and fourth unit faces are right triangles with side lengths measuring about L, about L, and about SQRT(2)*L such that the first puzzle unit is a tetrahedral solid.

28. The tetrahedral puzzle unit of claim 27, wherein the first, second, third, and fourth unit faces all include a color or design selected according to a predetermined code, the predetermined code selected from one of: Color Code 1, Subset I in Table 2; Color Code 1, Subset II in Table 3; Color Code 1, Subset III in Table 3; Color Code 1, Subset IV in Table 3; and Color Code 2 in Table 4.

29. The tetrahedral puzzle unit of claim 28, wherein at least one of a first corner, a second corner, a third corner, and a fourth corner of the puzzle unit is marked to identify the color or design on at least one of the first, second, third, and fourth unit faces marked according to the predetermined code, the first, second, third, and fourth corners each located opposite the respective first, second, third, and fourth unit faces.

30. The tetrahedral puzzle unit of claim 28, further comprising:

a connector retained on an interior volume of the tetrahedral puzzle unit, the connector being repositionable between a first corner and a second corner of the puzzle unit without detaching or disassembling the connector;

wherein the connector includes a flexible filament section.

31. The tetrahedral puzzle unit of claim 30, wherein at least one of the third unit face and the fourth unit face is beveled along a right angle edge to accommodate the flexible section of the connector traveling between the first corner and the second corner.

32. The tetrahedral puzzle unit of claim 30, wherein the connector also includes a metallic element disposed along the flexible filament section, the metallic element holding the connector alternately at the first corner of the puzzle unit by a first embedded magnet, and at the second corner of the puzzle unit by a second embedded magnet.

* * * * *

UNITED STATES PATENT AND TRADEMARK OFFICE

CERTIFICATE OF CORRECTION

PATENT NO. : 8,727,351 B2
APPLICATION NO. : 12/807100
DATED : May 20, 2014
INVENTOR(S) : Mosen Agamawi It is certified that error appears in the above-identified patent and that said Letters Patent is hereby corrected as shown below:

In the Specification

Col. 10, Line 31
Delete "minor"
Insert --mirror--

Col. 35, Line 36
Delete "12413"
Insert --124B--

Signed and Sealed this
Sixteenth Day of September, 2014

Michelle K. Lee

Michelle K. Lee
*Deputy Director of the United States Patent and Trademark Office*